US005957450A

United States Patent [19]

Kida et al.

[11] Patent Number: 5,957,450

[45] Date of Patent: Sep. 28, 1999

[54] SHEET DISCHARGING APPARATUS HAVING SELECTABLE TEMPORARY TRAY FOR TEMPORARILY RECEIVING SHEETS IN A REVERSED STATE

[75] Inventors: Hiroshi Kida, Yamatokoriyama; Syoichiro Yoshiura, Tenri, both of Japan

[73] Assignee: Sharp Kabushiki Kaisha, Osaka, Japan

[21] Appl. No.: 08/920,315

[22] Filed: Aug. 27, 1997

[30] Foreign Application Priority Data

Aug. 30, 1996 [JP] Japan ..... 8-229580
Oct. 1, 1996 [JP] Japan ..... 8-260425

[51] Int. Cl.[6] ..... B65H 39/11

[52] U.S. Cl. ..... 271/291; 271/298; 271/186; 271/902

[58] Field of Search ..... 271/3.01, 3.09, 271/287, 288, 298, 65, 186, 291; 270/58.11, 58.2, 58.22

[56] References Cited

U.S. PATENT DOCUMENTS

| | | | |
|---|---|---|---|
| 4,146,215 | 3/1979 | Mol | 270/58.2 |
| 4,428,572 | 1/1984 | Burke | 271/902 X |
| 4,534,643 | 8/1985 | Watanabe | 271/65 X |
| 4,787,616 | 11/1988 | Sasaki et al. | 271/291 X |
| 4,941,023 | 7/1990 | Holmes et al. | 271/288 X |
| 4,945,390 | 7/1990 | Hasegawa et al. | 399/405 |
| 5,166,739 | 11/1992 | Katsuki et al. | 399/401 |
| 5,201,517 | 4/1993 | Stemmle | 271/291 |
| 5,258,045 | 11/1993 | Yamashita | 271/902 X |
| 5,331,389 | 7/1994 | Fukuchi et al. | 271/291 X |
| 5,570,877 | 11/1996 | Asami et al. | 271/902 X |

FOREIGN PATENT DOCUMENTS

| | | |
|---|---|---|
| 362180869 | 8/1987 | Japan . |
| 62-180869 | 8/1987 | Japan . |
| 363196452 | 8/1988 | Japan . |
| 05310357 | 11/1993 | Japan . |

OTHER PUBLICATIONS

U.S. application No. 08/855,216, filed May 13, 1997.

*Primary Examiner*—William E. Terrell
*Assistant Examiner*—Patrick Mackey
*Attorney, Agent, or Firm*—David G. Conlin; William J. Daley, Jr.

[57] ABSTRACT

A sheet discharging apparatus has a plurality of trays for receiving sheets from an image forming apparatus and discharge rollers corresponding to the respective trays. The discharge rollers are rotatable in forward and reverse directions. The sheet discharging apparatus has a transport path for connecting the trays and a sheet discharge opening of the image forming apparatus. A gate for switching the destinations of sheets is disposed at each branched point in the transport path. A selected tray for finally receiving sheets is selected from the trays, and a temporary tray is selected from the trays other than the selected tray. A sheet is temporarily fed in a non-reversed state to the temporary tray from the image forming apparatus. Then, by rotating the discharge rollers in the reverse direction, the sheet is discharged in a reversed state to the selected tray from the temporary tray. A tray which can efficiently execute reverse discharge processing is appropriately specified according to the selected tray. It is thus possible to discharge sets of sheets with their image-formed side facing downward in page order without using a special switchback mechanism or decreasing the sheet output speed from the image forming apparatus.

34 Claims, 24 Drawing Sheets

52a
52b
52c
52d
52e
52f
53a
53b
53c
53d
53e
53f
P5
P4
P3
P2
P(P1)

P(P1)
53a
P2
P3
P4
P5
53e
53f
52a
52b
52c
52d
52e
52f

53a
P2
P3
P4
P5
P(P1)
53f
52a
52f

P6
P3
P4
P5
P2
53f
52a
52f 52a
52b
52c
52d
52e
52f
53a
53b
53c
53d
53e
53f
P5
P4
P3
P2
P(P1)

SHEET DISCHARGING APPARATUS HAVING SELECTABLE TEMPORARY TRAY FOR TEMPORARILY RECEIVING SHEETS IN A REVERSED STATE

FIELD OF THE INVENTION

The present invention relates to a sheet discharging apparatus provided in a discharge section of an image forming apparatus such as a digital copying machine available on the market, for discharging a recording paper (sheet) having an image formed thereon, and more particularly relates to a sheet discharging apparatus for sequentially outputting sheets in page order from the discharge section.

BACKGROUND OF THE INVENTION

Recently digital copying machines are provided with not only a normal copy mode in which a document image read by a reading section of such a copying machine is printed on a copying sheet, but also a printer mode, a fax mode, etc., in which image data received from an external data processing device are printed. In the printer mode, image data are received from an external data processing device such as a computer (including a personal computer), a word processor, etc., and printed on a copying sheet as an image. In the fax mode, the image data are received from an external image processing apparatus through communication means such as a telephone line, and printed on a copying sheet.

In general, in the normal copy mode, sheets are sequentially discharged in a state in which a surface of the sheet on which an image has been printed faces upward (the face-up state). On the other hand, in the printer mode or the fax mode, sheets are discharged in a state in which the surface having the image formed thereon faces downward (the face-down state).

Namely, in the normal copy mode, documents are controlled to be sent to the reading section of the copying machine in sequence from the last page of the documents in consideration of the page order when sheets are discharged after the formation of the images. In this case, an automatic document feeder provided in the copying machine is used. Thus, printed materials (hard copies) of the document images are discharged in sequence in the same page order as the document.

On the other hand, when the digital copying machine functions as a printer or a facsimile machine, in general, image data are sent in sequence from the top page of the document from an external apparatus like a personal computer, a word processor, a facsimile machine, etc. Therefore, when discharging the sheets in sequence from the discharge section, if the received image data are printed on the copying sheets and then the sheets are stacked in the face-up state on the discharge trays, the printed materials are output in reverse page order.

In order to solve such a problem, in general, it has been proposed to arrange the printed materials in page order by turning over the sheets being discharged in the described state and stacking the sheets with their image-formed sides facing downward on the discharge section.

Such a discharging function is enabled by, for example, an apparatus disclosed in Japanese Publication for Unexamined Patent Application No. 310357/1993 (Tokukaihei 5-310357). The structure of the apparatus will be briefly explained below.

As described in the above-identified Japanese publication (see also FIGS. 1 and 3–4 thereof), when a toner image on a photoreceptor is transferred to a copying sheet sent from a feed tray, the copying sheet is discharged out of the apparatus through a fusing device. The apparatus is provided with a discharge processing unit for switching the discharge state of a sheet according to a mode selected, i.e., a copy mode or a printer mode. When the image forming apparatus is set in the copy mode, the sheet is discharged with its image-formed side facing upward onto a discharge tray from a discharge opening through a predetermined transport path in the discharge processing unit. On the other hand, in the printer mode, the transport path is switched, and the sheet is once guided to a switchback transport path through a predetermined transport path. Thereafter, the transport direction is switched so that the sheet is discharged with its image-formed side facing downward from the discharge opening onto another discharge tray provided below the above-mentioned discharge tray.

As switch means for switching the transport direction of a sheet in the transport path, the structure where members like the switching members are provided in the transport path to switch ON/OFF solenoids is adopted.

Japanese Publication for Unexamined Patent Publication No. 180869/1987 (Tokukaisho 62-180869) proposes to form a discharge section provided with a sheet discharging apparatus having a sorting function for discharging a sheet having an image printed thereon from a page printer to one of a plurality output bins after turning over the sheet. As described in this publication (see also FIG. 1 thereof), sheets sent to a sorter through a fusing device and a discharge roller of a page printer are temporarily guided to reverse rollers by transport rollers. Thereafter, the transport direction of the sheets is reversed in a predetermined state, and then the sheets are discharged to bins ($BN_1$ to $BN_{n-1}$), respectively. As a result, the sheets having the images printed thereon are discharged in proper page order.

In the structure described in the above-mentioned publication (Tokukaihei 5-310357), it is necessary to provide a digital image forming apparatus with a switchback transport path and the mechanism therefor as a sheet discharging apparatus for switching the transport direction of sheets having images formed thereon.

The provision of the switchback transport path and the mechanism cause an increase in the overall size of the image forming apparatus, thereby presenting a problem that a large space is required for the installation of the apparatus in an office. Moreover, it is necessary to provide a switchback transport path and a transport mechanism, which can reverse a sheet of the maximum printable size in the image forming apparatus. Consequently, the device tends to be gigantic, causing a disadvantage in terms of costs.

Moreover, during a period of time in which the transport direction of the preceding sheet is reversed in the switchback transport path and then transported to a predetermined bin (tray), the following sheet is kept waited. When the preceding sheet has been transported to the predetermined bin, the following sheet is transported to its switchback transport path. Namely, the next sheet cannot be fed during the reverse transport operation, and therefore the transport interval between sheets becomes longer. This prevents an increase in the output speed. In particular, the discharging operation cannot be performed according to the processing speed of the image forming apparatus. Thus, there is a need to adjust the processing speed of the image forming apparatus to meet with the processing speed of the switchback transport path.

Furthermore, according to the above-mentioned publication (Tokukaisho 62-180869), since a mechanism used exclusively for reversing the sheet is provided in the sorter as the sheet discharging apparatus as well as a plurality of bins (trays) for storing sheets, the increase in the size of the image forming apparatus, i.e., the printer, is prevented. However, in the structure where the reversing mechanism is provided in the sorter in addition to the sorting function, the reversing mechanism cannot be used as the sheet discharge section. Namely, since the reversing mechanism is used exclusively for turning over a sheet when discharging sheets, the reversing mechanism becomes a useless member for the discharge section unless the reversing mechanism is used.

Additionally, since the sheet is always turned over in a predetermined reversing section, it may take a long time to feed a sheet to a predetermined tray.

Moreover, when the preceding sheet is being reversed by the reversing mechanism, the next sheet is kept waited before the reversing mechanism, and the waiting sheet is fed to the reversing mechanism after the completion of the reversal of the preceding sheet. Consequently, like the device disclosed in the former publication (Tokukaihei 5-310357), the distance between the discharging position and the next sheet to be discharged becomes longer. It is therefore necessary to adjust the output speed of the printer to meet with the discharge processing speed. In particular, when the processing speed of the printer is faster than the discharge processing speed, a considerable economical disadvantage is caused, and the printer is provided with an excessively high processing speed.

SUMMARY OF THE INVENTION

It is an object of the present invention to provide a sheet discharging apparatus capable of simplifying the discharge of sheets having images formed thereon.

It is another object of the present invention to provide a sheet discharging apparatus capable of reducing the size of an image forming apparatus main body and discharging a sheet in a reversed state in which the front side and the back side of the sheet are reversed.

It is still another object of the present invention to provide a sheet discharging apparatus capable of efficiently arranging sheets having images formed thereon, which are output successively from an image forming apparatus, in a predetermined order without delay.

It is yet another object of the present invention to provide a sheet discharging apparatus capable of increasing the processing speed by arbitrarily selecting a selected tray that finally receives a sheet having an image formed thereon in the reversed state and specifying a tray that achieves the highest efficiency for a temporary tray for use in reverse-discharging the sheet according to the selected tray.

In order to achieve the above objects, a sheet discharging apparatus of the present invention is characterized in including:

(1) a plurality of trays for receiving sheets having images formed thereon that are discharged from an image forming apparatus;

(2) a sheet transport path disposed to feed the sheets from the image forming apparatus to the plurality of tray, respectively;

(3) discharge rollers which are disposed to correspond to the plurality of trays, respectively, and rotatable in a direction of feeding the sheets to the trays and in the reverse direction; and (4) sheet transport controlling means which specifies one of the plurality of trays for a selected tray that finally receives the sheets in a reversed state in which the front side and the back side of the sheets are reversed, selects at least one tray from the plurality of trays except the selected tray for a temporary tray that temporarily receives the sheets in a non-reversed state in which the front side and the back side of the sheets are not reversed, wherein the temporary tray is selected according to which tray is specified for the selected tray, and controls the discharge rollers so that at least a discharge roller corresponding to the temporary tray is rotated in the reverse direction in feeding the sheet to the temporary tray and discharges the sheet in the reversed state to the selected tray.

In this structure, the selected tray and the temporary tray are not fixed, and suitable trays are specified for the selected tray and temporary tray through the sheet transport controlling means. This is an essential feature of the present invention. Accordingly, it is possible to specify the selected tray so that the sheets are most effectively distributed in the reversed state to the plurality of trays, respectively, according to various sheet output modes of the image forming apparatus and the number of sheets to be output, and select the temporary tray according to which tray is specified for the selected tray.

The modes include, for example, a grouping mode and a sorting mode, and specific examples thereof will be explained in detail in the following embodiment.

For example, when discharging several pages of sheets in the reversed state to a single tray, it is possible to specify a lowest tray for the selected tray and trays other than the selected tray for the temporary trays, and feed the sheets temporarily to the respective temporary trays in sequence from the highest tray downward. In this case, by rotating the discharge rollers corresponding to the respective temporary trays in the direction of feeding the sheets and in the opposite direction, it is possible to discharge the sheets in the reversed state from the respective temporary trays to the selected tray in sequence from the highest tray downward. Moreover, when a temporary tray discharges a sheet to a selected tray, the succeeding sheet can be fed to the temporary tray immediately after the discharge. It is therefore possible to shorten the interval between sheets output from the image forming apparatus, and produce the effect of improving the processing speed. Furthermore, it is only necessary to always feed the sheets from the highest tray in a downward direction, the mechanism of the transport rollers disposed in the transport path and control can be simplified.

In addition, for example, when discharging several sets of sheets consisting of several pages in the reversed state to a plurality of trays, it is possible to achieve efficient reverse discharge processing by only using three adjacent trays, namely upper, intermediate and lower trays. More specifically, after specifying the intermediate tray for the selected tray and the upper and lower trays for the temporary trays, the sheets are discharged to the upper tray and the lower tray alternately and then the sheets are discharged in the reversed state to the selected tray from the upper tray and the lower tray alternately. By shifting a set of three trays to a lower level or a higher level whenever a set of sheets are discharged, it is possible to achieve efficient reverse discharge processing irrespectively of the number of pages or the number of sets of sheets.

Thus, by suitably specifying the selected tray and temporary tray, efficient reverse discharge processing can be performed according to various sheet output modes of the image forming apparatus and the number of sheets to be output. Moreover, since the conventional sorter structure for distributing sheets can be used as it is, there is no need to provide a special switchback mechanism. Consequently, it is possible to prevent an increase in the size of the sheet discharging apparatus or the image forming apparatus, and in the cost.

For a fuller understanding of the nature and advantages of the invention, reference should be made to the ensuing detailed description taken in conjunction with the accompanying drawings.

DESCRIPTION OF THE PREFERRED EMBODIMENTS

Figure 1:
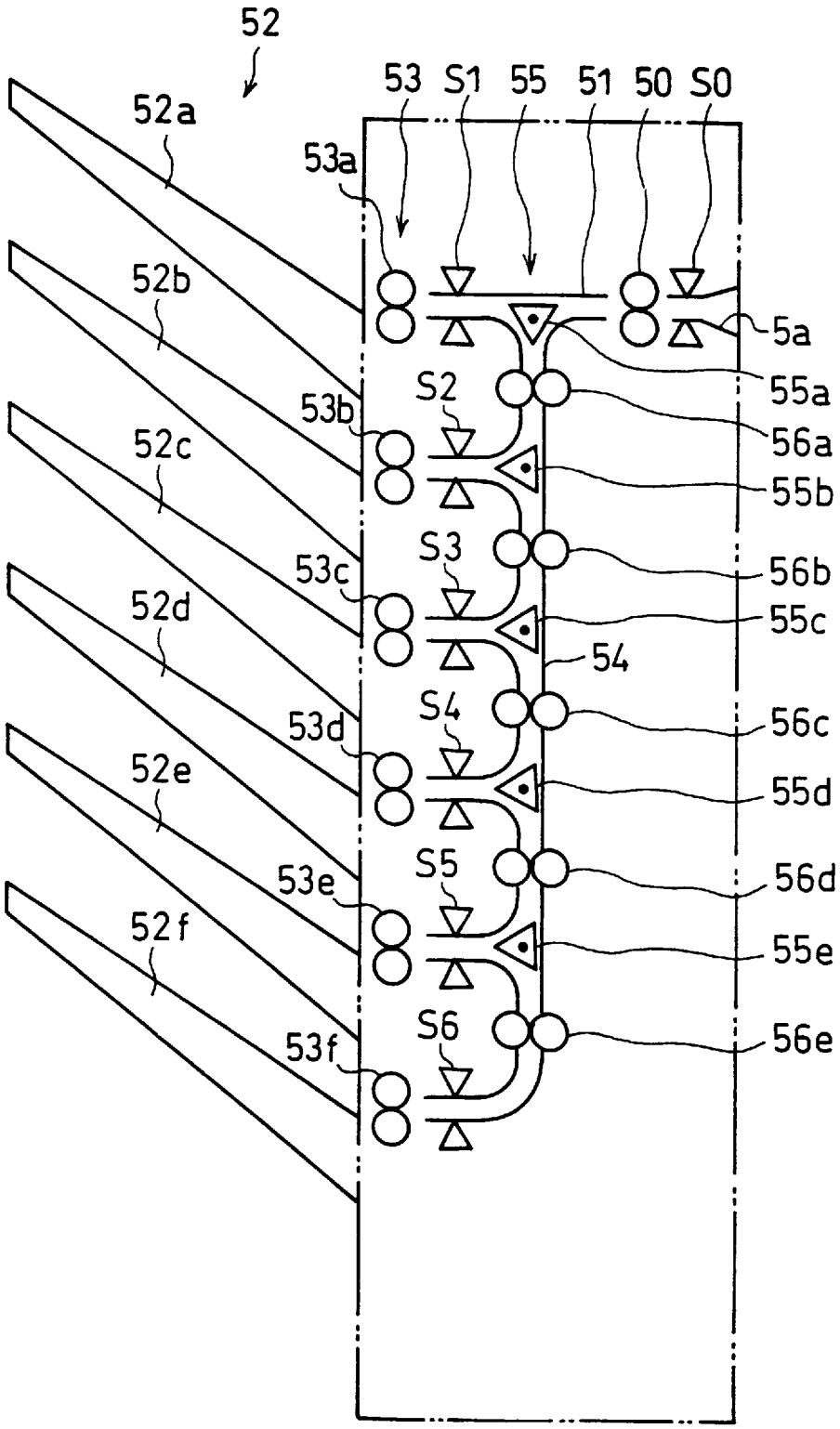
FIG. 1 is an explanatory view showing an internal structure of a sheet discharging apparatus in accordance with one embodiment of the present invention.

Referring to the drawings, the following descriptions will explain embodiments of a sheet discharging apparatus of the present invention which receives recording paper (hereinafter referred to as sheets) whereon images have been formed by an image processing apparatus, and discharges the sheets in the order of pages.

Figure 2:
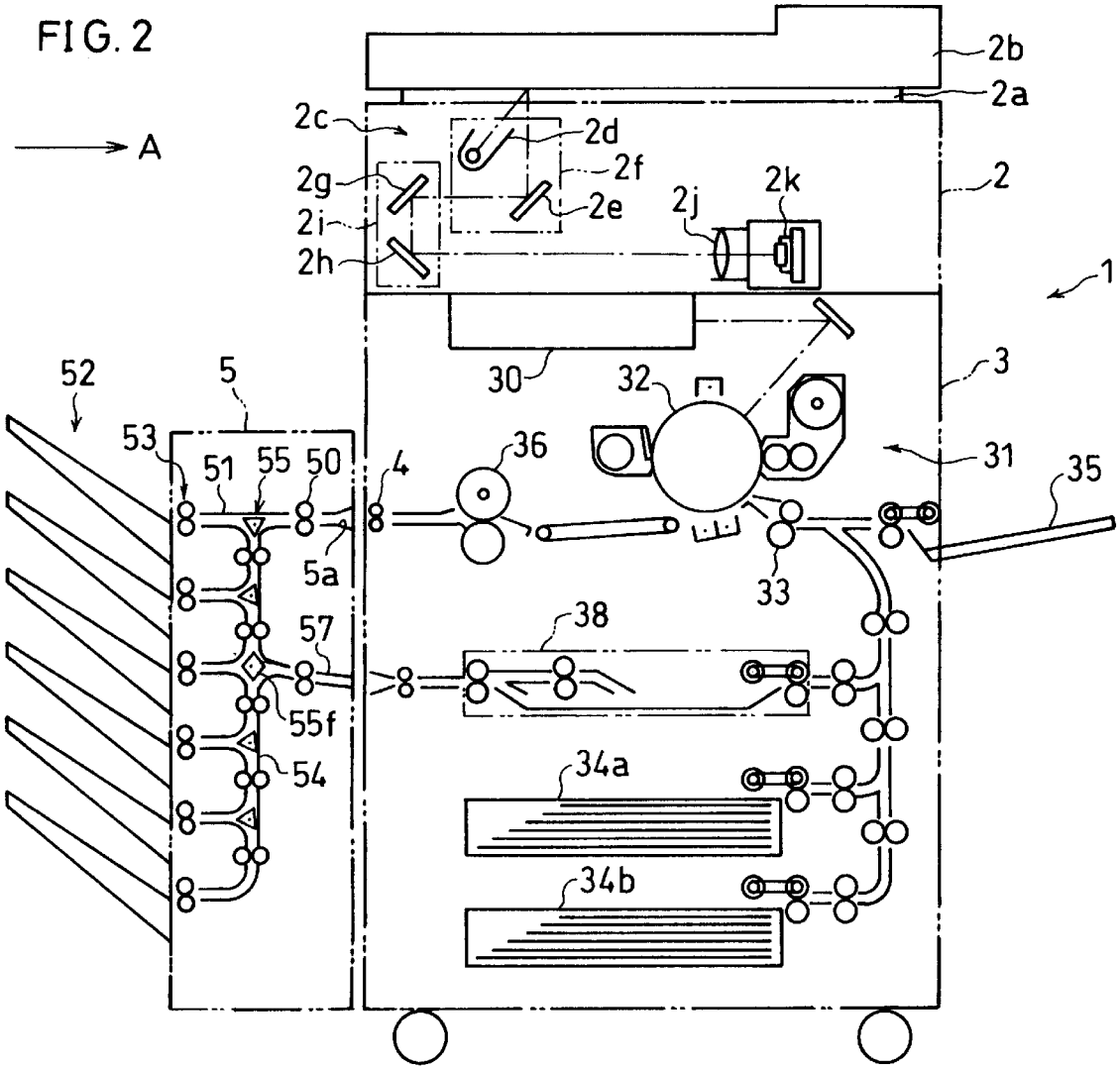
FIG. 2 is an explanatory view showing an overall structure of a digital copying machine provided with the sheet discharging apparatus.

A sheet discharging apparatus in accordance with the present embodiment is provided in a discharge section of a digital image forming apparatus having a copy mode, a printer mode, a fax mode, etc. An example of the sheet discharging apparatus is shown in FIG. 1. The entire structure of the image forming apparatus provided with the sheet discharging apparatus is schematically shown in FIG. 2.

First, the structure of the image forming apparatus will be explained with reference to FIG. 2. In the present embodiment, a digital copying machine is adopted as the image forming apparatus. The copying machine main body 1 of the digital copying machine is mainly composed of a scanner section 2 as an image reading section, and a laser printing section (hereinafter referred to as a printer section) 3 as an image forming section.

The scanner section 2 includes a document platen 2*a* made of transparent glass, a recirculating automatic document feeder (RADF) 2*b* for automatically feeding a document onto the document platen 2*a*, and a document image reading unit, i.e., a scanner unit 2*c*, for reading the image on the document placed on the document platen 2*a* by scanning. The document image read by the scanner section 2 is sent to an image data input section, to be described later, as read image data, and undergoes a predetermined image process.

The RADF 2*b* is a device in which a plurality of documents are set on a predetermined document tray (not shown) at a time, and the documents are automatically fed sheet by sheet to the document platen 2*a* of the scanner unit 2*c*. The RADF 2*b* includes a transport path for single-sided documents, a transport path for double-sided documents, a transport-path switching mechanism, a sensor group for recognizing and controlling a state of the document being passed through each section, a control section, etc., so that one side or both sides of documents is/are read by the scanner unit 2*c* according to a selection made by an operator. As to the RADF 2*b*, many applications have been filed, and there are a variety of RADFs available on the market, and thus further explanations thereof is omitted here.

The scanner unit 2*c* for reading an image on the document placed on the document platen 2*a* includes a lamp reflector assembly 2*d* for the exposure of the surface of the document, a first scanning unit 2*f*, a second scanning unit 2*i*, an optical lens 2*j*, and a CCD element 2*k*, to be described later. The first scanning unit 2*f* has a first reflecting mirror 2*e* placed thereon for reflecting light reflected from the document, for guiding the reflected image from the document to a photoelectric transfer element (CCD). The second scanning unit 2*i* has a second reflecting mirror 2*g* and a third reflecting mirror 2*h* for guiding the reflected image from the first scanning unit 2*f* to the photoelectric transfer element (CCD). The optical lens 2*j* forms a reflected light image from the document on the photoelectric transfer element (CCD). The CCD element 2*k* converts the reflected light image from the document into an electric image signal.

The scanner section 2 successively places documents on the document platen 2*a* by operations associated with the RADF 2*b* and the scanner unit 2*c*, and moves the scanner unit 2*c* along the bottom surface of the document platen 2*a* so as to read the image on the document placed on the document platen 2*a*. In particular, the first scanning unit 2*f* scans at a constant velocity V in a direction of an arrow A shown in FIG. 2 along the document platen 2*a*, and the second scanning unit 2*i* is controlled so as to scan in the same and parallel direction at a velocity of V/2. Thus, the document image is read by sequentially forming an image on the document placed on the document platen 2*a* of the CCD element 2*k* line by line.

The read image data resulting from reading an image on the document by the scanner unit 2*c* is sent to an image processing section, to be described later, and temporarily stored in a memory of the image processing section after various processing. Then, the image data in the memory is read out according to an output instruction, and transferred to the printer section 3 to form an image on a copying sheet. The printer section 3 includes a copying-sheet transport system for transporting a copying sheet, i.e., a recording material, for forming thereon an image, a laser writing unit 30, and an electrophotographic processing unit 31 for forming thereon an image.

The laser writing unit 30 includes a semiconductor laser source for emitting laser light according to the image data read by the scanner unit 2*c* or the image data transferred from an external device, a polygon mirror for deflecting the laser light at a constant angular velocity, and an f·θ lens for correcting the laser light deflected by the polygon mirror to be deflected at a constant velocity on a photoreceptor drum 32 of the electrophotographic processing section 31.

The electrophotographic processing section 31 includes the photoreceptor drum 32. The electrophotographic processing section 31 further includes a charger, a developing unit, a transfer unit, a separating unit, a cleaning unit, and a charge removing unit which are placed in this order along the outer surface of the photoreceptor drum 32 in a known manner. By controlling these members, an image is formed on a copying sheet.

On the other hand, the copying-sheet transport system includes a transport section 33 for transporting a copying sheet to the electrophotographic processing section 31 for forming an image, particularly to the portion where the transfer unit is placed, feeding cassettes 34*a* and 34*b* for feeding the sheet to the transport section 33, a manual feeder 35 for feeing a sheet of a desired size as the occasion arises, a fusing device 36 for causing a transferred image, particularly a toner image, to be affixed onto the copying sheet, and a retransport path 38 for feeding again the sheet having an image formed on the same surface or on the back surface of the sheet which has undergone the fixing process. Provided on the downstream side of the fusing device 36 is a sheet discharging apparatus 5 for receiving a sheet having an image printed thereon and for applying a predetermined process to the sheet.

In the laser writing unit 30 and the electrophotographic processing section 31, the image data read from the image memory is formed into an electrostatic latent image on the surface of the photoreceptor drum 32 by scanning the photoreceptor drum 32 of the electrophotographic processing section 31 with a laser beam emitted from the semiconductor laser light source of the laser writing unit 30. The electrostatic latent image is visualized by making the toner adhered thereto by the developing unit. The resulting visualized toner image on the surface of the photoreceptor drum 32 is electrostatically transferred onto one surface of the copying sheet being fed from either one of the feeding cassette 34*a* and 34*b* of the described multi-level feed units or the manual feeder 35 by electrostatic charges. Finally, the transferred image is made permanent onto the copying sheet by the fusing device 36.

The sheet having an image formed thereon is fed into the sheet discharging apparatus 5 from the fusing device 36 through discharge rollers 4.

Circuit of the Image Processing Section

Next, in the described digital copying machine, the structure and the functions of the image processing section for processing read document image data will be explained.

Figure 3:
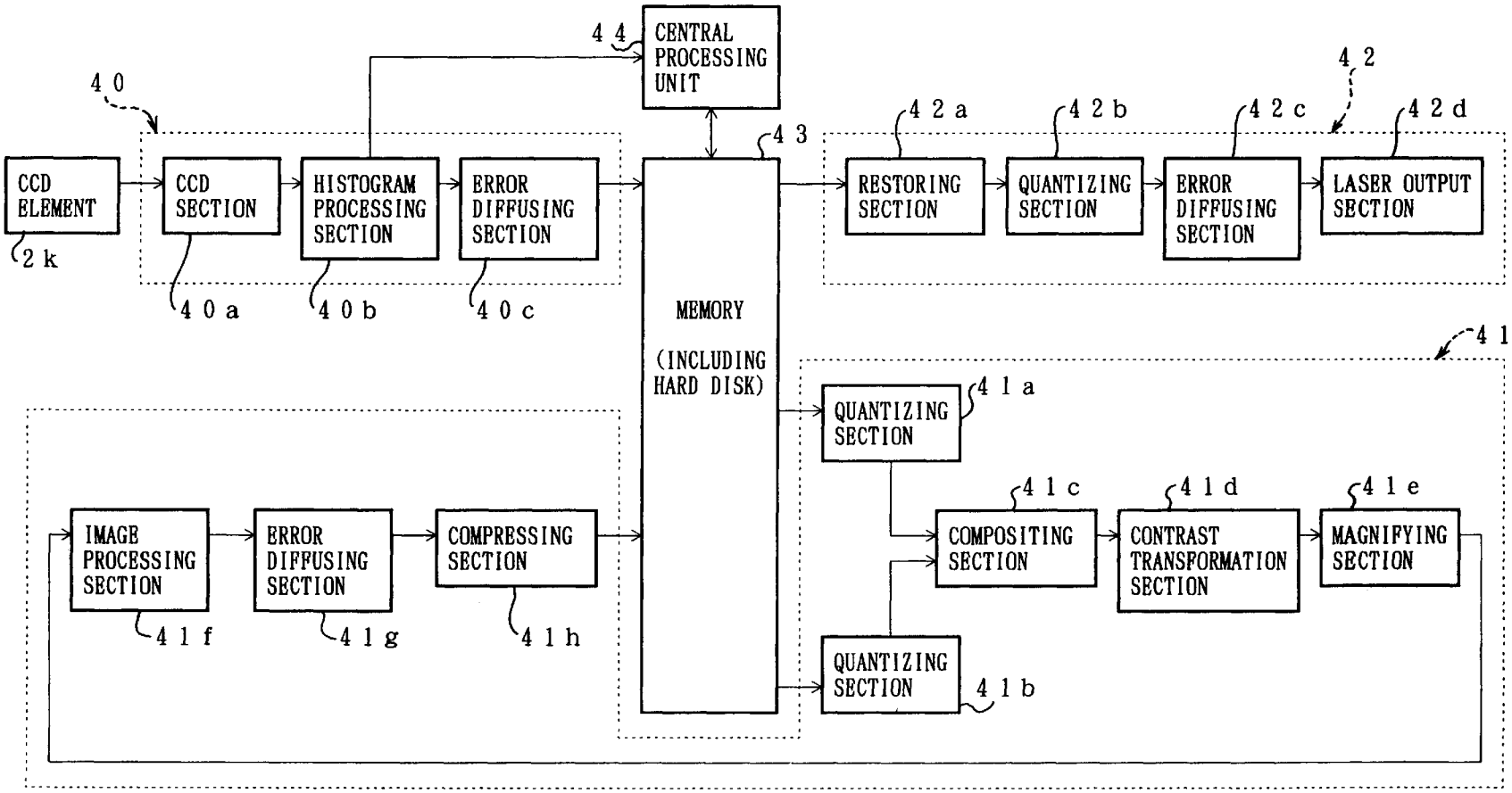
FIG. 3 is a block diagram showing a circuit structure in a digital image processing section of the digital copying machine.

FIG. 3 is a block diagram of the image processing section in the digital copying machine of FIG. 2. The image processing section includes an image data input section 40, an image processing unit 41, an image data output section 42, a memory 43 composed of a RAM (random access memory) and a hard disk, etc., and a central processing unit (CPU) 44.

The image data input section 40 includes a CCD section 40*a*, a histogram processing section 40*b*, and an error diffusing section 4*c*. The image data input section 40 converts the document image data, which has been photoelectrically converted by the CCD element 2*k*, into binary data, and processes the image data by an error diffusing method while making a histogram as binary digital quantity. The processed image data by the image data input section 40 is then temporarily stored in the memory 43.

Namely, in the CCD section 40*a*, analog signals representing the densities of pixel signals of the image data are converted into digital signals by the A/D conversion. Thereafter, digital signals are corrected by the MTF (modulation transfer function) correction, the black-and-white level correction, or the gamma correction. Then, (8-bit) digital signals representing 256 tones are transmitted as digital signals to the histogram processing section 40*b*.

In the histogram processing section 40*b*, the digital signal output from the CCD section 40*a*; is added according to the pixel densities of 256 tones so as to obtain density information (histogram data) . The density information thus obtained is sent as pixel data to the error diffusing section 40*c*, and to the CPU 44 if necessary.

In the error diffusing section 4*c*, the 8-bit/pixel digital signal output from the CCD section 40*a* is converted into 1-bit (binary) digital signal, and a re-allocation is performed for faithfully reproducing the densities of local portions of the document according to the error diffusing met hod. The error diffusing method is a type of pseudo-half-tone processing, and an error caused by the conversion to one bit is reflected when converting adjacent pixel into one bit.

The image processing unit 41 includes quantizing sections 41*a* and 41*b*, a compositing section 41*c*, a contrast transformation section 41*d*, a magnifying section 41*e*, an image processing section 41*f*, an error diffusing section 41*g* and a compressing section 41*h*. The image processing unit 41 converts the input image data into image data of a form as desired by the operator. The image processing unit 41 processes the image data until all the image data have been converted into a final form as desired by the operator and stored in the memory 43. The described sections in the image processing unit 41 do not always perform their functions but perform their functions as the need arises.

The functions of the above-mentioned sections in the image processing unit 41 will be explained in detail.

The image data converted into a one-bit form by the error diffusing section 4*c* is reconverted into 256 tones by the quantizing sections 41*a* and 41*b*. In the compositing section 41*c*, a logical operation, i.e., logical OR, AND, or exclusive-OR operation is selectively carried out for each pixel. The data subjected to this operation is the pixel data stored in the memory 43, and bit data from a pattern generator (PG: not shown).

In the contrast transformation section 41*d*, the relationship between the output density and input density is freely determined based on a predetermined gradation transformation table with respect to the data representing 256 tones.

In the magnifying section 41*e*, interpolation is performed based on the known data input according to a selected magnification ratio so as to obtain pixel data (a density level) of target pixels after being magnified. Here, a magnification process is performed in a main scanning direction after executing a magnification process in a sub-scanning direction. As a result, an image is output in a magnification ratio selected by the operator.

In the image processing section 41*f*, the input pixel data undergoes various image processing, and information is collected, for example, to extract features from data string.

The error diffusing section 41*g* performs a function similar to than of the error diffusing section 40*c* of the image data input section 40.

In the compressing section 41*h*, the one-bit data is compressed by run length encoding. If the image data has a final form of output image data, the compression of data is performed in the final processing doom.

The image data output section 42 includes a restoring section 42*a*, a quantizing section 42*b*, an error diffusing section 42*c*, and a laser output section 42*d*. The image data output section 42 restores the compressed image data stored in the memory 43, reconverts the data into data representing 256 tones, converts the resulting data into two-bit data which give a smoother halftone image than one-bit data, and transmits the data to the laser output section 42*d*. The resulting image data is finally sent to the laser writing unit 30 of the laser printer section 3, thereby forming an image.

Namely, the image data compressed by the compressing section 41*h* is restored in the restoring section 42*a*.

The quantizing section 42*b* performs processing in the same manner as in the quantizing sections 41*a* and 41*b* of the image processing unit 41. The error diffusing section 42*c* performs processing in the same manner as in the error diffusing section 40*c* of the image data input section 40.

The laser output section 42*d* converts the digital image data into a laser ON/OFF signal according to a control signal from a sequence controller, not shown. The emission of the laser beam from the semiconductor laser in the laser writing unit 30 is controlled based on the ON/OFF signal, and an electrostatic latent image is formed on the photoreceptor drum 32.

The data processed in the image data input section 40 and the image data output section 42 are basically stored in the form of one-bit data in the memory 43 in order to save the memory capacity thereof. However, considering the degradation of the image data, the data may be stored in the form of two-bit data.

Digital Copying Machine Controlling Mechanism

Figure 4:
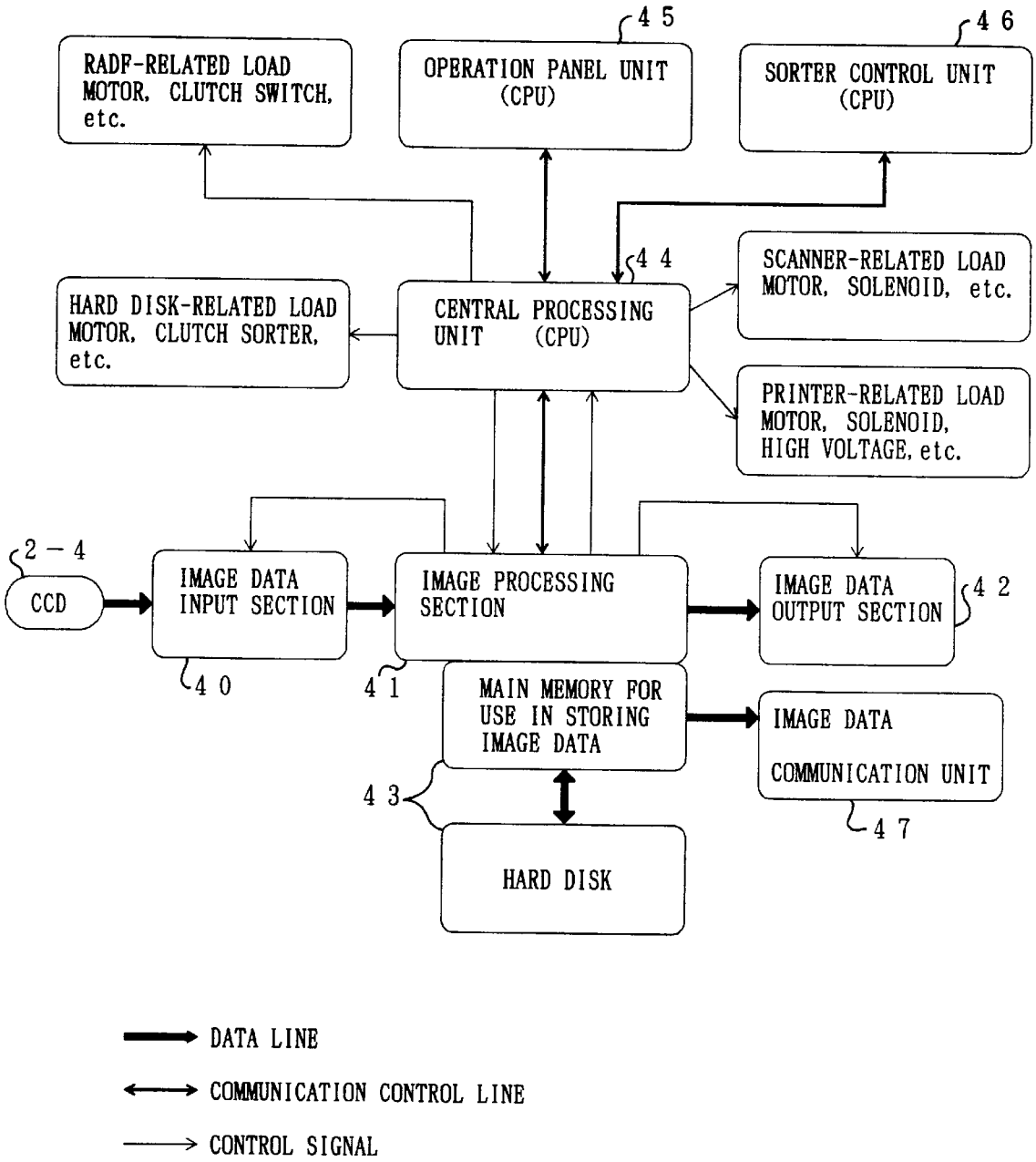
FIG. 4 is a block diagram showing an overall structure of a control section for controlling the image processing, image formation and discharge of sheets, and the digital image processing section.

FIG. 4 shows the state where respective members of the digital copying machine are controlled by the CPU 44.

The respective functions of the CCD element 2*k*, the image data input section 40, the image processing unit 41, the image data output section 42, and the image memory 43 are the same as those of the sections shown in FIG. 3, and thus the descriptions thereof are omitted here.

The CPU 44 explained in FIG. 3 controls the respective sections of the driving mechanism such as the RADF 2*b*, the scanner section 2 and the printer section 3 of the copying machine main body 1 by the sequence control, and outputs control signals for controlling the respective sections.

Further, an operation panel unit 45 composed of an operation panel is connected to the CPU 44 so as to allow communications between them. The operation panel unit 45 transfers a control signal to the CPU 44 according to a mode selected by the operator, thereby operating the digital copying machine main body 1 according to the set mode.

Moreover, the control signal indicative of the operating state of the copying machine main body 1 is transferred to the operation panel unit 45 from the CPU 44. In the operation panel unit 45, an operating state is sequentially displayed on a display section based on the control signal so as to show the current operating state to the operator.

A sorter control unit 46 is provided for controlling the operations of a sheet post-processing apparatus for classifying the copied material to be discharged from the copying machine main body 1. Here, the sorter control unit 46 mainly controls the sheet discharging apparatus 5 (see FIG. 2) of the present invention.

An image data communication unit 47 is provided so as to enable communication of the image data and the image control signal, etc., with other digital image forming apparatus.

Figure 5:
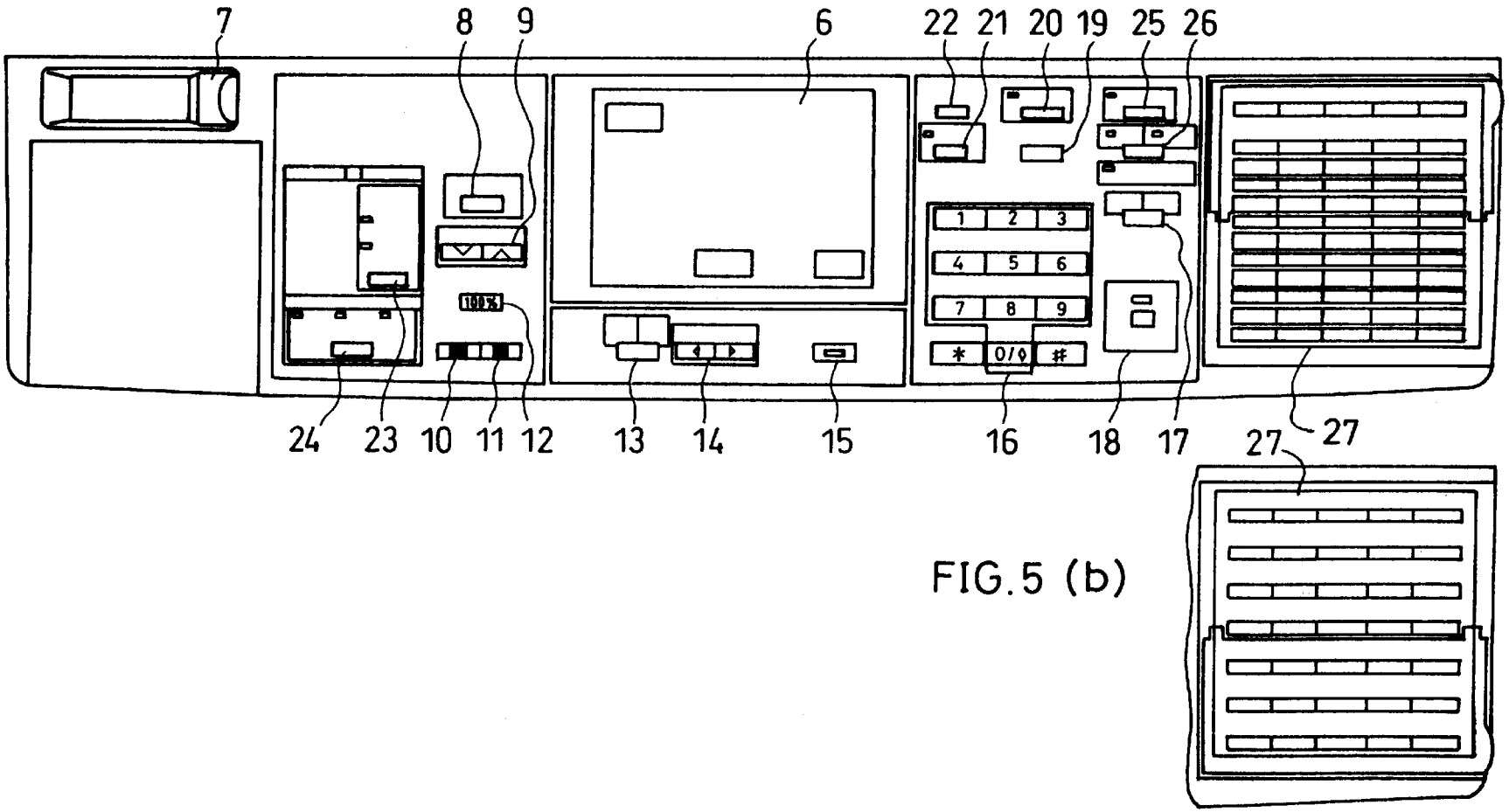
FIGS. 5(*a*) and 5(*b*) are plan views showing one example of an operation panel unit of the digital copying machine.
Figure 6C:
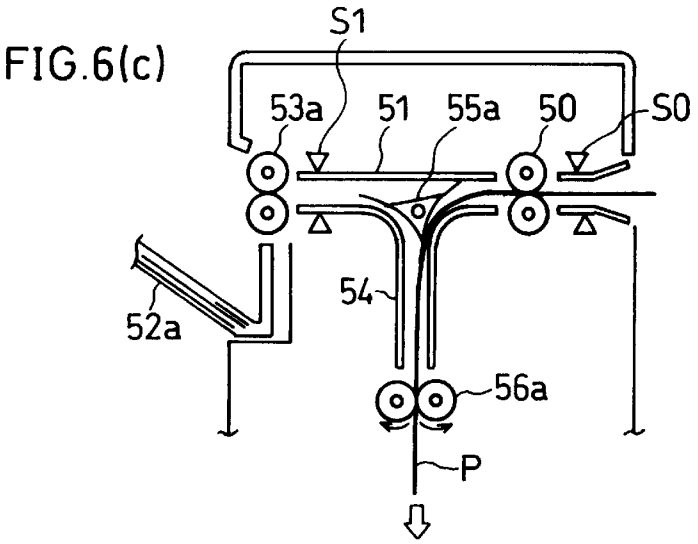
FIGS. 6(*a*) to 6(*d*) are cross-sectional views showing states of switching the sheet transport direction by a gate disposed in a first transport path for controlling the feeding of sheets in the sheet discharging apparatus.
Figure 6D:
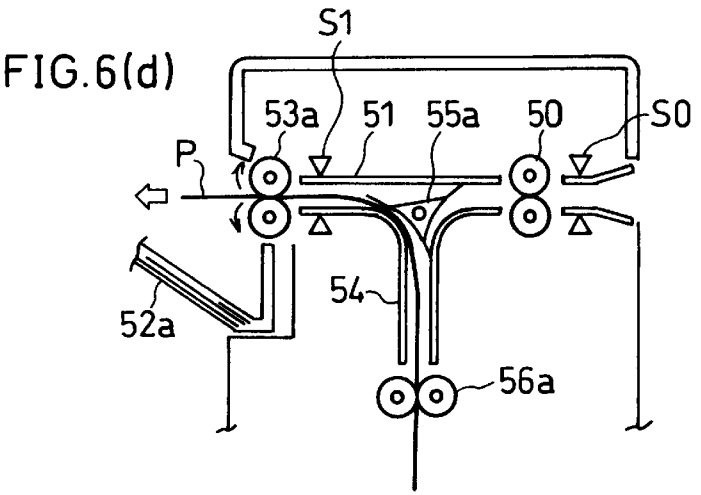
Figure 6A:
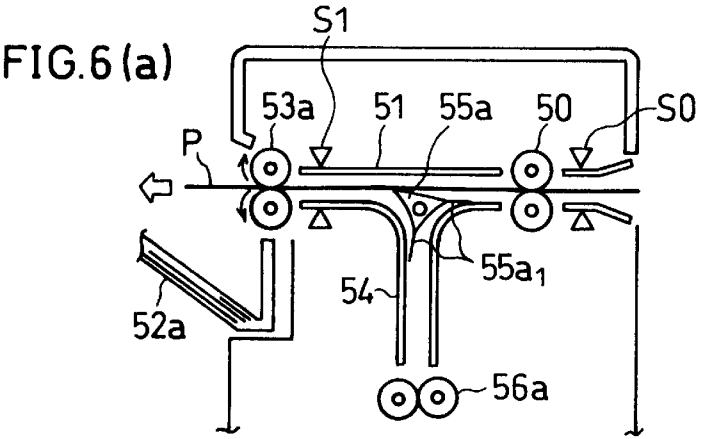
Figure 6B:
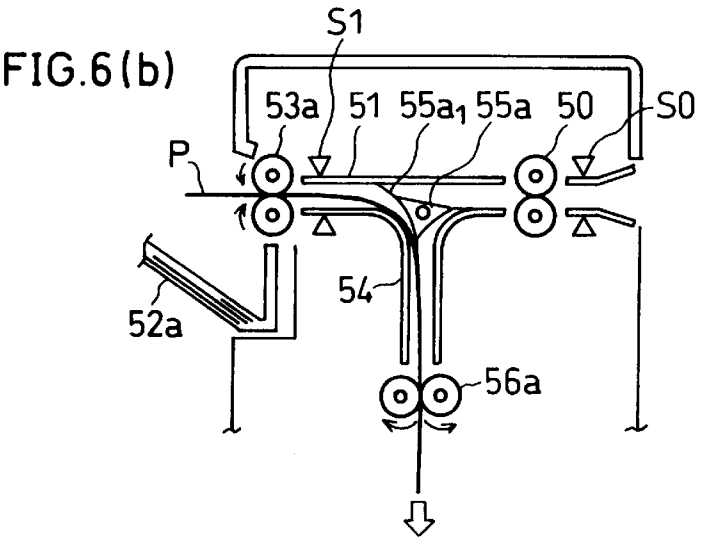
Figure 7A:
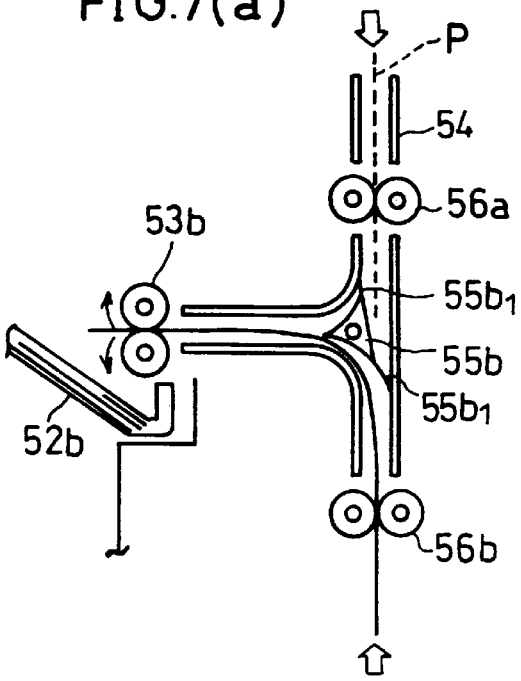
FIGS. 7(*a*) to 7(*d*) are cross-sectional views showing states of switching the sheet transport direction by a gate disposed in a second transport path for controlling the feeding of sheets in the sheet discharging apparatus.
Figure 7B:
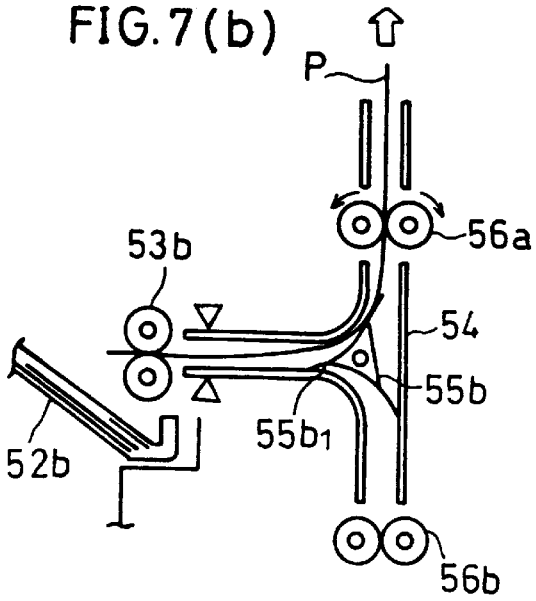
Figure 7C:
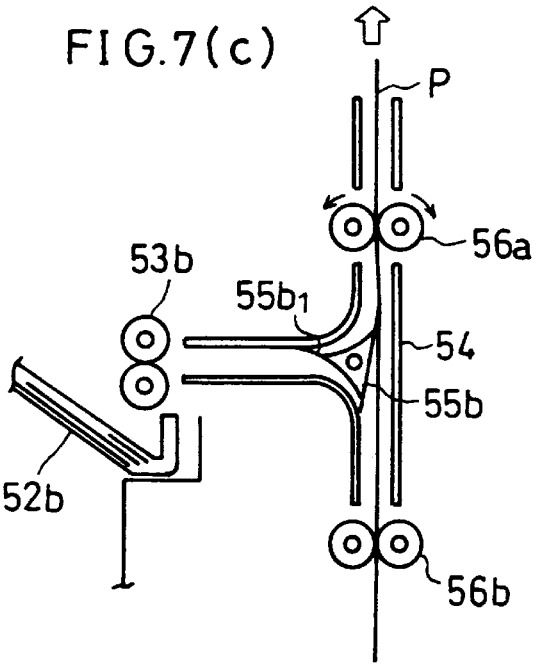
Figure 7D:
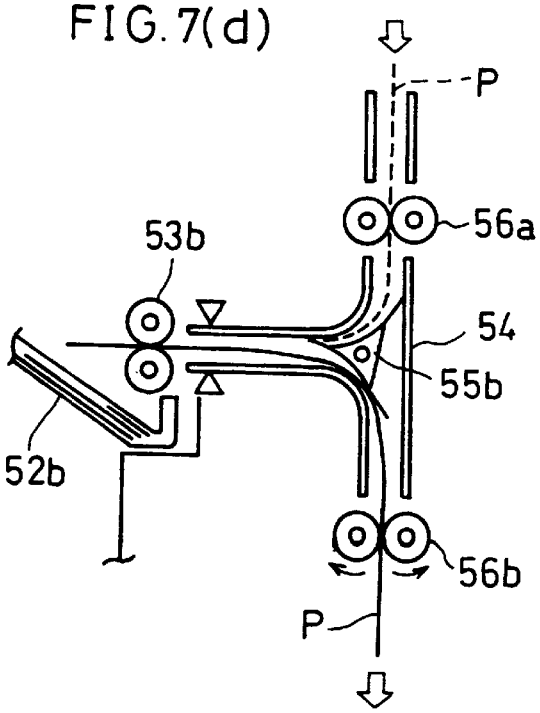

FIG. 5 shows the operation panel formed on the operation panel unit 45 in the copying machine main body 1. At the central portion of the operation panel, a touch panel liquid crystal display device 6 is disposed, and a group of various mode setting keys are arranged to surround the touch panel liquid crystal display device 6

On the screen of the touch panel liquid crystal display device 6, a screen switch instruction area for switching a screen for selecting the image editing function is always displayed. Upon directly depressing the area with a finger, a list of image editing functions is displayed on the liquid crystal screen so as to allow the operator to select image editing functions.

Then, an editing function is selected among various editing functions by touching the area in which the function desired by the operator is displayed.

The group of various setting keys arranged on the operation panel will be briefly explained. A dial 7 for adjusting the brightness of the screen of the liquid crystal display device 6 is provided.

An automatic magnification ratio selecting key 8 is provided for selecting a mode in which a magnification ratio is automatically selected. A zoom key 9 is provided for enabling the magnification ratio of copying to be set in percentage. Fixed magnification ratio keys 10 and 11 are provided for selecting a fixed magnification ratio. A 100% magnification ratio key 12 is provided for permitting the magnification to be set back to a normal magnification ratio (100%).

A density adjustment key 13 is provided for switching the adjustment of copy density from an automatic mode to a manual mode or a photograph mode. A density adjustment key 14 is provided for permitting a fine adjustment of a density level in the manual mode or the photographic mode. A cassette (tray) selection key 15 is provided for selecting a desired sheet size among the sheet sizes set in the feed section of the copying machine.

A number selecting key 16 is provided for selecting the number of copies to be produced. A clear key 17 is depressed for clearing a selected number of copies, or interrupting successive copying operations before being completed. A start key 18 (print switch) is depressed for instructing the start of copying. A reset key 19 is provided for cancelling all the modes currently set and restoring the normal mode. When successive copying operations are being performed, if a copy of another document needs to be produced, an interruption key 20 is to be depressed. When the operator does not know how to operate the copying machine, an operation guide key 21 is depressed. When the operation guide key 21 is depressed, a message explaining how to operate the copying machine is displayed. A message forward key 22 is depressed in order to forward the message displayed by the depression of the operation guide key 21.

A double-sided mode selecting key 23 is depressed to select the double-sided copy mode. A post-processing-mode selecting key 24 is depressed to select an operation mode of the post-processing apparatus 5 for sorting copied matter (a sheet having an image formed thereon) output from the copying machine. In the present invention, the post-processing-mode selecting key 24 is a selection key for allowing the operator to freely select a tray to which a sheet that has been turned over is finally output. The detail of the function of the post-processing-mode selecting key 24 will be explained later.

Keys 25 through 27 are printer mode and fax mode related keys. More specifically, a memory transmission mode key 25 is provided for transmitting a document that is once stored in memory. A copy/fax.printer mode switching key 26 is provided for switching a mode of the copying machine main body 11 between the copy mode and the fax and printer mode. A one-touch dial key 27 is provided for starting the transmission of a telephone call to an addressee whose telephone number has been stored by a one-touch operation.

The above-mentioned control panel, and various keys thereon are merely examples. Therefore, needless to say, the keys on the control panel may vary depending on various functions provided for the digital copying machine.

One Embodiment of Sheet Discharging Apparatus

Referring now to FIG. 1, the following description will explain in detail the sheet discharging apparatus 5 of the digital image forming apparatus of the present invention. Here, the sheet discharging apparatus 5 is provided so as to be detachable from the digital copying machine main body 1.

The sheet discharging apparatus 5 includes a sorter having a known sorting function for arranging sheets having images formed thereon in page order, and turns over the sheet using a transport path in the sorter and then discharges the sheet to a desired tray.

As illustrated in FIG. 2, the sheet discharging apparatus 5 receives a sheet as printed material having an image formed thereon in the digital copying machine main body 1. Then, the sheet discharging apparatus 5 transports the sheet through the transport path therein toward a predetermined direction according to a mode selected from various image formation modes. As a result, the sheets having images formed thereon are stacked in proper page order on a tray, thereby completing printed materials arranged in an appropriate state.

As illustrated in FIGS. 1 and 2, the sheet discharging apparatus 5 includes a sheet entrance opening 5*a* formed at a position corresponding to a position of the digital copying machine main body 1 through which the sheet is discharged by the sheet discharge rollers 4 therein, and transport rollers 50 placed to face the sheet entrance opening 5*a*. The transport rollers 50 are disposed at the leading end of a first transport path 51. The first transport path 51 is formed in a straight line on a line extended from the transport path in the copying machine main body 1 on which the fusing device 36 and the sheet discharge rollers 4 are provided.

In the sheet discharging apparatus 5, a tray (bin) set 52 is provided on a side opposite to the side where the sheet entrance opening 5*a* is formed so that the tray set 52 appears at the outside of the sheet discharging apparatus 5. Moreover, a discharge roller set 53 is disposed on a side of the first transport path 51 opposite to the transport rollers 50 so as to correspond to the tray set 52. A first tray 52*a* on the highest level and a highest discharge rollers 53*a* correspond to the first transport path 51.

Disposed on the first transport path 51 is a first gate 55*a* belonging to the gate set 55 for switching the transport direction to a second transport path 54 which is formed in a direction perpendicular to the first transport path 51. More specifically, the first gate 55*a* is positioned at the branch point of the first transport path 51 and the second transport path 54 on the highest level in the gate set 55. The sheet is guided to the first transport path 51 or the second transport path 54 by switching the transport direction of the sheet with the first gate 55*a*. Trays 52*b*, 52*c*, 52*d*, 52*e* and 52*f* are disposed on the second transport path 54 so as to receive the sheets discharged below the first tray 52*a*. In this embodiment, the number of bins in the sorter is made six for the purpose of simplifying the explanation.

Here, an ordinal number is added to each of the trays 52*b* to 52*f* as the need arises, and for example, the trays are called the second tray 52*b* and the third tray 52*c*.

Moreover, discharge rollers 53*b*, 53*c*, 53*d*, 53*e* and 53*f* are provided to correspond to the trays 52*b*, 52*c*, 532, 52*e* and 52*f*, respectively. Furthermore, gates 55*b*, 55*c*, 55*d* and 55*e* for switching the transport direction of the sheets are provided to correspond to the trays 52*b* to 52*f*, respectively, so that the sheets are fed forward along the second transport path 54 or guided to the trays 52*b* to 52*f*.

The gates 55*b* to 55*f* are called, for example, the second gate 55*b*, the third gate 55*c*, etc. by adding an ordinary number as the need arises.

In the second transport path 54, transport rollers 56*a* to 56*e* as transport rollers for transporting the sheets are provided between adjacent gates of the gates 55*a* and 55*e*, respectively, thereby enabling the transport of the sheets to the trays 52*b* to 52*f*.

The discharge rollers 53*a* to 53*f* of the present invention are rotatable in forward and reverse directions so as to enable the transport of the sheets in the reverse direction. The transport rollers 56*a* to 56*e* may be arranged to be rotatable in the reverse direction, if necessary.

Next, the following description will explain the gates 55*a* to 55*e* for switching the transport direction of the sheets. The first gate 55*a* is controlled to be switched to a non-switching position for guiding a sheet transported through the first transport path 51 straight to the first tray 52*a*, or to a switching position for guiding the sheet to the second transport path 54. Such positions are explained with reference to FIGS. 6(*a*) to 6(*d*).

When the first gate 55*a* has the position shown in FIG. 6(*a*), i.e., the non-switching position, the first gate 55*a* feeds a sheet P which has been transported through the transport rollers 50 straight to the discharge rollers 53*a* through the first transport path 51. On the other hand, as shown in FIG. 6(*b*), when the discharge rollers 53*a* are rotated in the reverse direction, the first gate 55 guides the sheet P from the discharge rollers 53*a* to the second transport path 54.

Therefore, the first gate 55*a* is formed to have a substantially triangular cross section so that the transport path of the sheet P is switched by the rotating direction of the discharge rollers 53*a* while the first gate 55*a* remains in the non-switching position. Moreover, a bendable thin film $\mathbf{55}a_1$ such as a polyester film is placed to each apex of the triangular first gate 55*a* so as to be in contact with the guide surfaces of the first transport path 51 and second transport path 54. This structure enables the transport of the sheet P to one of the transport paths 51 and 54, but disables the transport of the sheet P to the other.

In short, as described above, when the first gate 55*a* is switched to the non-switching position, the sheet P transported through the transport rollers 50 is guided to the first tray 52*a* through the first transport path 51 by the function of the film $\mathbf{55}a_1$, but is prohibited from being transported to the reverse direction. When transporting the sheet P in the reverse direction, the discharge rollers 53*a* are rotated in the reverse direction, and thus the first gate 55*a* guides the sheet P to the second transport path 54.

On the other hand, as shown in FIG. 6(*c*), when the first gate 55*a* is switched to the switching position, the sheet P transported in the first transport path 51 through the transport rollers 50 is guided to the second transport path 54, while the sheet P transported to the first gate 55*a* along the second transport path 54 by the reverse rotation of the transport rollers 56*a* is guided through the first transport path 51 to the first tray 52*a*.

All of the other gates 55*b* to 55*e* have the same shape, and guide the sheet P in the same manner. Therefore, the explanation of the gates 55*b* to 55*e* is simplified by only explaining the second gate 55*b* as one example with reference to FIGS. 7(*a*) to 7(*d*). Like the first gate 55*a*, the second gate 55*b* is formed to have a substantially triangular cross section, and a bendable thin film 55*b*, such as a polyester film is placed to each apex. When the films 55*b*, placed in the respective apexes come into contact with a guide surface which forms the second transport path 54, the transport of the sheet P in a predetermined direction is enabled, but the transport of the sheet P in the reverse direction is disabled.

Thus, as illustrated in FIG. 7(*a*), when the second gate 55*b* is switched to the non-switching position, if the sheet P is transported downward in the second transport path 54 as shown by the broken line, the sheet P is transported straight through the second transport path 54. On the other hand, when the sheet P is transported in the reverse direction through the second transport path 54 by the reverse rotation of the transport rollers 56*b*, i.e., in the upward direction, the sheet P is not fed straight through the second transport path 54, and the transport direction is changed to a direction toward the tray 52*b* on a higher level (hereinafter referred to as the second tray 52*b*). Moreover, as shown in FIG. 7(*b*), when the second gate 55*b* has the non-switching position, if the sheet P is transported by the reverse rotation of the discharge rollers 53*b*, the sheet P cannot be guided to a downward direction through the second transport path 54, but is guided to an upward direction.

On the other hand, as illustrated in FIG. 7(*c*), when the second gate 55*b* is switched to the switching position, if the sheet P is transported upward by the transport rollers 56*b*, the sheet P is guided straight along the second transport path 54. However, when the sheet P is transported in the reverse direction through the second transport path 54, i.e., in the downward direction, the transport direction of the sheet P is changed by the second gate 55*b*, thereby guiding the sheet P to the second tray 52*b* as shown by the broken line of FIG. 7(*d*). When the discharge rollers 53*b* are rotated in the reverse direction to transport the sheet P in the second tray 52*b* in the reverse direction, the second gate 55*b* prohibits the sheet P from being guided to the upward direction along the second transport path 54, and guides the sheet P to the downward direction along the second transport path 54.

In order to detect the leading end and the trailing end of the sheet P being transported, a sensor set is suitably disposed. A sensor S0 is disposed in front of the transport rollers 50 so as to detect the sheet P fed to the transport rollers 50. Sensors S1 to S6 are disposed in front of the discharge rollers 53*a* to 53*f*, respectively, so as to detect the sheets P fed to the discharge rollers 53*a* to 53*f*. Additionally, in the present invention, sheet detection sensors (not shown) for detecting the presence of the sheet P are provided in the trays 52*a* to 52*f*.

The switching of the rotating direction of the discharge rollers 53*a* to 53*f* and transport rollers 56*a* to 56*e* and the switching of the position of the gates 55*a* to 55*e* for switching the transport direction are controlled by sheet transport controlling means according to the detection of the sheet P by the sensors S1 to S6. The sheet transport controlling means is formed by a sorter control unit 46 which is explained as controlling means in FIG. 4.

Meanwhile, in the sheet discharging apparatus 5 shown in FIG. 2, a third transport path 57 is provided in parallel with the first transport path 51. The third transport path 57 is connected to the retransport path 38 including an intermediate tray for temporarily storing the sheets P, and used when forming images on both sides of the sheet P or forming an image on the same side of the sheet P again by the copying machine main body 1. The third transport path 57 is formed so that the third transport path 57 is connected to the retransport path 38 on a straight line.

In order to guide the sheet P to the third transport path 57, the gate 55*f* is disposed on the second transport path 54, particularly, at a position where the second transport path 54 and the third transport path 57 meet. The gate 55*f* is switched between a state for allowing the sheet P to be fed to the third transport path 57 and a state for preventing the sheet P from being fed to the third transport path 57, thereby controlling the transport of the sheet P in the sheet discharging apparatus 5.

The following description will explain the operation of the sheet discharging apparatus 5. Here, the explanation is made on an assumption that the gate 55*f* has the same shape as the second gate 55*b* as shown in FIG. 1 and cannot guide the sheet P to the third transport path 57.

Copy Mode: First Embodiment of Faceup Discharge

The sheet discharging apparatus 5 receives the sheets P having images formed thereon from the copying machine main body 1, and sequentially discharge the sheets P in the same manner as in a conventional apparatus.

When the copying machine main body 1 starts the output of the sheets P in the copy mode, the sheets P are successively discharged at predetermined intervals from the sheet discharge opening of the copying machine main body 1 through the discharge rollers 4. When the discharged sheet P enters the sheet entrance opening 5*a*, and is taken by the sheet discharging apparatus 5 through the transport rollers 50, it is confirmed whether the operation is being performed in the copy mode or not upon the detection of the leading end of the sheet P by the first sensor S0. For example, the sheet discharging apparatus 5 is informed that the operation is performed in the copy mode or not by the copying machine main body 1 before the first sensor S0 detects the leading end of the sheet P. In the copy mode, the first gate 55*a* is controlled to have the non-switching position. As a result, the sheet P is discharged onto the first tray 52*a* by the forward rotation of the discharge rollers 53*a* without changing its position, i.e., reversing the front side and the back side of the sheet P.

Moreover, in the copy mode, in the case where a plurality copies (hard copies) of a single document (or image data to be transmitted to the digital copying machine) need to be output simultaneously, when the next sheet P is sent to the sheet discharging apparatus 5, the sorter control unit 46 controls the first gate 55*a* to be switched to the switching position and the second gate 55*b* to have the switching position (the state shown in FIG. 7(*d*)) upon the detection of this sheet by the sensor S0. As a result, the next sheet P is discharged onto the second tray 52*b* by the forward rotation of the discharge rollers 53*b*.

Hence, the successively transported sheets P are sorted and discharged onto the respective trays in sequence from the highest tray downward according to the number of copies to be produced. After the discharge of the sheets P corresponding to the number of copies to be produced, when the sheets P having an image of the next document (image data) thereon are sent to the sheet discharging apparatus 5, the discharge of the sheets P is performed from the first tray 52*a* again. Alternatively, the sheets P are sorted and discharged onto the respective trays in reverse order from the lowest tray to which the sheet P corresponding to the previous document was discharged last toward the upward trays. Such a sorting and discharging operation is called a sorting mode.

On the other hand, in the digital copying machine, in addition to the output in the sorting mode, there is a case in which the image (or image data) of a single document is read and a predetermined number of copies thereof is output, i.e., the images of a set of a plurality of documents are successively output in page order. More specifically, when three copies are to be produced from a five-page document, one copy is produced from each page of the five-page document and successively output in page order, and this output operation is performed three times.

In order to perform such an operation, in the sheet discharging apparatus 5, the first gate 55*a* is controlled to be switched to the non-switching position, and five sheets P onto which the five pages of the document are copied, respectively, are guided to the first tray 52*a* without changing their states. Then, in order to discharge the next five pages of sheets P to the second tray 52*b* below the first tray 52*a,* the first gate 55*a* and the second gate 55*b* are respectively switched to the switching position. A set of copies arranged in page order are discharged in such a manner to each of the trays 52*a* to 52*f*. Such a discharging operation is called the grouping mode.

In this copy mode, since the image formation is performed in order of the documents placed on a document tray and the like of the RADF 2*b*, sheets P having images formed thereon are arranged in page order of the documents placed on the document tray. In particular, the images of the document are read by a scanner section in sequence from the last page of the document, and the image formation is performed in order of reading. Therefore, by discharging the sheet P with the surface having the image formed thereon (hereinafter referred to as the image-formed side) facing upward, it is possible to accurately place the sheets P in proper page order.

Control of Discharge in Fax Mode or Printer Mode: First Embodiment

Next, the following description will explain the control of discharging the sheet P when the digital copying machine is set in the fax mode or the printer mode. Unlike the copy mode, in these modes, the output of image is performed from the leading page. It is therefore necessary to discharge the sheet P having an image formed thereon after reversing (turning over) the sheet P. Such a discharging operation will be referred to as the "reverse discharge processing".

In this operation, in the sheet discharging apparatus 5, one tray (hereinafter referred to as the selected tray) onto which the reversed sheet P is finally discharged is selected, and sheets P which are successively output from the copying machine main body 1 are sorted and fed in sequence to trays (hereinafter referred to as the temporary trays) other than the selected tray. At this time, in the temporary trays other than the selected tray, the trailing ends of the sheets P are kept caught between the discharge rollers 53 so that the trailing ends of the sheets P are not completely discharged to the temporary trays.

When the sheets P are discharged onto the temporary trays in such a manner, the reverse transport for transporting the sheet P from the temporary tray to the selected tray is started in the temporary trays in sequence. At this time, the respective sheets P on the temporary trays are sequentially fed toward the selected tray so that the sheets P are arranged in page order from the first page. When the last sheet P is discharged onto the selected tray, a set of sheets which have been turned over and arranged in page order are placed on the selected tray.

In this case, when the number of pages is less than the number of the temporary trays, a sequence of feeding and reverse transport processes are performed using the respective temporary trays. As a result, the sheets are discharged at intervals corresponding to the output speed of the copying machine main body 1. Additionally, it is possible to increase the discharge speed as the need arises.

On the other hand, when the number of the temporary trays is not more than the number of pages, i.e., when the number of output materials is more than the number of the temporary trays, the discharge of sheets P cannot be performed to the end by the sequence of the processes. Therefore, the discharge is performed partially by the sequence of the processes within a possible range, and the partial discharge is repeated. Thus, even when the quantity of sheets to be discharged is large, it is possible to successively discharge the sheets by discharging the sheets using the reverse discharge processing of the present invention.

In this case, when repeating the partial discharge, it is necessary to introduce a delay by temporarily stopping the output operation of the digital copying machine for a time required by the reverse discharge processing, or lowering the output speed of the digital copying machine. Nevertheless, it is clear from the explanation below that the discharge speed of the present invention is much faster than the discharge speed of a conventional structure.

Furthermore, by determining the lowest tray for the selected tray for use in the reverse discharge processing, and by temporarily discharging sheets in sequence from the first page to the respective trays from the highest tray downward, it is possible to perform the reverse-discharge operation at a speed corresponding to the output speed of the copying machine main body 1 without introducing a substantial delay.

The discharging steps will be explained in detail below by presenting some examples.

Figures 8A, 8B:
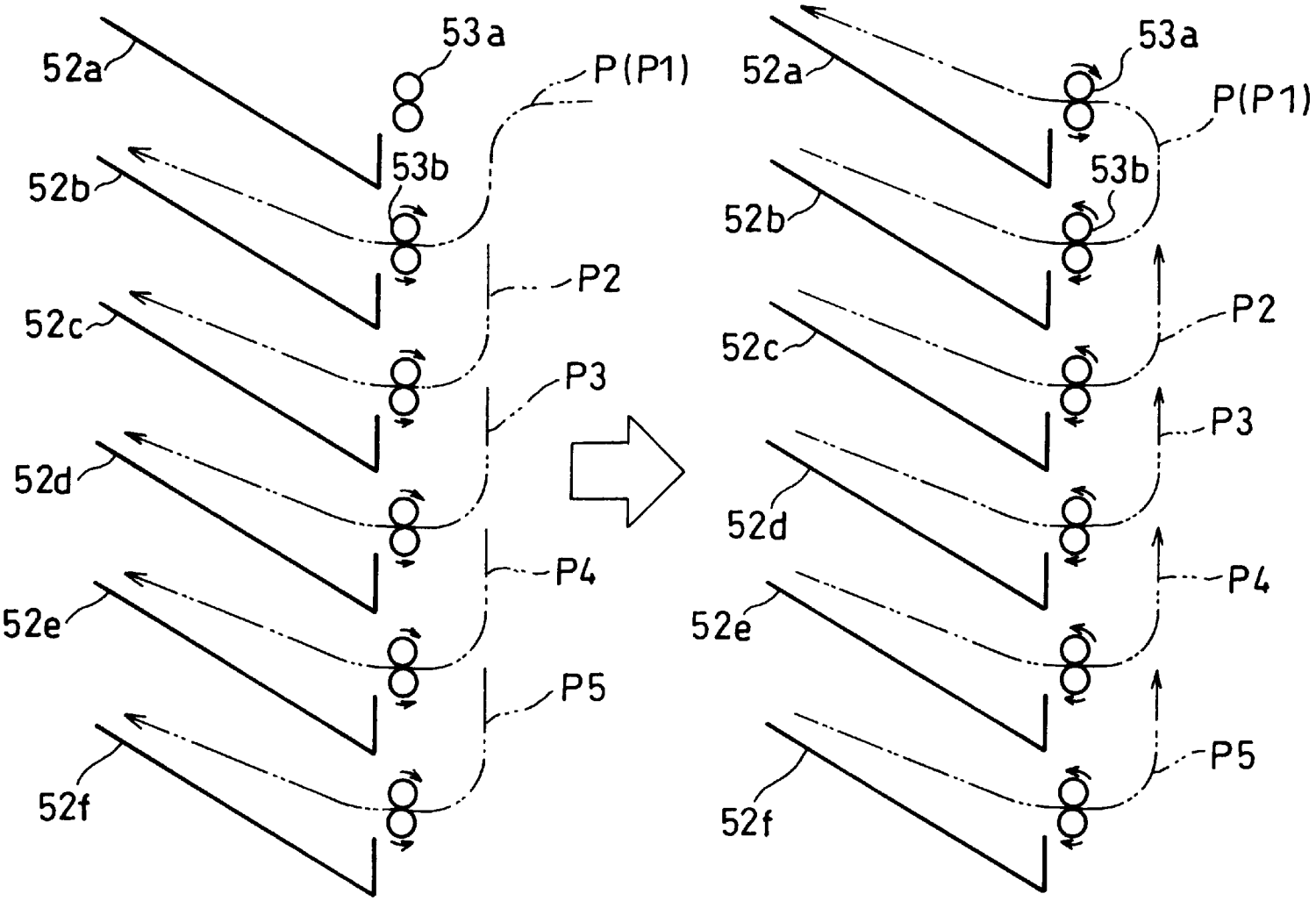
FIGS. 8(*a*) and 8(*b*) are explanatory views showing an example of the operation of reverse discharge processing in the sheet discharging apparatus.

Reverse Discharge Processing I when Highest Tray is Specified for Selected Tray As shown in FIGS. 8(*a*) and 8(*b*), this embodiment illustrates an actual example in which the first tray 52*a* on the highest level is determined as the selected tray onto which the sheet P having an image formed thereon is discharged in a state in which the sheet P is turned over. The copying machine main body 1 discharges the sheets P having images formed thereon in sequence from the leading page, and the sheet discharging apparatus 5 receives the discharged sheets P.

As illustrated in FIG. 8(*a*), the sheets P are discharged onto the respective trays except the first tray 52*a* on the highest level in sequence from the tray positioned on the upstream side of the second transport path 54 to the tray located on the downstream side. More specifically, a sheet P1 to be the first page is discharged to the second tray 52*b*, a sheet P2 to be the second page is discharged to the third tray 52*c*, a sheet P3 to be the third page is discharged to the fourth tray 52*d*, a sheet P4 to be the fourth page is discharged to the fifth tray 52*e*, and a sheet P5 to be the fifth page is discharged to the lowest tray 52*f*. This discharge processing is the same as the discharging processing using the sorting function with the exception described below. In this processing, when the trailing ends of the sheets P1 to P5 are detected by the sensors S2 to S6 (see FIG. 1), the discharging operations of the discharge rollers 53*b* to 53*f* are stopped and the sheet discharging apparatus 5 is kept on standby in a state in which the trailing ends of the sheets P1 to P5 are caught between the discharge rollers, 53*b* to 53*f*, respectively.

When the sheet P5 is discharged onto the lowest tray 52*f* and its trailing end is detected by the sensor S6, the forward rotation of the discharge rollers 53*f* is stopped, and simultaneously the reverse discharge processing is started to discharge the sheets P1 to P5 to the first tray 52*a* on the highest level in sequence from the sheet P1 that is the leading page kept on standby in the second tray 52*b* (see FIG. 8(*b*)). In this reverse discharge processing, the sheet P1 as the first page is discharged onto the first tray 52*a* in a state in which the image-formed side thereof faces downward. Thus, the succeeding sheets P are sequentially placed on the previously discharged sheet P so that their image-formed sides face downward. This reverse discharge processing is particularly controlled in such a manner that when the sheet P1 in the second tray 52*b* is not detected any longer by the sensor S2, the reverse discharge processing in the third tray 52*c* below the second tray 52*b* is started.

Therefore, when a set of sheets to be output are not more than five pages, it is possible to perform the reverse discharge processing successively. Whether the successive reverse discharge processing is available or not is determined by the number of trays (bins) in the sorter. In this embodiment, the trays are arranged on six levels for the sake of explanation. In general, a 20-level sorter is often used. In this case, it is possible to continuously feed 19 pages of sheets to the respective trays, thereby causing almost no intervals between the sheets being transported.

When a set of sheets to be output are more than five pages, the first five pages are continuously output by the digital copying machine, and the above-mentioned reverse discharge processing is continuously performed by the sheet discharging apparatus 5. The sorter control unit 46 instructs a central processing unit 44 to control the digital copying machine to temporarily stop the discharge of the sheets while the reverse discharge processing is being performed by the sheet discharging apparatus 5. Next, when the sensor S1 corresponding to the first tray 52*a* detects the completion of the reverse discharge processing for the fifth page of the sheet, the next five pages of sheets are output by the digital copying machine upon an instruction given to the central processing unit 44 from the sorter control unit 46, and the above-mentioned reverse discharge processing is repeated in the sheet discharging apparatus 5. It is thus possible to execute the reverse discharge processing for a set of numerous sheets.

Figure 9:
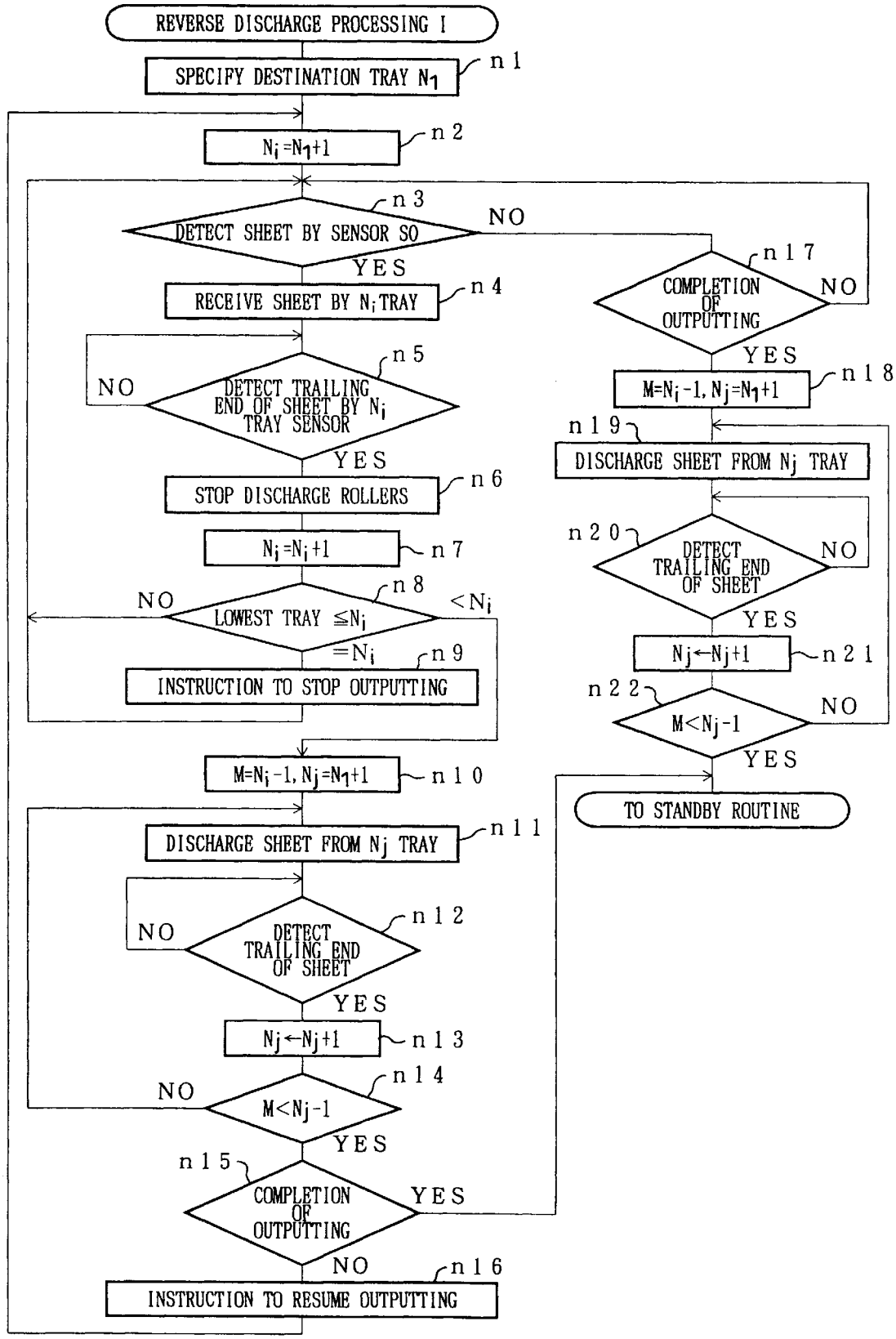
FIG. 9 is a flow chart showing the steps of controlling the operation of the reverse discharge processing shown in FIGS. 8(*a*) and 8(*b*).

Referring now to the flow chart shown in FIG. 9, the following description will explain the control of the reverse discharge processing shown in FIGS. 8(*a*) and 8(*b*). This control is carried out by the sorter control unit 46 as the sheet transport controlling means shown in FIG. 4.

First, in step n1, the selected tray to which the sheets P are finally discharged is determined, and a designating number $N_1$ is given to the determined selected tray. The following explanation is made on the assumption that the selected tray contains no sheets P discharged. In this embodiment, as explained above, the first tray 52*a* on the highest level is determined as the selected tray, and the designating number "1" is given thereto. The trays are arranged on six levels from the top to the bottom, and therefore the numbers 1 to 6 are given to the trays, respectively.

In step n2, in order to feed the sheet P to the tray located just below the selected tray, the relationship $N_i=N_1+1$ is executed. Here, $N_i$ is the counted value in a tray specifying counter. More specifically, the tray specifying counter is controlled to execute "$N_1$+1" with respect to the designating number $N_i$ of the selected tray, and "$N_1$+1" is stored as the counted value $N_i$ in the tray specifying counter. Thus, the second tray 52*b* is brought into a sheet receiving state.

When the sensor S0 detects the transport state of the sheet P1 output from the copying machine main body 1 in step n3, the control for transporting the sheet P1 to the second tray 52*b* is executed in step n4. Namely, the first gate 55*a* is switched to the switching position, and the second gate 55*b* is switched to the switching position. Specifically, the first gate 55*a* was switched to the switching position in advance upon the initiation of the reverse discharge processing.

Consequently, the sheet P1 is fed to a tray specified by the counted value N in the tray designating counter, i.e., to the second tray 52*b*. In step n5, it is confirmed if the sensor S2 detects the trailing end of the sheet P1. When the trailing end of the sheet P1 is detected, the forward rotation of the discharge rollers 53*b* is stopped (step n6). As a result, the sheet P1 is kept on standby in a state in which the trailing end thereof is caught between the discharge rollers 53*b*.

In step n7, in order to feed the next sheet Pi to the tray on the next level, this tray is specified by executing $N_i \leftarrow N_i+1$. The designating number of the tray on the next level is specified by the counted value $N_i$ in the tray specifying counter. In step n8, it is confirmed whether the specified designating number is equal to or is not greater than the designating number of the lowest tray 52*f*. When the specified designating number is equal to or is not greater than the designating number of the lowest tray 52*f*, the control operation returns to step n3, and the presence of the next sheet Pi is checked by the sensor S0.

Here, if no sheet is detected in step n3 before the specified designating number exceeds the designating number of the lowest tray 52*f*, the control operation moves to step n17. In step n17, it is confirmed whether no more sheets are output, i.e., whether the output of the formed images has been completed in the copying machine main body 1. When the completion of the output is confirmed, the control processes in steps n18 to n22 are repeated so as to perform the reverse discharge processing for the sheets P which have been fed to the respective trays and kept on standby.

On the other hand, in step n8, when the counted value $N_i$ in the tray specifying counter is equal to the counted value ($N_6$) specifying the lowest tray 52*f*, the copying machine main body 1 is instructed to pause the output operation in step n9. This instruction is carried out in the step of discharging the sheet P to the lowest tray 52*f*. In particular, when the lowest tray 52*f* is specified, the sheet P5 to be discharged to the lowest tray 52*f* is being fed from the copying machine main body 1 to the sheet discharging apparatus 5, and therefore an instruction to pause the output is given at the time the lowest tray 52*f* is specified. When the feeding of the sheet P5 to the lowest tray 52*f* is completed, the tray specifying counter has counted a number exceeding the designating number of the lowest ray 52*f*. Thus, in order to execute the reverse discharge processing, the processes in steps n10 to n14 are performed as follows.

In step n10, the value $N_i$−1 is stored as the counted value M in another counter with respect to the counted value $N_i$ in the tray specifying counter in step n8. In order to specify the second tray 52*b* below the first tray 52*a*, the tray specifying counter is controlled to perform $N_j=N_i+1$ (where $N_1$ is the address number of the selected tray). When $N_1=1$, $N_j=2$ is stored in the tray specifying counter (n10). Consequently, in order to perform reverse discharge processing in the second tray 52*b*, the discharge rollers 53*b* are rotated in the reverse direction (n11). At this time, the second gate 55*b* is switched to the non-switching position, while the first gate 55*a* retains the switching position. The reverse discharge processing is performed in this state. As a result, the sheet P1 in the second tray 52*b* is fed back to the first tray 52*a*, and is discharged to the first tray 52*a* din a state in which the sheet P1 is reversed (turned over). In this reverse discharge processing, in order to start the reverse discharge processing for the next sheet P, the counted value $N_j$ in the tray specifying counter is counted up (step n13) upon the detection of the trailing end of the sheet P1 by the sensor S2 (n12). In step n14, $N_j$−1 obtained from the counted value $N_j$ in the tray specifying counter and the counted value M in the another counter are compared.

In this comparison, if the counted value $N_j$−1 does not exceed the counted value M, the control operation moves to step n11, and the reverse-discharge processing is performed for the sheet P which has been kept on standby in the tray specified by the counted value $N_j$. The reverse discharge processing is performed by rotating the discharge rollers corresponding to the tray specified by the counted value $N_j$ in the reverse direction. In this case, as described above, the first gate 55*a* retains the switching position, while the gate corresponding to the specified tray is switched to the non-switching position and the other gates are switched to the switching position. For example, when the reverse discharge processing is performed for the sheet P2 in the third tray 52*c*, only the third gate 52*c* is switched to the non-switching position and the other gates are switched to the switching position under this control.

When the reverse discharge processing for the sheet P5 in the lowest tray 52*f* is completed by repeating such a control, $N_j \leftarrow N_j+1$ is executed and a comparison between the counted value M and the counted value $N_j$−1 is performed. As a result, it is detected that the counted value $N_j$−1 exceeds the counted value M. In this case, when it is confirmed in step n15 that the output operation has not been completed in the copying machine main body 1, the copying machine main body 1 is instructed to resume the output operation in step n16. On the other hand, when it is confirmed in step n15 that the output operation has been completed in the copying machine main body 1, the control operation moves to a routine that keeps the copying machine main body 1 on standby.

Here, when the output operation of the copying machine main body 1 is completed at the time or before the lowest tray 52*f* is specified to receive the sheet P5, the detection of the sheet is not performed in step n3. Therefore, the sorter control unit 46 receives a signal indicating the completion of the output operation from the copying machine main body 1 in step n17.

Moreover, even when the copying machine main body 1 is instructed to pause the output operation at the time the lowest tray 52*f* is specified in step n8, the output operation has already been stopped in the copying machine main body 1 due to the process in step n9. In this case, the control operation moves to step n17 from step n3, and a signal indicating the completion of the output operation is received from the copying machine main body 1. Thereafter, the same processes as in steps n10 to n14 mentioned above are carried out in steps n18 to n22.

Thus, when the number of bins (trays) in the sorter is represented by N, if the number of sheets to be output from the copying machine main body 1 is not more than the number of the bins except the selected tray (N−1), it is possible to feed all of the sheets P to the trays except the selected tray. Subsequently, by selectively rotating in the reverse direction the discharge rollers 53 in the standby state for the reverse discharge processing, it is possible to perform the reverse discharge processing for discharging the sheets P to the selected tray, for example, the first tray 52*a* in sequence from the sheet P which was fed to the tray first and is kept on standby therein. As a result, the first tray 52*a* contains the output sheets P arranged in page order. In this case, since the sheets P are discharged to the highest tray, the user can easily remove the output materials.

Therefore, in the present invention, a sequence of the reverse discharge processing is continuously performed when the number of the sheets to be output is not more than the number given by subtracting one from the number of trays in the sorter in the copying machine main body 1. Moreover, since there is no need to instruct the copying machine main body 1 to pause the operation, it is possible to match the intervals of the sheets to the intervals of the processing performed by the digital copying machine. Furthermore, even when the number of sheets to be output exceeds the number given by subtracting one from the number of trays, the output operation of the copying machine main body 1 is paused only for a period of time in which the reverse discharge processing is performed. Therefore, compared to the case in which the reverse discharge processing is performed for each of the sheets, the processing speed can be increased.

In addition, when there is a variation in the size of the sheets P which are kept on standby in a state in which the sheets P are caught between the discharge rollers 53, the processing can be executed without changing the intervals between the sheets until the standby state. Namely, even when the sheets P vary in size, the processing can be performed irrespectively of the sizes of the sheets P because the discharge rollers 53 are stopped upon the detection of the trailing ends of the sheets P by the sensors S2 to S6. In the step of moving to the reverse discharge processing, the control is performed so that, when the sheet P caught between the discharge rollers 53 is reverse-transported, the reverse discharge processing for the next sheet P is carried out upon the detection of the leading end of the sheet P, i.e., the trailing end of the sheets P being reverse-transported, by the sensors S2 to S6. Therefore, since there is no need to change the intervals of sheets according to the size of each sheet, no special controlling means is required. Thus, even when the sheets vary in size, it is possible to discharge the sheets in proper page order by performing simple control.

In another mode of this embodiment, in the copying machine main body 1, when the number of sheets to be output is known in advance, it is possible to increase the processing speed according to the number of sheets to be output. In particular, when the number of sheets to be output is not less than the number of trays in the sorter, if the number given by subtracting the number of trays (N−1) from the number of sheets to be output (Ns) is less than the number of trays (N−1), the copying machine main body 1 is controlled to output Ns−(N−1) sheets before (N−1) sheets.

As a result, it is not necessary to perform the reverse discharge processing with respect to all of the trays, i.e., it is necessary to perform the reverse discharge processing Ns−(N−1) times which are less than (N−1). Therefore, the time taken for the reverse discharge processing can be reduced compared to the case in which (N−1) sheets are output beforehand. Namely, the time taken for pausing the output operation of the copying machine main body 1 for the reverse discharge processing is shortened. Moreover, since the reverse discharge processing can be successively executed for the next (N−1) sheets, it is possible to shorten the overall processing time.

Here, when the fax mode is selected, there may be a case in which data, such as the number of sheets to be transmitted, are transmitted before the transmission of the image data. Similarly, when the printer mode is selected, data such as the number of pages are often sent from another word processor or personal computer. It is therefore possible to execute the above-mentioned processing easily according to the data, such as the number of sheets to be transmitted and the number of pages.

Furthermore, as shown in FIGS. 8(*a*) and 8(*b*), when the first tray 52*a* on the highest level is determined as the selected tray, the control is performed so that the sheets P are fed to the trays in sequence from the lower tray nearest to the first tray 52*a* toward the lowest trays. However, needless to say, it is possible to feed the sheets P to the trays by specifying a tray in sequence from the lowest tray upward, and then perform the reverse discharge processing.

Reverse Discharge Processing II when Lowest Tray is Specified for Selected Tray The above-mentioned reverse discharge processing I is performed when a higher tray, for example, the highest tray, is specified for the selected tray to which the sheets P are finally discharged. The following description will explain an example in which a lower tray is specified for the selected tray.

Figure 10:
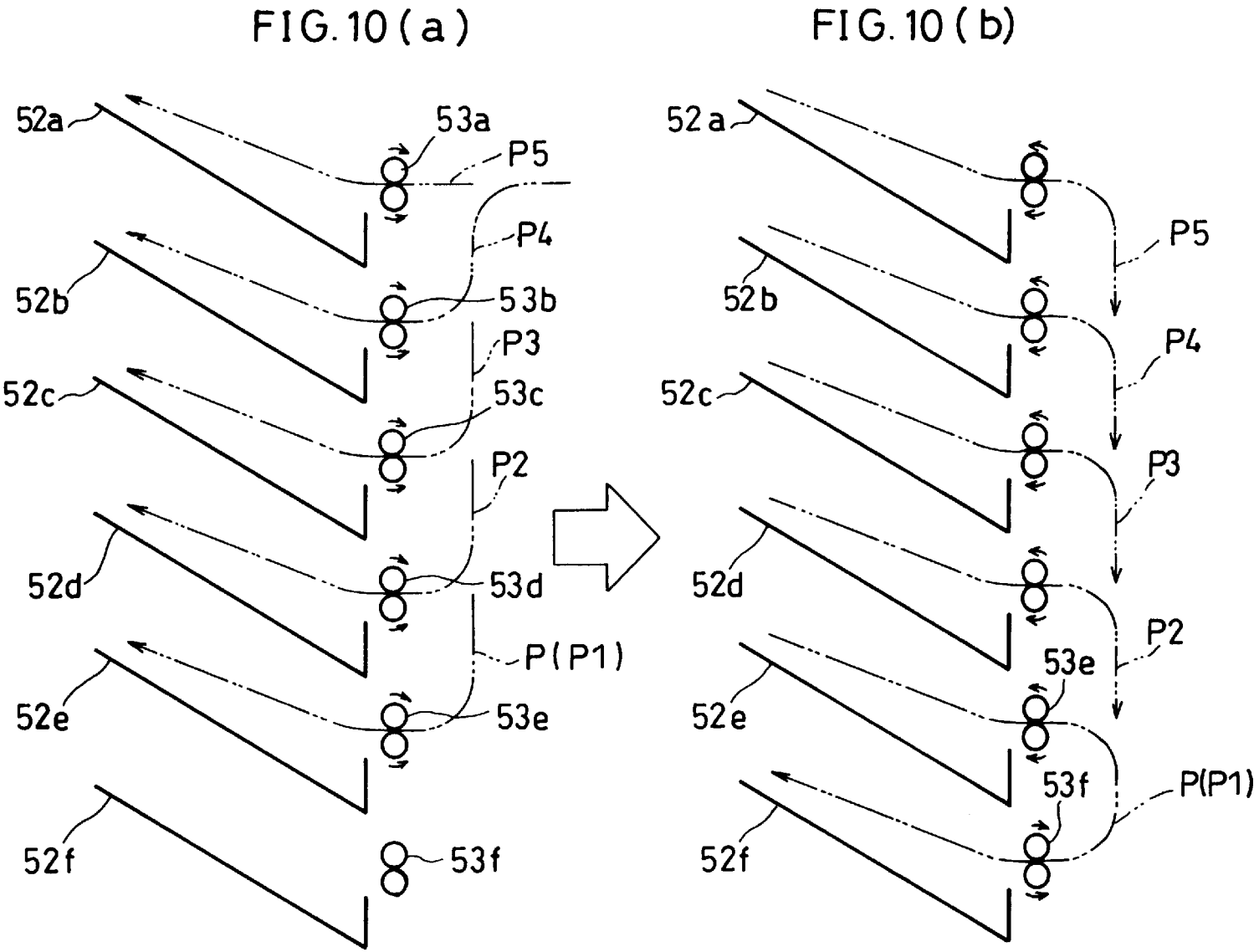
FIGS. 10(*a*) and 10(*b*) are explanatory views showing another example of the operation of the reverse discharge processing in the sheet discharging apparatus.

In the mode explained below, the lowest tray is specified for the selected tray. FIGS. 10(*a*) and 10(*b*) are views for explaining the operation of the reverse discharge processing.

As illustrated in FIG. 10(*a*), the sheets P (P1 to P5) having images formed thereon from the copying machine main body 1 are discharged onto the respective trays in sequence from the fifth tray 52*e* upward. More specifically, the fifth tray 52*e* to which the sheet P1 to be the first page is discharged is located on the upstream side with respect to the lowest tray 52*f* as the selected tray in the second transport path 54. When the trailing ends of the sheets P1 to P5 are detected by the sensors S5 to S1, respectively, the forward rotations of the discharge rollers 53*e* to 53*a* are stopped. As a result, the sheet discharging apparatus 5 is kept on standby in a state in which the trailing ends of the sheets P1 to P5 are caught between the discharge rollers 53*e* to 53*a*, respectively. When the feeding of the sheets P1 to P5 to all of the trays 52*e* to 52*a* except the lowest tray 52*f* is completed, the reverse discharge processing is performed for the sheets P1 to P5 in sequence from the sheet P1 as shown in FIG. 10(*b*). As a result, the sheet P1 is discharged onto the lowest tray 52*f* in a state in which the sheet P1 is turned over, and then the sheets P2 to P5 are sequentially discharged in their turned over state on the sheet P1. Consequently, the lowest tray 52*f* contains the output materials arranged in page order.

In this case, since the lowest tray 52*f* is selected for the tray to which the sheets P2 to P5 are finally discharged, the sheet P1 is fed to the fifth tray 52*e*. When the sheet P1 is in a standby state in the fifth tray 52*e*, even if the reverse discharge processing for the sheet P1 is performed successively after the feeding of the sheet P2, the processing can be performed without causing problems. Therefore, in a state in which the next sheet P2 is being fed to the fourth tray 52*d*, the reverse discharge processing for the sheet P1 is performed simultaneously in the fifth tray 52*e*.

Figures 11A, 11B:
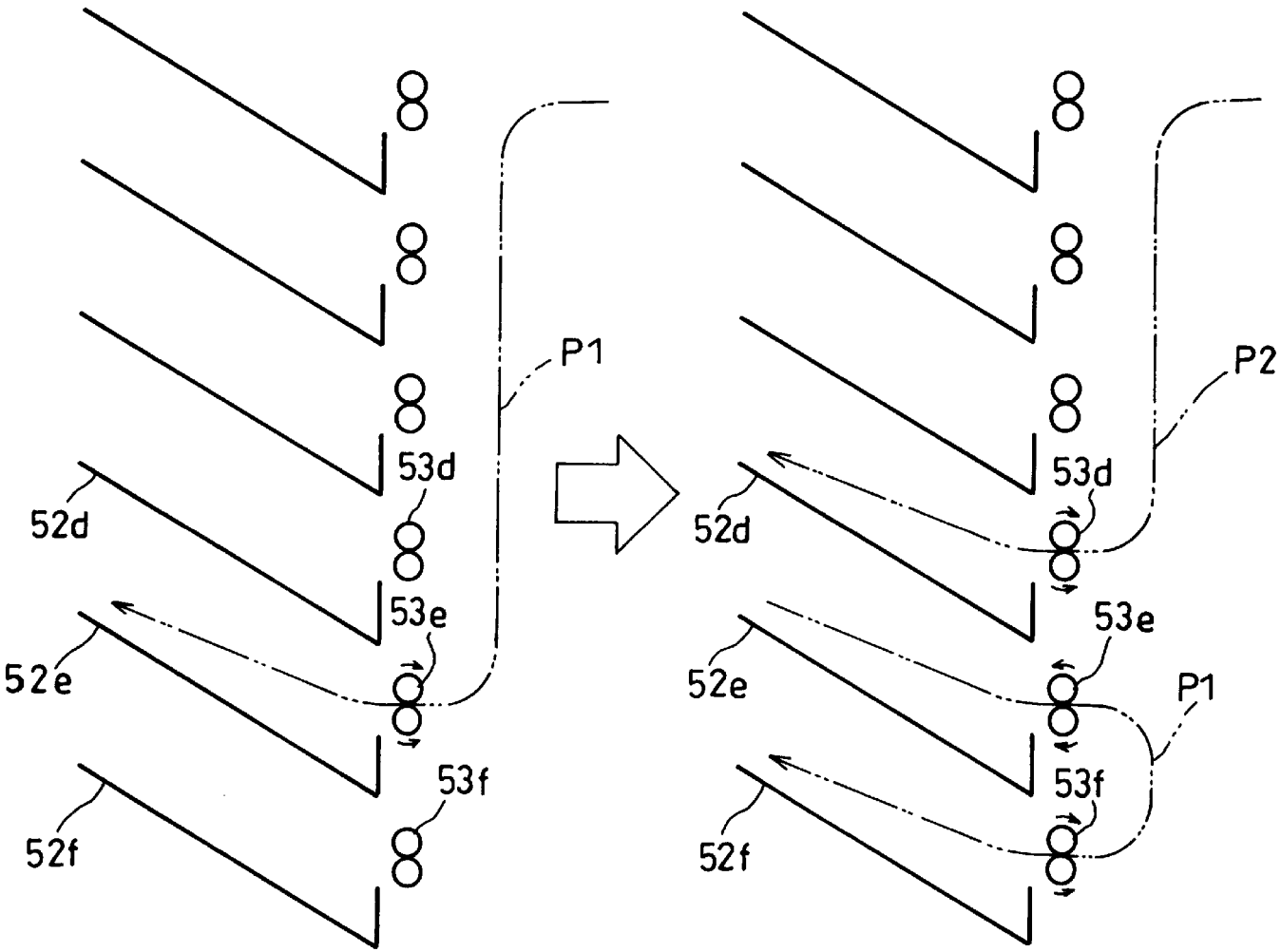
FIGS. 11(*a*) and 11(*b*) are explanatory views showing an optimum example of the operation of the reverse discharge processing in the sheet discharging apparatus.

Namely, the reverse discharge processing for the sheet P1 can be successively performed upon the completion of the feeding of the sheet P1 as shown in FIGS. 11(*a*) and 11(*b*) without causing the reverse discharge processing to be kept on standby until the sheets P1 to P5 have been fed to all of the trays 52*e* to 52*a* except the lowest tray 52*f* as shown in FIGS. 10(*a*) and 10(*b*). Here, the completion means a state in which the discharge rollers 53*e* are stopped, and the trailing end of the sheet P1 is caught between the discharge rollers 53*e*.

Thus, by performing the feeding of a sheet and the reverse discharge processing for the sheet successively from the lower tray upward, the interval between sheets is slightly increased only when the feeding of the sheet P5 to the first tray 52*a* on the highest level is completed. The slight increase in the interval between sheets occurs because the copying machine main body 1 is kept on standby for a short period of time during which the reverse discharge processing for the sheet P5 is performed. In short, since the output operation of the copying machine main body 1 needs to be stopped only for the short period of time during which the reverse discharge processing for the sheet P5 is performed, it is possible to minimize the time taken for the reverse discharge processing.

In this control, since the sheets P are controlled to be transported toward the downstream side in the second transport path 54, the transport rollers 56*a* to 56*e* shown in FIG. 1 are always rotated in one direction. Therefore, the control and the mechanism for rotating the rollers 56*a* to 56*e* are very simple.

Figure 12:
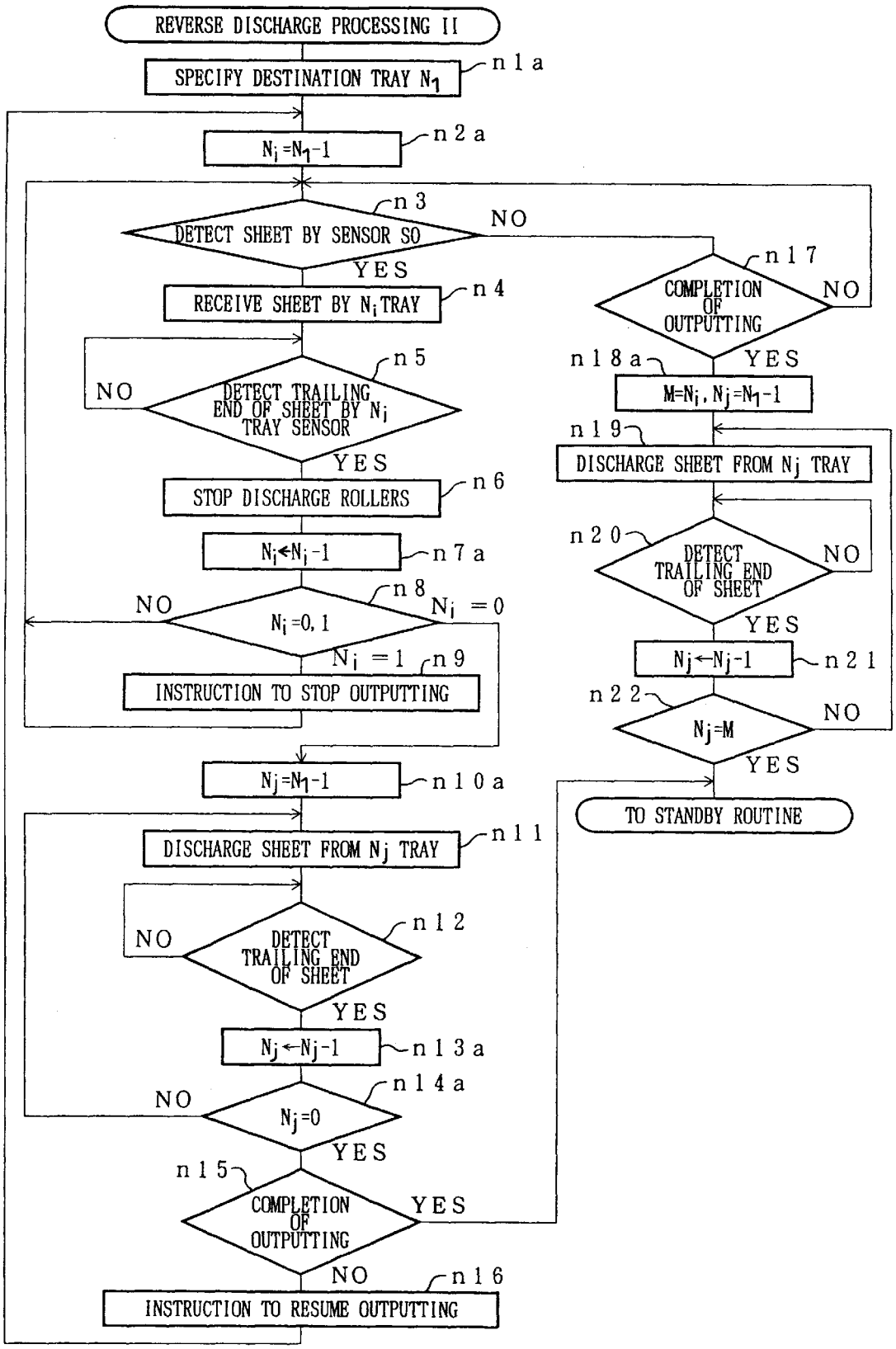
FIG. 12 is a flow chart for achieving the operation of the reverse discharge processing shown in FIGS. 10(*a*) and 10(*b*).

FIG. 12 is the flow chart for controlling the discharge of the sheets P shown in FIGS. 10(*a*) and 10(*b*). Since a tray which is different from the selected tray in FIG. 9 is selected in FIG. 12, the tray specifying operation slightly varies. Except for this difference, the control processes are exactly the same. Therefore, the same control steps are indicated by the same step codes.

First, in step n1*a*, a tray to which the sheets P are finally discharged is selected. Here, the lowest tray 52*f* is determined as the selected tray. In this case, it is assumed that the lowest tray 52*f* contains no sheets P discharged. When the trays are arranged on six levels, the counted value N in the tray specifying counter is "$N_1$=6".

Next, in step n2*a,* in order to specify a tray to which the sheet P having an image formed thereon is fed first from the copying machine main body 1, the tray specifying counter is controlled to carry out the operation $N_1-1$. As a result, a substraction is performed on the content of the tray specifying counter, and the tray corresponding to the counted value given by the subtraction is specified and then the sheet P1 to be the first page is fed to the tray (step n4). In this case, the first gate 55*a* is switched to the switching position and the gates 55*b* to 55*d* are switched to the non-switching position under control. The fifth gate 55*e* corresponding to the specified fifth tray 52*e* is switched to the switching position so as to produce a state for receiving the sheet P. Therefore, when the sheet P1 to be the first page is fed to the fifth tray 52*e* and the trailing end thereof is detected by the sensor S5 (step n5), the forward rotations of the discharge rollers 53*e* corresponding to the fifth tray 52*e* are stopped (step n6).

Thereafter, in order to receive the next sheet P by the tray above the fifth tray 52*e*, the operation $N_i-1$ is executed and $N_i-1$ is stored as the counted value $N_i$ in the tray specifying counter, for specifying this tray (step n7*a*). In step n8*a*, the processes in step n3 to step n7*a* are repeated until $N_i-1$ equals 1 or 0. In step n8*a*, when $N_i-1$ is 1, the first tray 52*a* on the highest level is specified, and therefore there is no more trays for receiving the sheets P. Consequently, the copying machine main body 1 is instructed to pause the output of sheets after the fifth page (step n9). Thereafter, it is confirmed in step n3 whether the sheets P are being fed to the sheet discharging apparatus 5.

In step n3, when the sheet P is not detected, whether a signal indicating the completion of the output operation has been received from the copying machine main body 1 is checked in step n17. When the output operation has not been completed, the operation is kept on standby until the next sheet P is detected by the sensor S0. When the next sheet P is detected, a processing is performed so that the sheet P is received by the first tray 52*a* on the highest level. When the processing is completed, the counted value $N_i$ in the tray specifying counter becomes "0", and thus it is possible to perform the reverse discharge processing for the sheets P received by all of the trays 52*a* to 52*d*.

In the reverse discharge processing, in order to discharge the sheets P from the first sheet P1 as the first page, "1" is subtracted from the number $N_1$ of the lowest tray 52*f* as the selected tray (step n10*a*). As a result, the fifth tray 52*e* is specified, and the reverse discharge processing is performed by discharging the sheets P to the lowest tray 52*f* in sequence from the fifth tray 52*e*.

When the reverse discharge processing for the sheet P5 in the first tray 52*a* on the highest level is completed (step n14*a*), it is checked whether the output operation of the copying machine main body 1 has been completed (step n15). When the output operation has not been completed, the copying machine main body 1 is instructed to resume the output operation and the above-mentioned processes are repeated. Whereas when the output operation has been completed, the copying machine main body 1 moves to the standby routine so as to perform the next output operation.

On the other hand, when the output operation of the copying machine main body 1 is completed at the time or before the first tray 52*a* on the highest level is specified, the sensor S0 can never detect the sheet P in step n3. Therefore, the sorter control unit 46 receives a signal indicating the completion of the output operation from the copying machine main body 1 in step n17, and then the reverse discharge processing is carried out for the sheets which are kept on standby after being fed. In order to perform the reverse discharge processing, the value $N_i$ in the tray specifying counter is stored as the counted value M in another counter (step n18*a*). Then, in order to start the reverse discharge processing for these sheets in sequence from the sheet P1 as the first page, the fifth tray 52*e* is specified according to the counted value $N_j$. Therefore, like step n2*a*, the value obtained by subtracting "1" from the designating number $N_1$ of the lowest tray 52*f* is stored in the tray specifying counter (step n18*a*), and the reverse discharge processing is performed sequentially from the sheet which is kept on standby after being fed to the specified tray (step n19) so as to reverse-transport the sheet to the lowest tray 52*f*. When the reverse discharge processing is completed, the control operation moves to the standby routine.

In the above-mentioned reverse discharge processing II, when the number of sheets to be output from the copying machine main body 1 is not more than the number of the bins (trays) other than the selected tray (N−1) in the sorter, it is possible to perform the reverse discharge processing continuously for the sheets P by the processes of steps n18*a* to n22, thereby increasing the processing speed. Moreover, even when the number of sheets to be output exceeds the above-mentioned number (N−1), the processing speed can be increased compared to the conventional structure in which the reverse discharge processing is performed for a sheet and then the reverse discharge processing is performed for the next sheet.

Furthermore, as explained in the above section for the reverse discharge processing I, when the number of sheets to be output is known in advance, the time taken for the simultaneous reverse discharge processing can be shortened by controlling the reverse discharge processing according to the number of sheets to be output.

Another Optimum Embodiment of Reverse Discharge Processing II

In the above explanation, when the feeding of sheets to the respective trays other than the selected tray is completed, the reverse discharge processing is performed for the respective sheets simultaneously. In particular, as illustrated in FIGS. 11(*a*) and 11(*b*), if a lower tray is selected as a tray to which the sheets are finally discharged, when the feeding of the sheets to a higher tray is completed, it is possible to successively perform the reverse discharge processing and the feeding of a sheet to a still higher tray simultaneously without causing problems.

Figure 13:
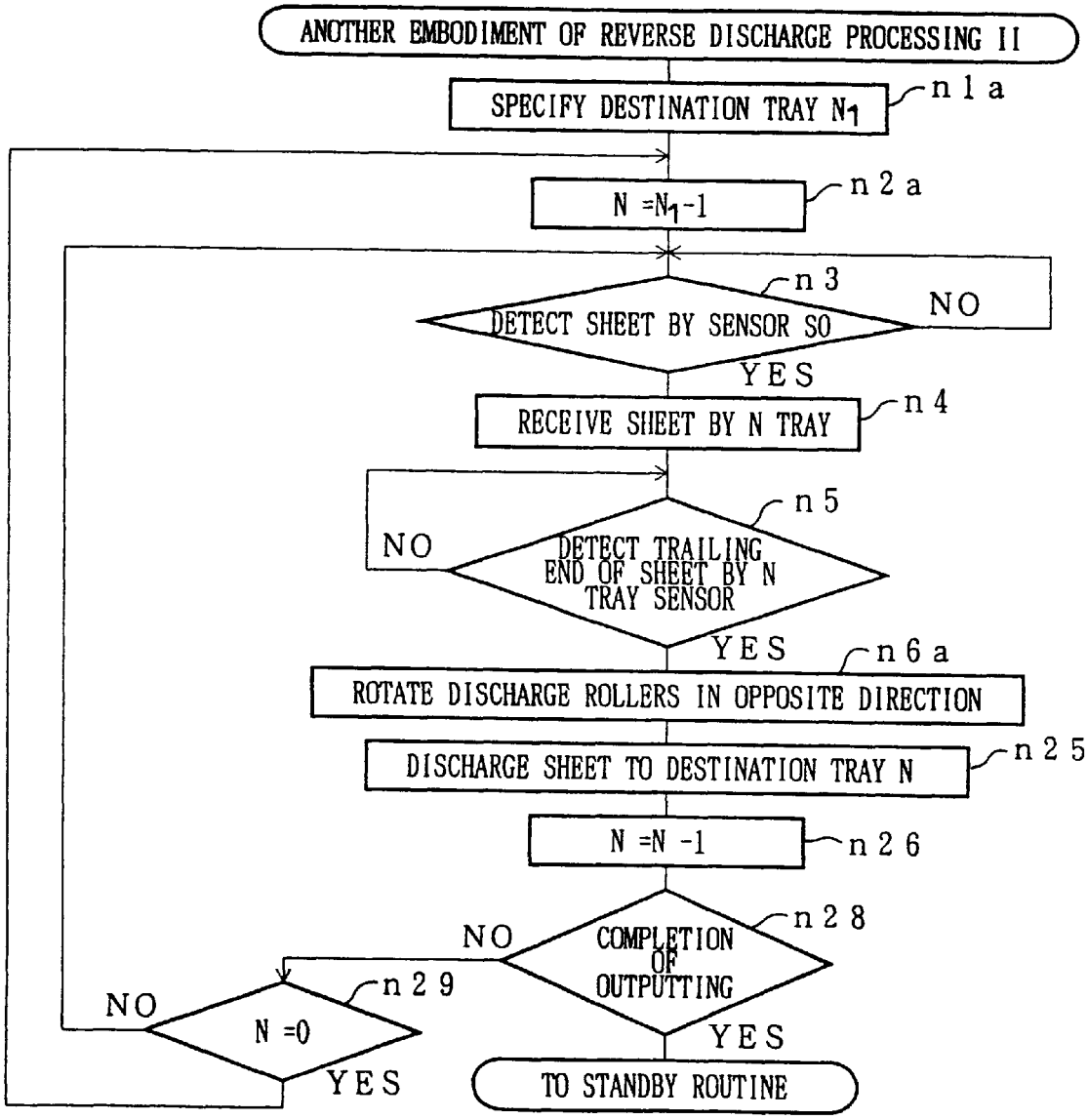
FIG. 13 is a flow chart showing the steps of controlling the operation of the reverse discharge processing shown in FIGS. 11(*a*) and 11(*b*).

The flow chart for controlling such an operation is shown in FIG. 13. With reference to FIG. 13, how to control the operation shown in FIGS. 11(*a*) and 11(*b*) will be explained below. Here, the steps in which the same processes as those for the operations shown in FIGS. 9 and 12 are performed are indicated by the same codes.

First, in step n1*a*, the lowest tray 52*f* is selected for a tray to which the sheets P are finally discharged. Then, the value obtained by subtracting one from the designating number ($N_1$) of the lowest tray 52*f* is stored as the counted value N in the tray specifying counter (step n2*a*). After the completion of this process, the sheet P1 having an image formed thereon is discharged from the copying machine main body 1. When the sheet P1 is fed to the sheet discharging apparatus 5 through the transport rollers 50, the sheet P1 is detected by the sensor S0. In step n3, when the sheet P1 is detected, a process for feeding the sheet P1 to the tray specified in step n2*a* is executed (step n4). At this time, only the gate facing the specified tray is switched to the switching position and the other gates are all switched to the non-switching position under control. At this time, the first gate 55*a* is switched to the switching position. It is therefore possible to feed the sheet P1 to the specified tray.

When the trailing end of the sheet P1 is detected by a sensor corresponding to the specified tray, i.e., the sensor S5 corresponding to the fifth tray 52*e* which is specified first (step n5), the forward rotations of the discharge rollers 53*e* are stopped. As a result, the trailing end of the sheet P1 is caught between the discharge rollers 53*e*. Subsequently, in order to reverse-discharge the sheet P1 to the lowest tray 52*f*, the discharge rollers 53*e* are rotated in the reverse direction (step n6*a*). At this time, the fifth gate 55*e* is retained in the same position, and the sheet P1 being reverse-transported is discharged to the lowest tray 52*f* (step n25). Thereafter, in order to feed the next sheet P2 to the fourth tray 52*d* above the fifth tray 52*e*, the fourth gate 55*d* is switched to the switching position during the reverse transport, while the gates 55*b* and 55*c* located on the upstream side are retained in the non-switching position.

Regarding the fifth tray 52*e* to which the sheet P1 to be the first page has been fed, in order to perform the reverse discharge processing for the sheet P1, the corresponding discharge rollers 53*e* are driven in the reverse direction in step n6*a* as explained above. At this time, the reverse discharge of the sheet P1 to the lowest tray 52*f* and the feeding of the next sheet P2 to the fourth tray 52*d* are carried out simultaneously. Therefore, in order to specify the fourth tray 52*d*, the operation of "N−1" is carried out in step n26, and the value thus obtained is stored as the counted value N in the tray specifying counter. Subsequently, in step n28, whether the output operation of the copying machine main body 1 has been completed or not is checked.

When the sorter control unit 46 has received a signal indicating the completion of the output operation from the copying machine main body 1, the control operation moves to the standby routine upon the completion of the reverse discharge processing for the sheets P fed to the trays. When the output operation has not been completed, it is confirmed whether the content of the tray specifying counter is "0" (step n29). When content of the tray specifying counter is "0", the specified tray is not present. Therefore, the control operation returns to step n2*a*, and the fifth tray 52*d* on a higher level nearest to the lowest tray 52*f* is specified again.

Meanwhile, when the first tray 52*a* on the highest level is specified, there is no more tray to which the next sheet P6 following to the sheet P5 fed to the first tray 52*a* can be fed. Therefore, in step n26, the copying machine main body 1 is informed that there is no tray for receiving the succeeding sheets P at the time N=1 is confirmed. Subsequently, the control operation returns to step n3, and the feeding of the sheet P5 to the first tray 52*a* on the highest level is performed. Then, when the trailing end of the sheet P5 is detected by the sensor S1 during the reverse discharge processing performed in step n25, the copying machine main body 1 is instructed to resume the output of the sheet P6 to the sheet discharging apparatus 5. In this case, it is possible to control the copying machine main body 1 so that the output speed is temporarily decreased or the intervals between the sheets P to be output are temporarily increased at the time the first tray 52*a* on the highest level is specified, without pausing the operation of the copying machine main body 1.

Thus, the reverse discharge processing for the sheet P5 is started when the first tray 52*a* on the highest level has received the sheet P5. Since the output operation of the copying main body 1 continues during the reverse discharge processing for the sheet P5, the processing for receiving the succeeding sheet P6 by the fifth tray 52*e* can be successively executed after the reverse discharge processing for the sheet P5. Finally, when the output operation is completed, the control operation moves to the standby routine for the next sheet.

Therefore, only when there is no more tray to which the next sheet P can be fed, the receipt of the next sheet P is slightly delayed for a short period of time during which the reverse discharge processing for the previous sheet P is performed. Since this delay is very short, the overall processing speed is not lowered.

As described above, in the reverse discharge processing for the sheets P shown in FIGS. 10(*a*) and 10(*b*) or FIGS. 11(*a*) or 11(*b*), since the transport rollers 56*a* to 56*e* disposed on the second transport path 54 are always rotated in the same direction particularly when receiving the sheets P and when reverse-transporting the sheets P, the driving mechanism thereof is simplified compared to the driving mechanism for the discharge processing shown in FIGS. 8(*a*) and 8(*b*). Namely, when performing the operation shown in FIGS. 8(*a*) and 8(*b*), it is during the reverse discharge processing for the sheet P5, the processing for receiving the succeeding sheet P6 by the fifth tray 52*e* can be successively executed after the reverse discharge processing for the sheet P5. Finally, when the output operation is completed, the control operation moves to the standby routine for the next sheet.

Therefore, only when there is no more tray to which the next sheet P can be fed, the receipt of the next sheet P is slightly delayed for a short period of time during which the reverse discharge processing for the previous sheet P is performed. Since this delay is very short, the overall processing speed is not lowered.

As described above, in the reverse discharge processing for the sheets P shown in FIGS. 10(*a*) and 10(*b*) or FIGS. 11(*a*) or 11(*b*), since the transport rollers 56*a* to 56*e* disposed on the second transport path 54 are always rotated in the same direction particularly when receiving the sheets P and when reverse-transporting the sheets P, the driving mechanism thereof is simplified compared to the driving mechanism for the discharge processing shown in FIGS. 8(*a*) and 8(*b*). Namely, when performing the operation shown in FIGS. 8(*a*) and 8(*b*), it is necessary to arrange the transport rollers 56*a* to 56*e* to be rotatable in the reverse direction.

Moreover, when the reverse discharge processing shown in FIGS. 11(*a*) and 11(*b*) are performed, the time in which the copying machine main body 1 is paused becomes very short, thereby increasing the processing speed for the reverse discharge.

Reverse Discharge Processing III when Lowest Tray is Specified for Selected Tray The following description will explain a mode for carrying out efficient reverse discharge processing of the present invention. In this reverse discharge processing III, the processing speed can be increased like the above-mentioned another embodiment of the reverse discharge processing II.

Figures 14A, 14B, 14C:
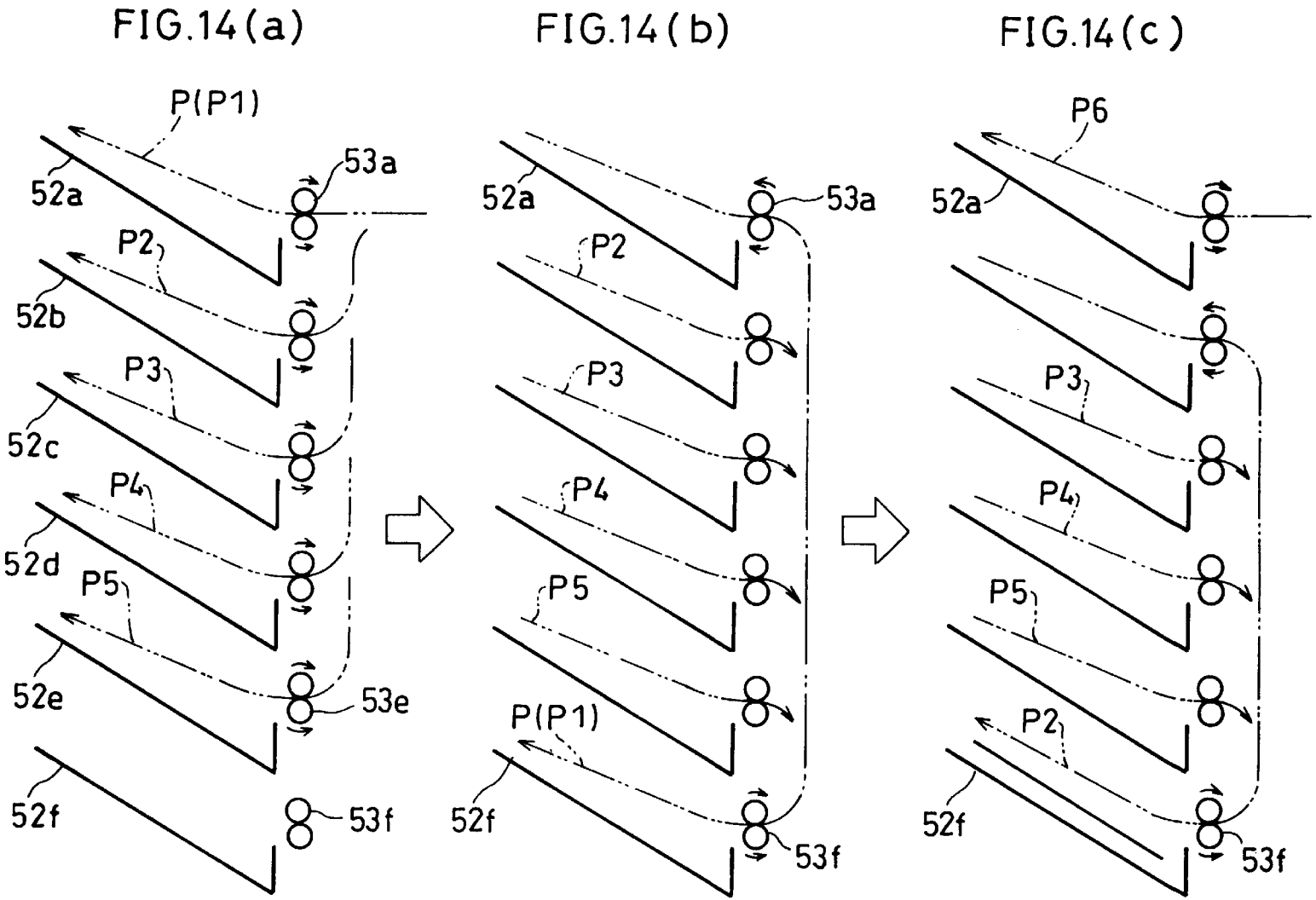
FIGS. 14(*a*) to 14(*c*) are explanatory views showing another optimum example of the operation of the reverse discharge processing in the sheet discharging apparatus.

FIGS. 14(*a*) to 14(*c*) are views for explaining the operation in which the lowest tray 52*f* is selected for a tray to which the sheets P having images formed thereon are finally discharged, and such sheets P output from the copying machine main body 1 are fed to the respective trays 52*a* to 52*e* in sequence from the first tray 52*a* on the highest level downward. In the next step, when the feeding of the sheets P to all of the trays except the selected tray has been completed, the reverse discharge processing is performed for the respective sheets P.

First, the reverse discharge processing is performed for the sheet P1 in the first tray 52*a* on the highest level. In this case, when the trailing end of the sheet P5 to be fed to the fifth tray 52*e* is detected by the transport sensor S0, the reverse discharge processing for the sheet P1 in the first tray 52*a* on the highest level is successively started so that the sheet P1 and the sheet P5 do no overlap. Subsequently, when the trailing end of the sheet P1 being reverse-transported is detected by the sensor S1, the feeding of the next sheet P6 to the first tray 52*a* on the highest level is started. Such control achieves the reverse discharge processing with a minimum sheet interval.

Namely, by performing the reverse discharge processing for a certain sheet, an empty tray is effectively used for controlling the feeding of sheets. The reverse discharge processing in other tray can be executed according to the control for the feeding of sheets.

Figure 15:
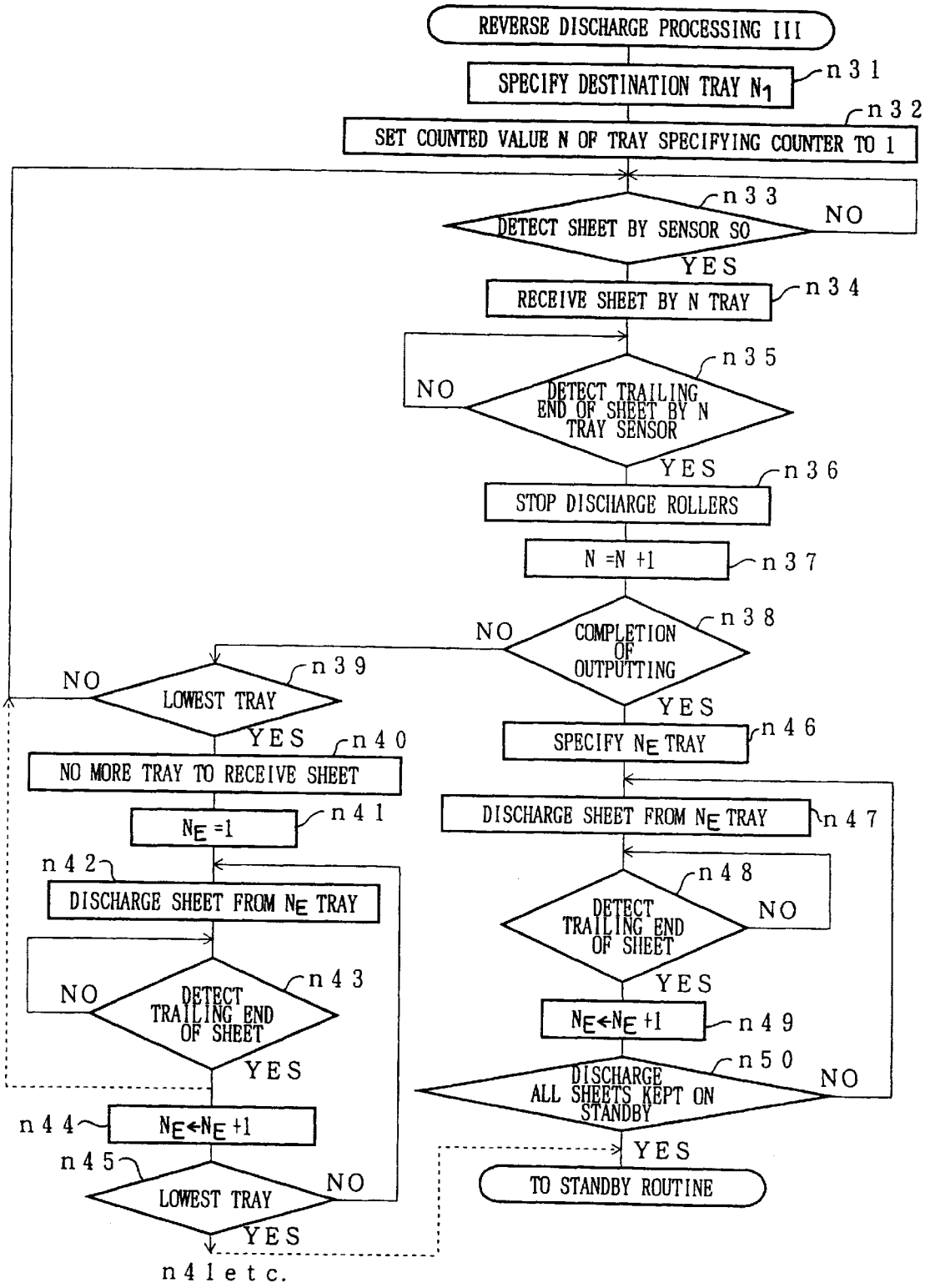
FIG. 15 is a flow chart showing another control steps for achieving the operation of the reverse discharge processing shown in FIGS. 14(*a*) to 14(*c*).
Figure 16A:
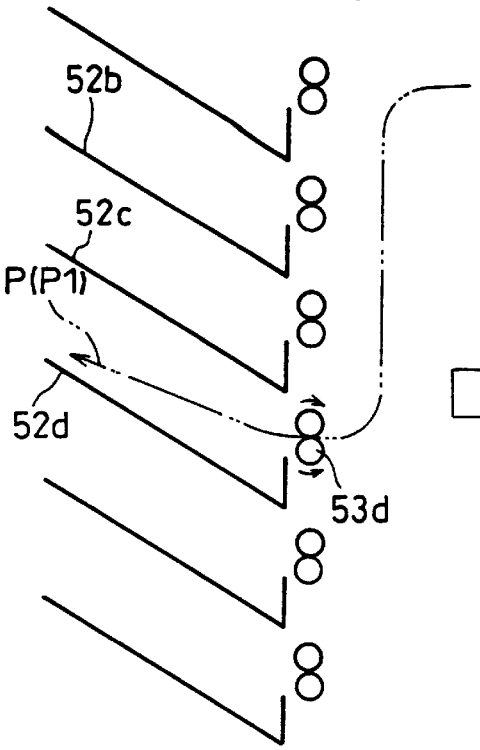
FIGS. 16(*a*) to 16(*d*) are explanatory views showing an example of the operation of the reverse discharge processing according to another embodiment of the sheet discharging apparatus of the present invention.
Figure 16B:
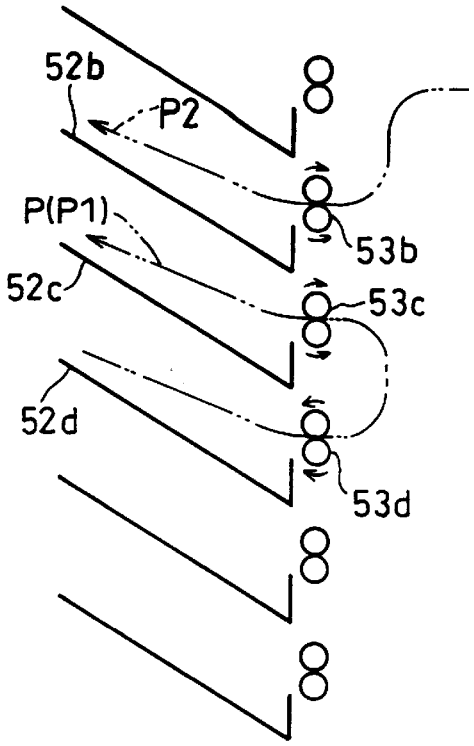
Figure 16C:
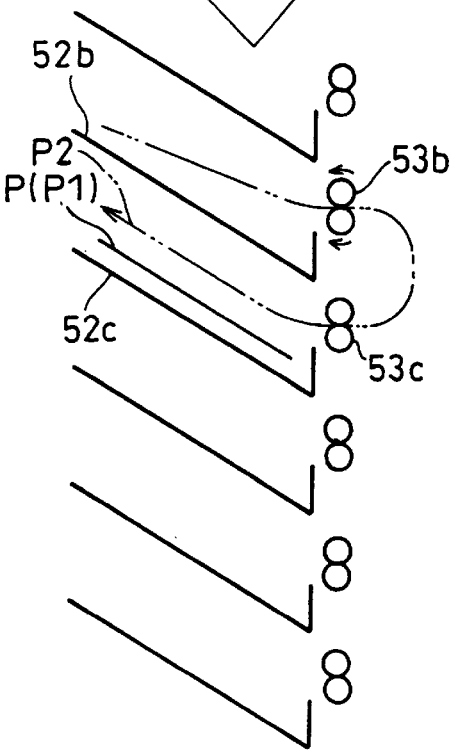
Figure 16D:
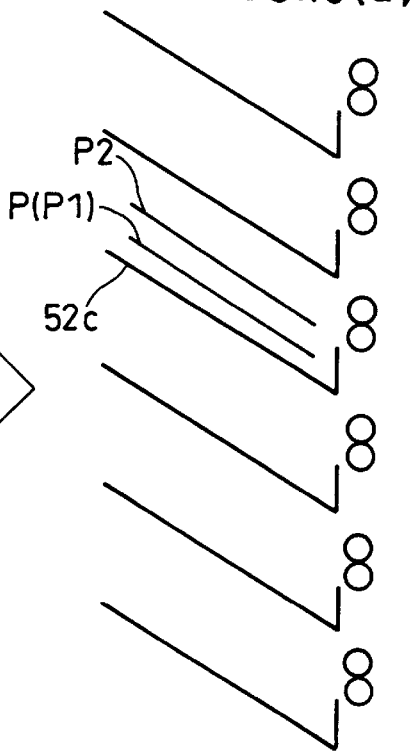

FIG. 15 shows the flow chart for controlling the above-mentioned processing. According to FIG. 15, in step n31, the lowest tray 52*f* is selected, and the tray number "$N_1$" is stored. In order to feed the sheet P output from the copying machine main body 1 to the first tray 52*a* on the highest level, the counted value N in the tray specifying counter is set to "1" (step n32). The sheet P1 output from the copying machine main body 1 is first detected by the sensor SO (step n33), and a state for receiving the sheet P1 by the specified first tray 52*a* is produced (step n34).

At the time the sheet P1 is fed to the specified first tray 52*a* and the trailing end thereof is detected by the sensor S1 in step n35, the forward rotations of the discharge rollers 53*a* are stopped (step n36). Subsequently, in order to feed the sheet P2 to be output next to the second tray 52*b* on the next level, the counted value N in the tray specifying counter is counted up to N+1 (step n37). Then, it is confirmed whether the output operation of the copying machine main body 1 has been completed or not (step n38).

Here, if the output operation has not been completed, it is confirmed whether the counted value N in the tray specifying counter specifies the lowest tray 52*f* (tray number "6") or not (step n39). If the lowest tray 52*f* is not specified, the processes in n33 to n37 are repeated to feed the sheets P sequentially to the specified trays, respectively, and keep the sheets P on standby for the reverse discharge processing.

When the lowest tray 52*f* is specified in step n39, since the lowest tray 52*f* is selected for a tray to which the sheets P are finally discharged, a standby state in which the sheets P have been fed to all of the trays except the lowest tray 52*f* is achieved. Therefore, in order to perform the reverse discharge processing for the sheet P1 in the first tray 52*a* on the highest level, the first tray 52*a* is specified (step n41). In this case, a destination tray specifying counter is separately provided for the reverse discharge processing, and 1 is set as the counted value $N_E$ of the destination tray specifying counter. At the same time, in order to specify the first tray 52*a* on the highest level for a tray to which the sheet P6 output from the copying machine main body 1 is fed, the counted value N in the tray specifying counter is set to 1. The tray specifying counter and the destination tray specifying counter correspond to the tray specifying means recited in the claims. Next, the discharge rollers 53*a* corresponding to the first tray 52*a* on the highest level specified by the counted value $N_E$ are rotated in the reverse direction (step n42). Before these processes, in step n40, the copying machine main body 1 is informed that there is no tray to which the next sheet P6 output from the copying machine main body 1 can be fed. Namely, when feeding the sheet P to the fifth tray 52*e*, the copying machine main body 1 is informed that there is no tray to which the next sheet P6 can be fed. For example, the information in step n40 is transmitted from the sorter control unit 46 to the central processing unit 44. Consequently, after the completion of the output of the sheet P5 to be fed to the fifth tray 52*e*, the copying machine main body 1 performs processing so that the interval between the sheet P6 and the sheet P5 is increased.

In step n43, the completion of the reverse discharge processing in the highest first tray 52*a* is confirmed upon the detection of the trailing end of the sheet P1 by the sensor S1. Then, the counted value $N_E$ in the destination tray specifying counter is counted up to "$N_E$+1" so as to specify a tray in which the reverse discharge processing is performed next (step n44). The copying machine main body 1 is instructed to restore the output operation of the copying machine main body 1 to the original state in accordance with this timing. Then, in step n45, it is confirmed whether the counted value $N_E$ of the destination tray specifying counter specifies the lowest tray 52*f*. If the lowest tray 52*f* is not specified, the control operation returns to step n42, and the reverse discharge processing is executed sequentially for the sheet P which is kept on standby in the tray specified by the counted value $N_E$ in the destination tray specifying counter.

In this case, if the lowest tray 52*f* is specified in step n42, it is confirmed whether the succeeding sheet P6 is present in the first tray 52*a* on the highest level. If the sheet P6 is present, the control operation returns to step n41, and the above-mentioned processes are carried out. On the other hand, if the sheet P6 is not present, the control operation moves to the standby routine. Moreover, in step n45, there is a case where it is confirmed not only whether the counted value $N_E$ specifies the lowest tray 52*f,* but also whether the sheet P to be reverse-transported is absent, and then the control operation moves to the standby routine.

Additionally, in step n43, when the trailing end of the sheet P1 is detected, the first tray 52*a* on the highest level becomes empty. Namely, the sheet P1 is not present in the first tray 52*a* due to the reverse discharge processing. At this time, in order to receive the sheet P6, the first tray 52*a* is specified by the tray specifying counter as described above. Therefore, the control operation returns to step n33 to feed the sheet P6 output from the copying machine main body 1 to the first tray 52*a*. As a result, the feeding of the sheet P in step n33 and the reverse discharge processing for the sheet P in step n42 are performed simultaneously.

In FIG. 15, the broken line running from the output of step n44 to the output of step n39 means that the feeding of the sheet P in steps n33 to n39 and the reverse discharge processing in steps n44 and n45 are performed simultaneously.

When the completion of the output operation of the copying machine main body 1 is confirmed in step n38 during the feeding of the sheet P, the reverse discharge processing is performed only for the sheet P which has already been fed to the corresponding tray. Therefore, the control operation moves to step n46. In step 46, if the counted value $N_E$ in the destination tray specifying counter is set for the reverse discharge operation in steps n42 to n45, a tray is specified according to the counted value $N_E$. On the other hand, when the output operation of the copying machine main body 1 is completed before or at the time the sheets P are fed to the trays other than the lowest tray 52*f,* the destination tray specifying counter specifies "1". In either case, the reverse discharge processing is carried out in a tray specified by the counted value $N_E$ in the destination tray specifying counter (step n47), and the completion of the processing is detected by one of the sensors (S1 to S5) (step n48). Then, the counted value $N_E$ in the destination tray specifying counter is counted up (step n49). Subsequently, it is confirmed whether all of the sheets P kept on standby for the reverse discharge processing have been discharged (step n50). When the processes in steps n47 to n50 are repeatedly executed to complete the reverse discharge processing for all of the sheets P, the control operation moves to the standby routine for the reverse discharge processing for the next sheet P.

As explained above, the lowest tray is selected for a tray for finally receiving the sheets P discharged in a state in which the sheets P are turned over, and then the sheets P are fed to the respective trays in sequence from the highest tray among the remaining trays. When the feeding of the sheets P is completed, the reverse discharge processing is performed for the sheets P in the respective trays from the highest tray. When the reverse discharge processing in the highest tray is completed, the reverse discharge processing in the next tray and the feeding of the sheet P to the highest tray can be performed simultaneously. By repeating these processes, the processing can be performed without increasing the transport intervals between the sheets P, thereby shortening the time taken for the reverse discharge processing. Moreover, since the number of the sheets P to be output is not restricted by the number of the bins in the sorter, the discharge processing to be performed after reversing the sheets P and the feeding of the sheets P output from the copying machine main body 1 can be executed very efficiently.

Additionally, it is possible to perform another mode by adopting the embodiment shown in FIGS. 10(*a*) and 10(*b*) into the embodiment shown in FIGS. 14(*a*) to 14(*c*). More specifically, at the time the feeding of the sheets P to all of the trays except the lowest tray 52*f* is completed, the reverse discharge of the sheet P to the lowest tray 52*a* can be started from the fifth tray 52*e,* and then the next sheet P can be fed to the fifth tray 52*e* after completing the reverse discharge processing in all of the trays except the lowest tray 52*f.* In this mode, the same processing as that shown in FIGS. 14(*a*) to 14(*c*) is performed with the exception that the order of feeding the sheets P output from the copying machine main body 1 to the trays is opposite to that of FIGS. 14(*a*) to 14(*c*).

In this case, immediately after starting the reverse discharge processing in a tray, if the feeding of the sheet P to the tray is started, the processing efficiency is improved.

Reverse Discharge Processing IV

The above-mentioned embodiment explains the reverse discharge processing particularly when the highest tray or the lowest tray is specified for a tray to which the sheets P are finally discharged. In addition to the above-mentioned embodiment, the following description will explain an embodiment in which a tray located between the highest and lowest trays (hereinafter referred to as the "intermediate tray") is selected for the tray to which the sheets P are finally discharged.

This embodiment is particularly effective for the case where the number of trays to which the sheets P are discharged is limited to a small number, and can simplify the control of the gates, transport rollers, discharge rollers, etc. for guiding the sheets P to the trays.

The idea of this processing is to carry out the reverse discharge processing and the feeding of the sheet P simultaneously by (1) the use of the intermediate tray as the tray to which the sheets P are finally discharged, and (2) the use of the trays above and below the intermediate tray as the trays for the inverse discharge processing as well as the trays for receiving and keeping the sheets P on standby before the inverse-transport.

FIGS. 16(*a*) to 16(*d*) are explanatory views for showing the operation states of the processing, and particularly showing the processing steps when the third tray 52*c* is selected for the intermediate tray to which the sheets P are finally discharged, and trays located above and below the third tray 52*c,* particularly the fourth tray 52*d* and the second tray 52*b* located in the closest positions on the downstream side and the upstream side of transport path of the sheets P, are selected for temporary trays.

As illustrated in FIG. 16(*a*), first the sheet P1 to be the first page is controlled to be fed to the fourth tray 52*d* and stopped in a state in which the trailing end of the sheet P1 is caught between the discharge rollers 53*d.* Then, as illustrated in FIG. 16(*b*), the next sheet P2 to be the second page is fed to a tray located on the upstream side with respect to the third tray 52*c,* i.e., the second tray 52*b* on the higher level. At this time, the sheet P1 which is stopped in the state of being fed to the fourth tray 52*d* is reverse-transported by the reverse rotations of the discharge rollers 53*d*. It is thus possible to perform the reverse discharge processing for the first page and the feeding of the sheet P2 as the second page at substantially the same time.

Then, as illustrated in FIG. 16(*c*), the reverse discharge processing for the sheet P2 to be the second page are successively performed after the completion of the reverse discharge processing for the sheet P1, and the next sheet P3 to be the third page is fed to the fourth tray 52*d* at the time the reverse discharge processing for the sheet P2 is completed. Thus, by alternately performing the reverse discharge processing and the feeding, the processing speed can be improved without increasing the transport intervals of the sheets P.

More particularly, the sheet P with an odd page number is fed to the fourth tray 52*d* which is closest to the third tray 52*c* on the downstream side, while the sheet P with an odd page number is f ed to the second tray 52*b* which is closest to the third tray 52*c* on the upstream side. This operation can be performed in the opposite way. However, when feeding the sheet P with an odd page number to a tray on the upstream side, it is necessary to feed the sheet P with an even page number to a tray on the downstream side. Namely, after feeding the sheet P with an odd page number to the second tray 52*b* and the sheet P with an even page number to the fourth tray 52*d* on the downstream side, it is necessary to execute the reverse discharge processing for the sheet P on the upstream side. As a result, the reverse discharge processing is delayed.

However, the reverse discharge processing for the sheet P with an odd page number is only delayed at the beginning, and thereafter the processing is performed in the same manner as in the operations shown in FIGS. 16(*a*) to 16(*d*). Specifically, when the feeding of the sheet P with an even page number is completed, the reverse discharge processing for the sheet P with an odd number is performed on the upstream side. Subsequently, the reverse discharge processing for the sheet P with an even page number on the downstream side and the next feeding of the sheet P with an even page number on the upstream side are carried out simultaneously.

Figure 17:
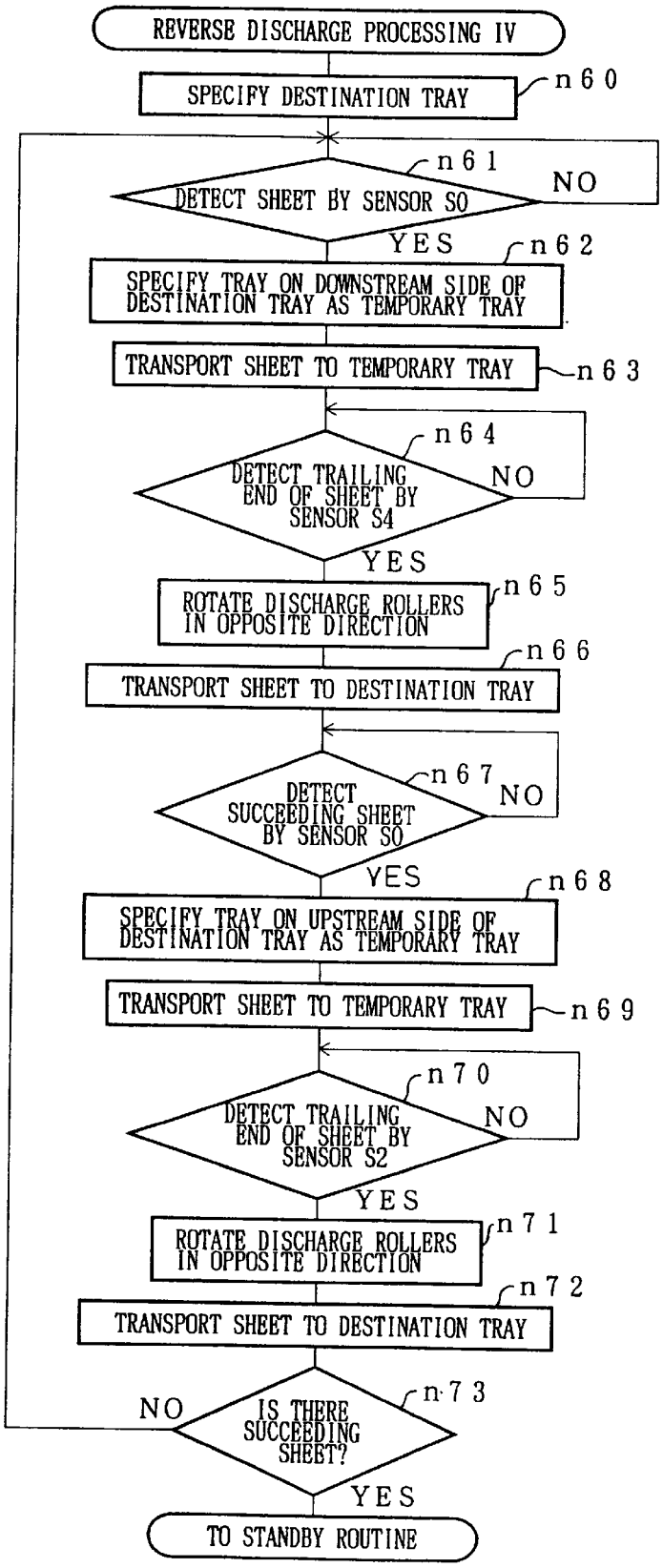
FIG. 17 is a flow chart showing control steps for achieving the operation of the reverse discharge processing shown in FIGS. 16(*a*) to 16(*d*).

FIG. 17 shows a flow chart showing the steps of controlling the discharge processing for the sheets P shown in FIGS. 16(*a*) to 16(*d*). First, in step n60, a selected tray (third tray 52*c*) to be the tray to which the sheets P are finally discharged is specified. When the sheet P is output from the copying machine main body 1, the sensor S0 detects the sheet P (step n61). Subsequently, a lower tray (fourth tray 52*d*) on the downstream side with respect to the selected tray is specified for the temporary tray (step n62), and the sheet P is fed to the lower tray (step n63).

When the trailing end of the sheet P fed to the lower tray is detected by the sensor (S4) (step n64), the feeding operation is stopped. Namely, the operation of the discharge rollers (53*d*) is stopped, and the rotating direction thereof is reversed (step n65). As a result, the reverse discharge processing toward the selected tray (third tray 52*c*) is carried out (step n66) , and simultaneously the control operation moves to step n67 for detecting the next sheet P by the sensor S0.

At this time, if the image processing in the copying machine main body 1 is completed, the control operation moves to the standby routine. On the other hand, if the image processing is not completed, the transport of the next sheet P is waited in step n67. When the next sheet P is transported, the higher tray (second tray 52*b*) on the upstream side with respect to the selected tray is specified for a temporary tray (step n68), and the feeding of the sheet P to the higher tray (second tray 52*b*) is executed (step n69), and then it is confirmed whether the trailing end of the sheet P is detected by a sensor (S2) corresponding to the higher tray (step n70). Namely, it is confirmed weather the sheet P has been received by the higher tray (second tray 52*b*) and whether the sheet P is in the standby state for the reverse-transport.

When the confirmation is made, the control operation moves to step 71, and the discharge rollers (53*b*) corresponding to the higher tray (second tray 52*b*) are paused and immediately rotated in the reverse direction so as to execute the reverse discharge processing. As a result, the next sheet P which has been turned over is discharged onto the sheet P which was previously discharged after being turned over onto the selected tray (third tray 52*c*) (step n72), and thus the sheets P are discharged in page order. After the discharge processing, it is confirmed whether there is a succeeding sheet P (step n73). If there is no sheet P, the control operation moves to the standby routine. On the other hand, if there is a sheet P, the control operation moves to step n61 so as to repeat the above-mentioned processes.

It is therefore possible to efficiently perform the reverse discharge processing using a small number of trays. Namely, if at least three trays are present, the processing of this embodiment is executable. Thus, compared to the use of all the trays, the limited section is effectively used for the reverse discharge processing, thereby decreasing the burden of controlling the switching of, for example, the trays to which the sheets P are to be fed. Then, the burden of the controlling means can be decreased eventually.

Another Embodiment of Reverse Discharge Processing IV

The reverse discharge processing can be performed as explained below based on the above-mentioned basic processing. More particularly, the reverse discharge processing is executed by dividing the trays into two groups and respectively managing the groups of the trays. One of the groups includes all the trays on the upstream side with respect to the tray to which the sheets P are finally discharged, and the other group includes all the trays on the downstream side.

For example, the third tray 52*c* is specified for the selected tray, and the remaining trays are divided into two groups: a group of the fourth tray 52*d* to the sixth tray 52*f* on the downstream side with respect to the third tray 52*c*, and a group of the first tray 52*a* and the second tray 52*b* on the upstream side. The two groups of trays are respectively managed and controlled so that, when the feeding operation (receiving operation) is performed with respect to one group of trays, the reverse discharge processing is executed to the other group of trays. It is thus possible to perform the discharging operation efficiently like in the above-explained embodiment.

Figures 18A, 18B, 18C, 18D:
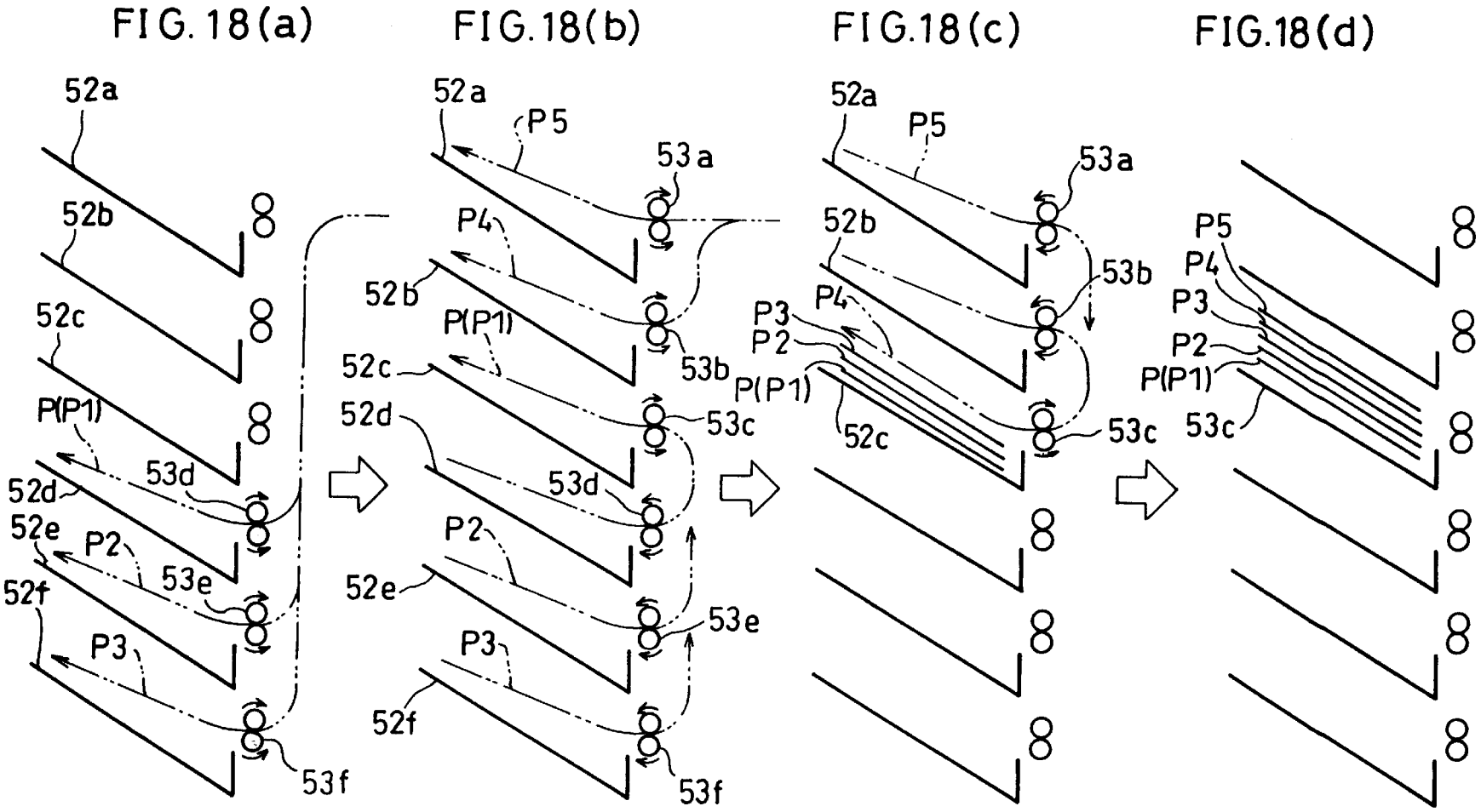
FIGS. 18(*a*) to 18(*d*) are explanatory views showing an example of the operation of another reverse discharge processing which is based on the reverse discharge processing shown in FIGS. 16(*a*) to 16(*d*).
Figure 19:
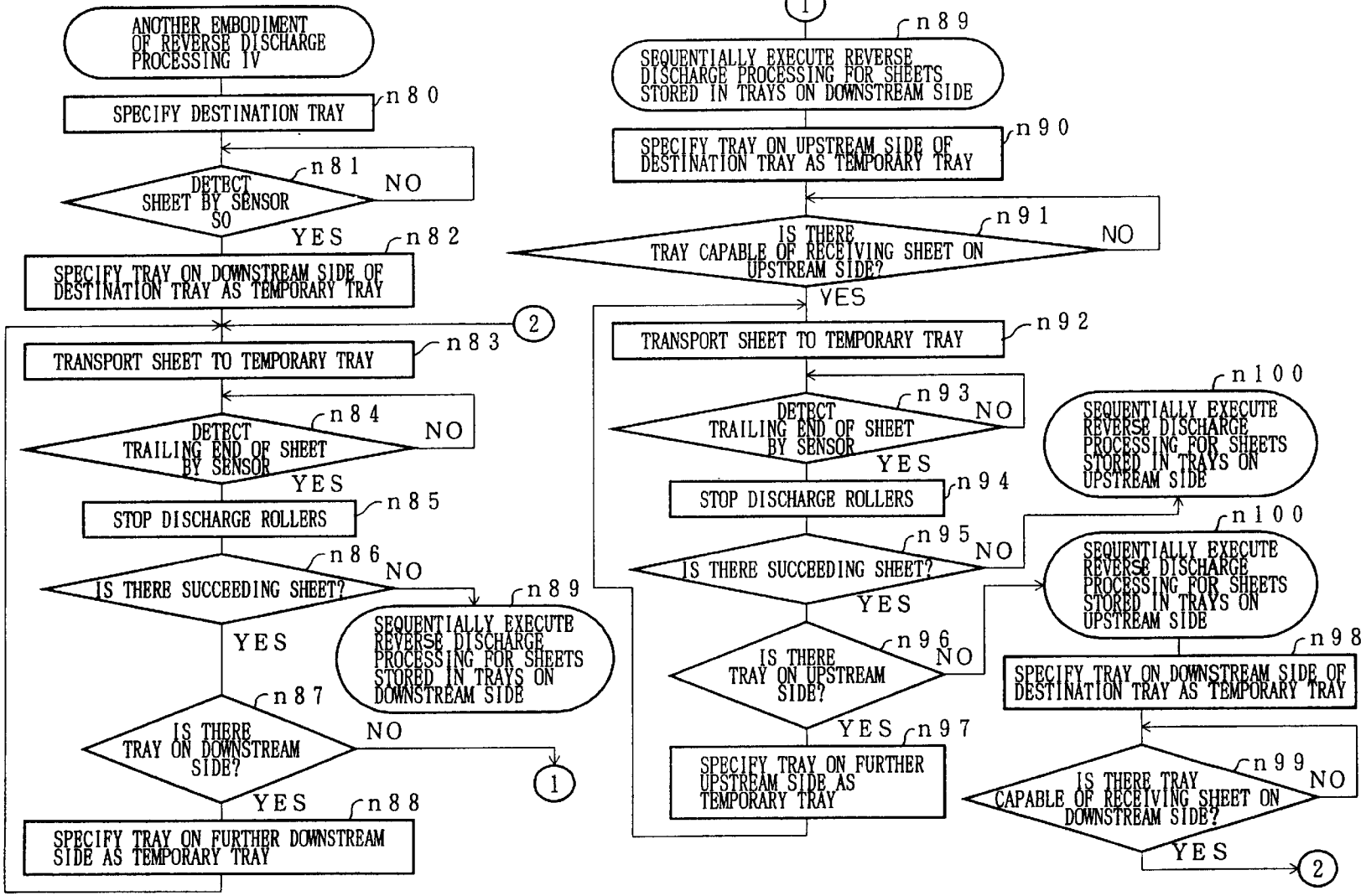
FIGS. 19 is a flow chart showing control steps for achieving the operation of the reverse discharge processing shown in FIGS. 18(*a*) to 18(*d*).

FIGS. 18(*a*) to 18(*d*) are views for showing the steps of controlling the discharging operation. FIG. 19 shows the flow chart for executing the control. First, as shown in FIGS. 18(*a*) to 18(*d*), the third tray 52*c* is specified for the selected tray. The sheets P1 to P3 output from the copying machine main body 1 are fed in page order to the group of trays on the downstream side with respect to the third tray 52*c*. When the sheets P1 to P3 are all fed to the group of trays on the downstream side, the reverse discharge processing is executed for the sheets P1 to P3 as shown in FIG. 18 (*b*). At this time, the feeding of the succeeding sheets P4 and P5 in page order to the group of trays on the upstream side is simultaneously carried out.

When the feeding operation on the upstream side is completed, the reverse discharge processing is executed for the sheets P4 and P5 as shown in FIG. 18(*c*). Thus, the succeeding sheets P4 and P5 are reversed and discharged over the previously discharged sheets P1 to P3. Hence, the sheets P1 to P5 are placed in page order on the third tray 52*c* as shown in FIG. 18(*d*). By repeating this operation from the beginning, the reverse discharge processing can be performed efficiently.

Referring now to FIG. 19, the following description will explain the control operation in detail. The processes in steps n80 to n85 are the same as steps n60 to n65 shown in FIG. 17 described above. However, in step n85, only the discharge rollers 53*d* are stopped.

Figure 20:
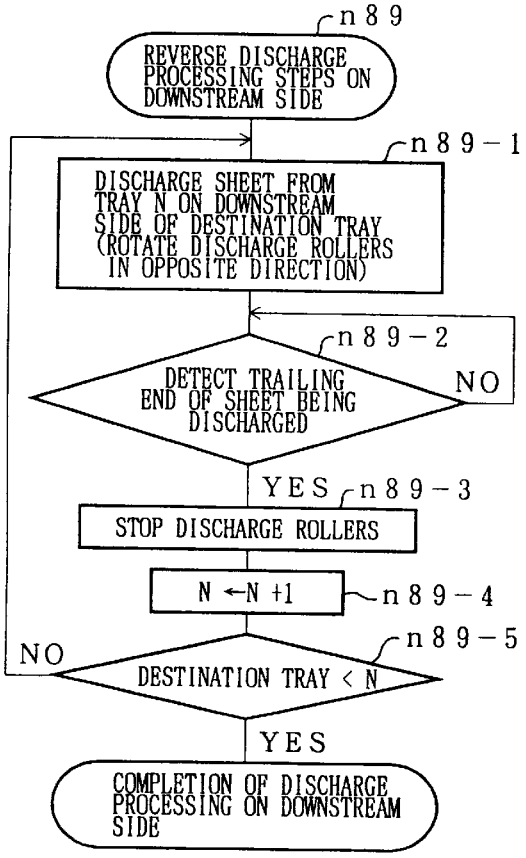
FIG. 20(*a*) is a flow chart showing control steps for achieving the reverse discharge processing on the downstream side in the reverse discharge processing shown in FIG. 19, and FIG. 20(*b*) is a flow chart showing control steps for achieving the reverse discharge processing on the upstream side in the reverse discharge processing shown in FIG. 19.
Figure 20:
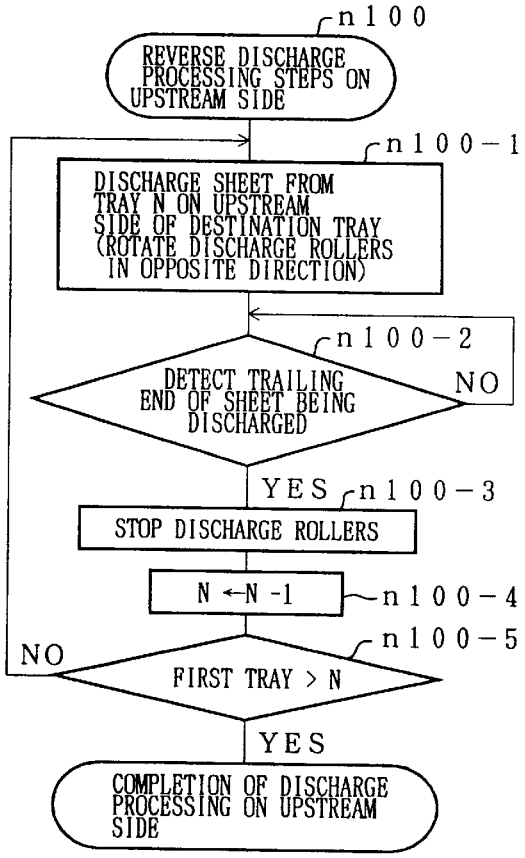

In the next step, n86, it is confirmed whether there is a succeeding sheet P. If there is a sheet P, it is confirmed whether there is a tray on the downstream side to which the sheet P can be fed (step n87). If the presence of the tray to which the sheet P can be fed is confirmed, the tray is specified for the temporary tray (step n88), and the control operation returns to step n83 to perform the same processing as above. On the other hand, if there is no succeeding sheet P in step n86, the reverse discharge processing is respectively performed in the fourth tray 52*d* to the lowest tray 52*f* located on the downstream side with respect to the third tray 52*c* (step n89). The detail of the reverse discharge processing is shown in FIG. 20.

On the other hand, if there is no more trays on the downstream side to which the sheets can be fed in step n87, the control operation moves to a control routine for feeding the sheets P to the trays on the upstream side. Therefore, first, the reverse discharge processing is performed for the sheets P which have been fed to the trays on the downstream side (step n89). This processing is controlled as shown in FIG. 20, and will be explained in detail later. Subsequently, the processes in steps n90 to n94 are carried out. In these steps, the same processes as in steps n68 to n71 shown in FIG. 17 are performed. In this case, in step n91, the absence of the sheets P and the receiving state that allows the feeding of the sheets P are confirmed in the first tray 52*a* and the second tray 52*b* on the upstream side with respect to the third tray 52*c*. Moreover, in step n94, only the forward rotations of the respective discharge rollers are stopped.

Then, when the feeding of the sheet P to the second tray 52*b* on the upstream side (step n92) is completed, i.e., the trailing end of the sheet P is detected by the sensor S2 in step n93, it is confirmed whether there is a succeeding sheet P (step n95). If there is a succeeding sheet P, it is confirmed whether there is a tray on the upstream side to which the sheet P can be fed (step n96). If the presence of a tray is confirmed, the first tray 52*a* on the further upstream side is specified for the temporary tray (step n97). Then, the control operation returns to step n92, and the above-mentioned processes are repeated. If there is no succeeding sheet P in step n95, the reverse discharge processing is performed for the sheets P fed to the trays on the upstream side (step n97). Additionally, if there is no more trays for receiving the sheets P in n96, the reverse discharge processing is executed in the same manner as above for the sheets P which have been fed to and on standby in the trays on the upstream side (step n100).

Simultaneously the trays on the downstream side with respect to the third tray 52*c* are specified for the temporary trays (step n98), and it is confirmed whether the trays on the downstream side are ready for receiving the sheets P (step n99). At this time, if the previous reverse discharge processing in the trays on the downstream side has been completed, it is determined that the trays on the downstream side are ready for receiving the sheets P.

Referring now to FIG. 20, the following description will explain the control steps in n89 and n100 for reverse-discharging the sheets P.

The flow chart shown in FIG. 20(*a*) relates to the reverse discharge processing for the sheets P which have been fed to and kept on standby in the trays on the downstream side with respect to the third tray 52*c*, and more particularly relates to the detail process in step 89. First, in step n89-1, the reverse discharge processing of the sheet P from the fourth tray 52*d* near the third tray 52*c* on the downstream side toward the third tray 52*c* is performed. At this time, the discharge rollers 53*d* corresponding to the fourth tray 52*d* are rotated in reverse direction. At the time the corresponding sensor S4 detects the leading end of the sheet P, more particularly the trailing end thereof when the sheet P is reverse-transported (step n89-2), the rotations of the discharge rollers 53*d* are stopped (step n89-3). Subsequently, in order to specify the next fifth tray 52*e*, the counted value in the tray specifying counter is increased to "N+1" (step n89-4). At this time it is confirmed whether the newly specified tray is the lowest tray 52*f* or not (step n89-5). If the counted value in the tray specifying counter is not greater than the value of the lowest tray, the above-mentioned processes are repeated. When a tray whose value is grater than the value of the lowest tray 52*f* is specified, the reverse discharge processing on the downstream side is completed.

The flow chart shown in FIG. 20(*b*) relates to the reverse discharge processing for the sheets P which have been fed to and kept on standby in the trays on the upstream side with respect to the third tray 52*c*, and more particularly relates to the detail process in step n100. First, in step n100-1, the reverse discharge processing of the sheet P from the second tray 52*b* near the third tray 52*c* on the upstream side to the third tray 52*c* is performed. At this time, the discharge rollers 53*b* corresponding to the second tray 52*b* are rotated in reverse direction. Then, at the time the corresponding sensor S2 detects the leading end of the sheet P, more particularly the trailing end thereof when the sheet P is reverse-transported (step n100-2), the rotations of the discharge rollers 53*b* are stopped (step n100-3). Subsequently, in order to specify the next first tray 52*a*, the counted value in the tray specifying counter is decreased to "N−1" (step n100-4). At this time it is confirmed whether the newly specified tray is the first tray 52*a* on the highest level or not (step n100-5). If the counted value in the tray specifying counter is not smaller than the value of the highest tray, the above-mentioned processes are repeated. When a tray whose value is smaller than the value of the first tray 52*a* on the highest level is specified, the reverse discharge processing on the upstream side is completed.

By performing the reverse discharge processing in the manner mentioned above, the receiving of the sheet P and the reverse discharge processing of the sheet P can be performed simultaneously, thereby improving the processing efficiency.

In addition to the reverse discharge processing according to the above-explained embodiments, it is possible to select processing in which the sheet P is discharged as it is to the retransport path 38 in the copying machine main body 1 through the sheet discharging apparatus 5 as shown in FIG.

Figure 21:
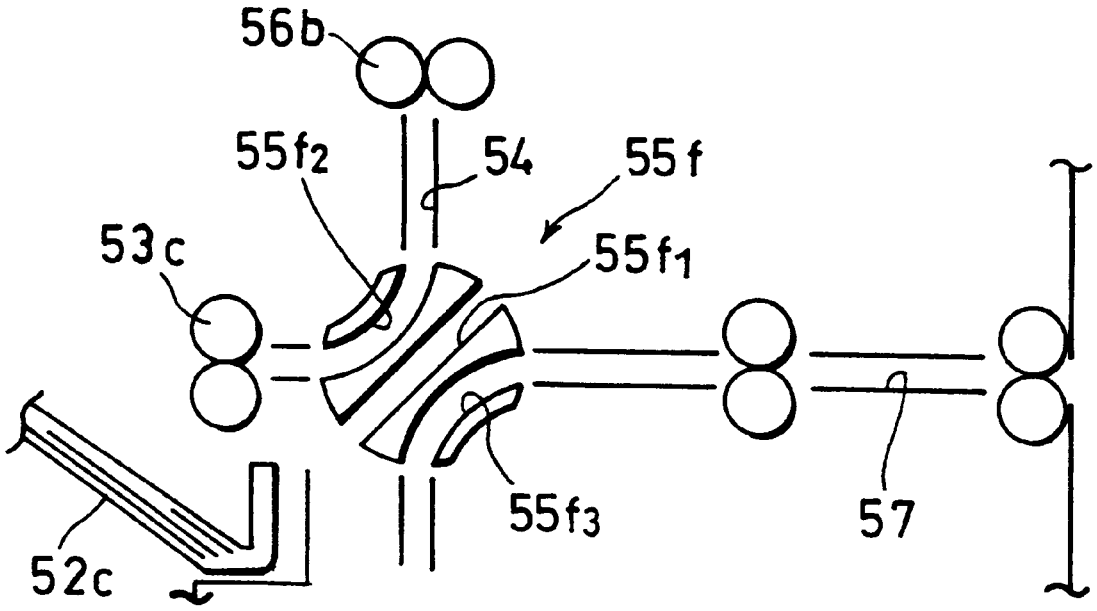
FIG. 21 is an explanatory view showing an example of a gate for achieving the switching of the sheet transport direction for feeding the sheet back to a retransport path in the digital copying machine main body when forming an image on the sheet again in the sheet discharging apparatus of the present invention.

2. For this processing, FIG. 21 shows a specific structure where the second transport path 54 and the retransport path 38 are connected and the gate 55*f* is positioned at the branch point of the paths 38 and 54. The branch point of the paths 38 and 54 is an intersection like a crossroads.

The gate 55*f* is rotatable, and includes a straight guide path 55$f_1$, and two curved guide paths 55$f_2$ and 55$f_3$ which are formed symmetrically with the straight guide path 55$f_1$ therebetween. If the straight path 55$f_1$ is connected to the second transport path 54, the sheet P is guided along the second transport path 54. In the state shown in FIG. 21, the curved guide path 55$f_2$ connects the second transport path 54 and the third tray 52*c* on the upstream side in the transport direction of the sheet P, while the curved guide path 55$f_3$ connects the second transport path 54 and the retransport path 38 on the downstream side.

Moreover, if the gate 55*f* is turned at 90° in either direction from the state shown in FIG. 21, the gate 55*f* connects the second transport path 54 and the retransport path 38 on the upstream side, and connects the third tray 52*c* and the second transport path 54 on the downstream side. Thus, the sheet P can be guided to either the paths.

Hence, when the gate 55*f* is turned at 90° in either direction from the state shown in FIG. 21, the sheet P transported along the second transport path 54 can be transported as it is to the retransport path 38. Furthermore, in the state shown in FIG. 21, the sheet P is fed temporarily to the third tray 52*c* and stopped in a state in which the trailing end thereof is caught between the discharge rollers 53*c*, and then the straight guide path 55$f_1$ is turned clockwise at 45° to connect the third tray 52*c* and the retransport path 38. This arrangement enables the sheet P which has been turned over to be discharged to the retransport path 38. This processing is available not only in the third tray 52*c*, but also in any of the other trays if the turning angle of the gate 55*f* is switched appropriately. Additionally, since another sheet P to be reverse-transported can be fed to the other tray during the reverse transport of the previous sheet P to the retransport path 38, the reverse transport to the copying machine main body 1 can be efficiently performed in succession.

Control of Discharge in Fax Mode or Printer Mode: Second Embodiment

In the digital copying machine as an image forming apparatus, there are two output modes for outputting a hard copy corresponding to the image on a document and outputting a hard copy corresponding to image data transmitted from an external device. In one output mode, a plurality of hard copies of an image are repeatedly and successively output in the above-mentioned sorting mode. The other output mode is operated in the grouping mode in which a set of hard copies of a set of documents including images on different pages are successively output in page order, and this set of output operations are repeated several times. In the explanation below, the output processing in the sorting mode is called the "sorted output", while the output processing in the grouping mode is called the "grouped output".

In other words, in the grouping mode, the sheets P carrying images formed thereon are successively output as the hard copies in page order. Therefore, by successively discharging a set of hard copies onto a single tray, it is possible to obtain a bunch of sheets P arranged in page order.

On the other hand, in the sorting mode, a specified pieces of the same page are output as hard copies corresponding to the image data. Therefore, by selecting the number of trays corresponding to the specified number of the hard copies, it is possible to obtain a bunch of sheets P arranged in page order on each of the trays.

Here, when the copying machine main body 1 performs the output operation according to the facsimile mode or the printer mode, the sheet P to be output in the above-mentioned manner needs to be discharged in a reversed state in which the front and back sides of the sheet P are reversed. Therefore, in the present invention, the trays except the selected tray to which the sheets P are finally discharged are automatically specified for the temporary trays for use in the reverse discharge processing. It is thus possible to perform the reverse discharge processing for the sheets P without additionally providing a special reverse discharging mechanism (switchback mechanism), thereby reducing the size of the apparatus.

Moreover, in order to sort or group the output sheets P, if any one of the trays is specified for the selected tray, temporary trays other than the selected tray are automatically specified for use in the reverse discharge processing. In addition, if the tray near the selected tray is used as the temporary tray without fixing a certain tray for the temporary trays, it is possible to improve the processing efficiency and increase the processing speed.

Reverse Discharge Processing V

Figure 22:
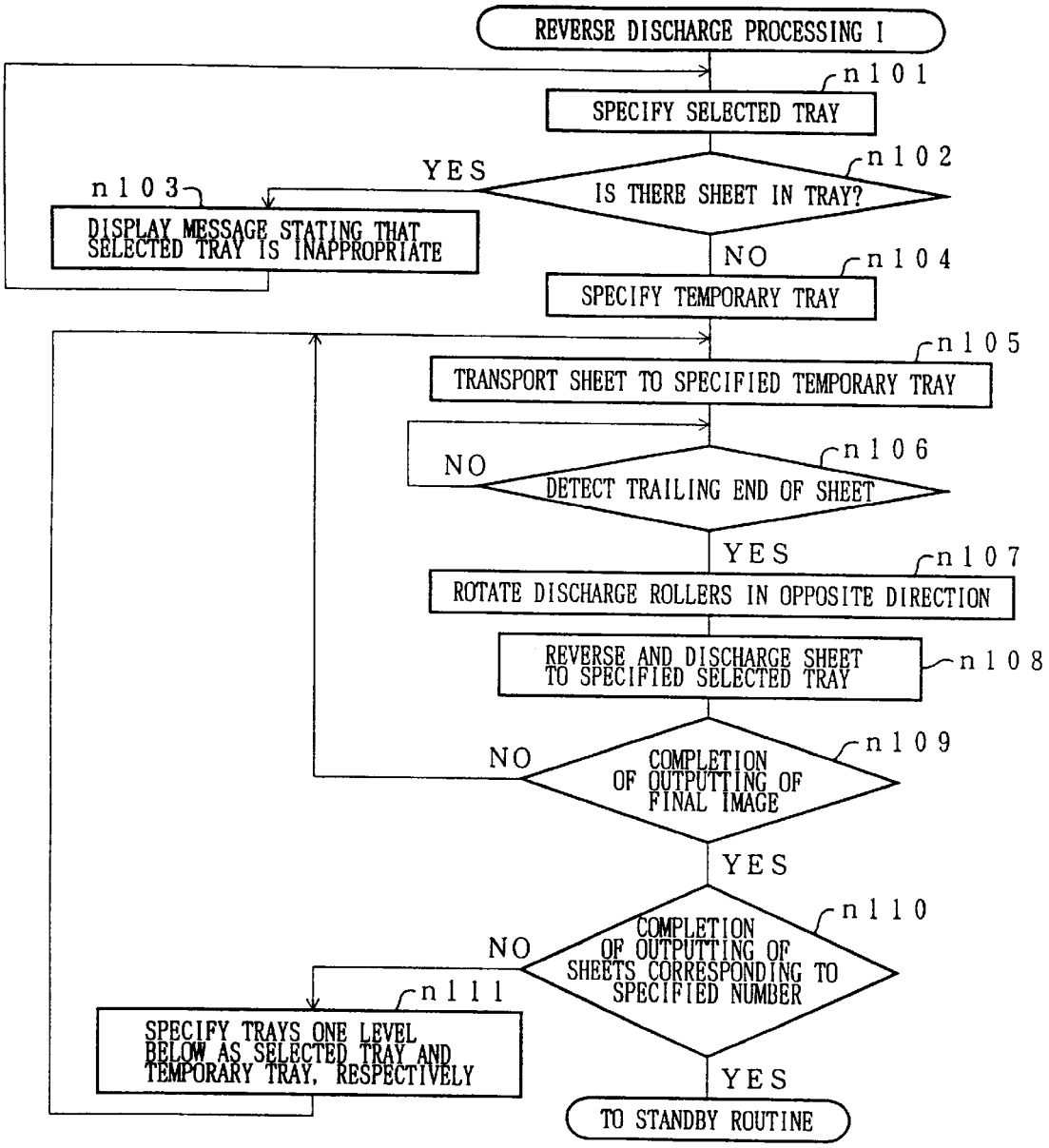
FIG. 22 is a flow chart showing the control steps for the reverse discharge processing according to a still another embodiment of the sheet discharging apparatus of the present invention.

Reverse discharge processing V will be explained with reference to the flow chart shown in FIG. 22. This processing is control of the discharge in the grouping mode, and causes the copying machine main body 1 to output a group of the sheets P at a time.

When the copying machine main body 1 outputs a hard copy after performing image processing using image data transmitted from an external device, the whole pages of the image data are output as sheets of hard copies page by page. The sheets P output by the grouping mode are sent to the sheet discharging apparatus 5 from the copying machine main body 1. At this time, the sorter control unit 46 executes control for (reversing) turning over the sheets P as shown in FIG. 22.

Figure 24:
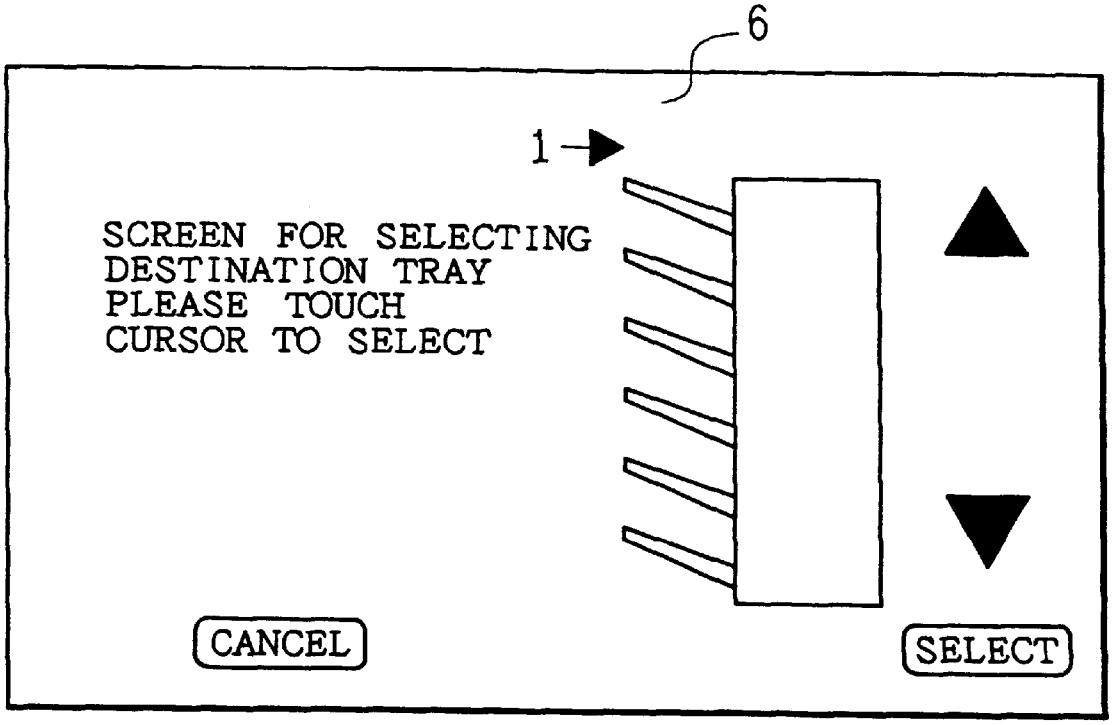
FIG. 24 is an explanatory view showing an example of a display showing which tray is specified for a selected tray on an operation panel when specifying a selected tray which finally receives sheets turned over by the reverse discharge processing of the present invention.

Before this process, an operator can specify an arbitrary tray for the selected tray. Therefore, for example, as shown in FIG. 24, a tray selecting screen is displayed on the touch panel liquid crystal display device 6 by operating the post-processing-mode selecting key 24 on the operation panel (operation panel unit) 45 explained in FIG. 5.

When such a selection is made before performing the grouped output, the routine in step n101 is skipped, and then it is confirmed whether there is a sheet P in the arbitrarily specified selected tray in step n102. This confirmation is made using known sheet detection sensors (micro switches, etc., not shown) provided for the trays 52*a* to 52*f*, respectively. Consequently, the sorter control unit 46 can confirm whether the sheet P is present or not.

If the sheet P is present in the selected tray, a message stating that the selected tray is inappropriate is displayed (step n103), and the control operation returns to step n101 again so as to specify another tray for the selected tray. Here, the tray to which the sheets P are finally discharged is selected according to the displayed instruction shown in FIG. 24 as explained above. In FIG. 24, the schematic view of the sheet discharging apparatus 5 including the trays 52*a* to 52*f* is displayed on the liquid crystal display device 6, and upward and downward arrow keys (triangular symbols) for selecting an arbitrary tray are displayed at the right of the screen. Moreover, an arrow indicating the selected tray as well as the tray number are displayed at the left of the schematic view of the sheet discharging apparatus 5. The arrow indicating the tray is moved up or down together with the tray number according to the operation of the arrow keys. When a tray is selected by the operator, the tray is specified (determined) for the tray to which the sheets P are finally discharged by operating a select key displayed at the bottom right of the screen.

As described above, in step n102, when the presence of the sheet P in the selected tray is confirmed, if the message stating that the selected tray is inappropriate is displayed on the display device 6 so as to inform the operator of this fact, the operation of specifying the selected tray is simplified. Alternatively, by arranging a tray containing the sheet P to be skipped and not to be specified even when the arrow key is operated for selecting an arbitrary tray, the specifying operation is simplified.

The reason for preventing a tray containing the sheet P from being specified for the selected tray is to avoid the mixture of the sheet P which has undergone the discharge processing and the sheet P which is to be discharged from now so as to ease the operation to be performed by the operator after the discharge processing.

When an appropriate tray is specified for the selected tray as described above, the sorter control unit 46 automatically selects a temporary tray for use in the reverse discharge processing. The remaining trays other than the selected tray are subjected to the automatic selection. Thus, the sorter control unit 46 specifies a tray containing no sheet P or specifies a higher or lower tray nearest to the selected tray for the temporary tray.

When the temporary tray is selected (step n104), the sheet P having an image formed thereon output from the copying machine main body 1 is fed to the automatically selected temporary tray under control (step n105). At this time, the rotating direction and the switching position of the gate set 55, the discharge roller set 53, etc. are controlled so as to produce a state in which the sheet P can be fed to the temporary tray.

When the sheet P is fed to the specified temporary tray and then the trailing end thereof is detected by the sensor (one of S1 to S6) (step n106), the discharge roller set 53 is stopped rotating. Therefore, the sheet P is caught between a pair of the discharge rollers in the discharge roller set 53. Subsequently, the discharge roller set 53 is rotated in the reverse direction (step n107). Alternatively, only the discharge rollers corresponding to the sensor which has detected the trailing end of the sheet P can be rotated in the reverse direction.

As a result, the sheet P is switchback-transported for turning over the sheet P, and fed in the reversed state to the selected tray (step n108). In this case, the gate set 55, etc. are selectively controlled to be switched suitably and guide the sheet P to the selected tray for the reverse transport.

After this process, it is confirmed whether the reverse-discharged sheet P is a hard copy of the final page (step n109). If the sheet P is not the hard copy of the final page, the control operation moves to step n105, and the above-mentioned processes are repeated. By performing such reverse discharge processing, it is possible to pile up the sheets P in page order on the selected tray. When the reverse discharge processing for the sheet P as the final page is completed, the control operation moves to step n110, and it is confirmed whether the reverse discharge processing has been performed for the selected number of sets of sheets P.

If it is understood from the confirmation that the reverse discharge processing for all of the selected number of sets of sheets P has not been completed, a tray on the next level is automatically specified for the selected tray so as to distinguish a set of sheets to be discharged to this tray from a set of sheets which have been piled up in page order on the previously specified selected tray. Moreover, a tray other than the previously specified temporary tray, i.e., a tray located on the next level of the previously specified temporary tray, is specified for the temporary tray (step n111). After this processes, the control operation returns to step n105, and the same processes are repeated. As a result, a set of reversed sheets are piled up in page order on the automatically specified selected tray. When the image formation for the finally specified number of sets is completed and then the sets of sheets P are completely discharged, the copying machine main body 1 and the sheet discharging apparatus 5 move to the standby routine for the next processing.

Therefore, for example, if the specified number of sets are five sets and the initially specified selected tray is the highest tray, the first tray 52*a* to the fifth tray 52*e* store sets of sheets P piled up in page order, respectively. When an arbitrary tray is specified for the selected tray in advance, not only the selected tray is automatically selected, but also the temporary tray for use in the reverse discharge processing is automatically selected in the following processing. After the processing, sets of sheets P having images formed thereon, arranged in page order, are sorted out and stored in the trays, respectively. Thus, the operator can handle the respective sets of the sheets P easily.

In the grouping operation of the copying machine main body 1, the sheets P are reverse-discharged in sequence from the first page to the final page to a tray selected first. Therefore, when the lowest tray 52*f* is specified for the selected tray, the adjacent fifth tray 52*e* above the tray 52*f* is automatically specified for the temporary tray. In this case, in order to further increase the processing speed, after feeding the sheet P to the fifth tray 52*e,* the next sheet P needs to be fed to the fourth tray 52*d* above the fifth tray 52*e.* As a result, the feeding of the sheet P to the fourth tray 52*d* is performed during the reverse-discharge of the sheet P to the fifth tray 52*e,* thereby increasing the processing speed. This is a unique phenomenon produced by selecting the temporary tray according to the selected tray rather than fixing a certain tray for the temporary tray.

Moreover, when the first tray 52*a* on the highest level is specified for the selected tray, the adjacent second tray 52*b* below the selected tray is specified for the temporary tray. Thus, the time taken for the reverse-transport of the sheet P to the selected tray is minimized.

On the contrary, when the first tray 52*a* on the highest level is specified for the selected tray and the lowest tray 52*f* is specified for the temporary tray, the time taken for feeding the sheet P to the lowest temporary tray and the time taken for reverse-transporting the sheet P to the highest selected tray are required, resulting in an increase in the processing time. In this sense, in the above-mentioned structure of the present invention, since the tray nearest to the selected tray is specified for the temporary tray, the time taken for the reverse discharge processing can be shortened. It is thus possible to perform the reverse discharge processing at a speed corresponding to the output speed of the copying machine main body 1.

Furthermore, when the tray below the selected tray is specified for the temporary tray, the sheet P which is kept on standby for the reverse-transport in the temporary tray is not seen by the operator because this sheet P is hidden by the selected tray above the temporary tray. It is thus possible to prevent the operator from removing the standby sheet P in the temporary tray by mistake, and prevent the sheets P from being piled up in wrong page order.

Reverse Discharge Processing VI

Figure 23:
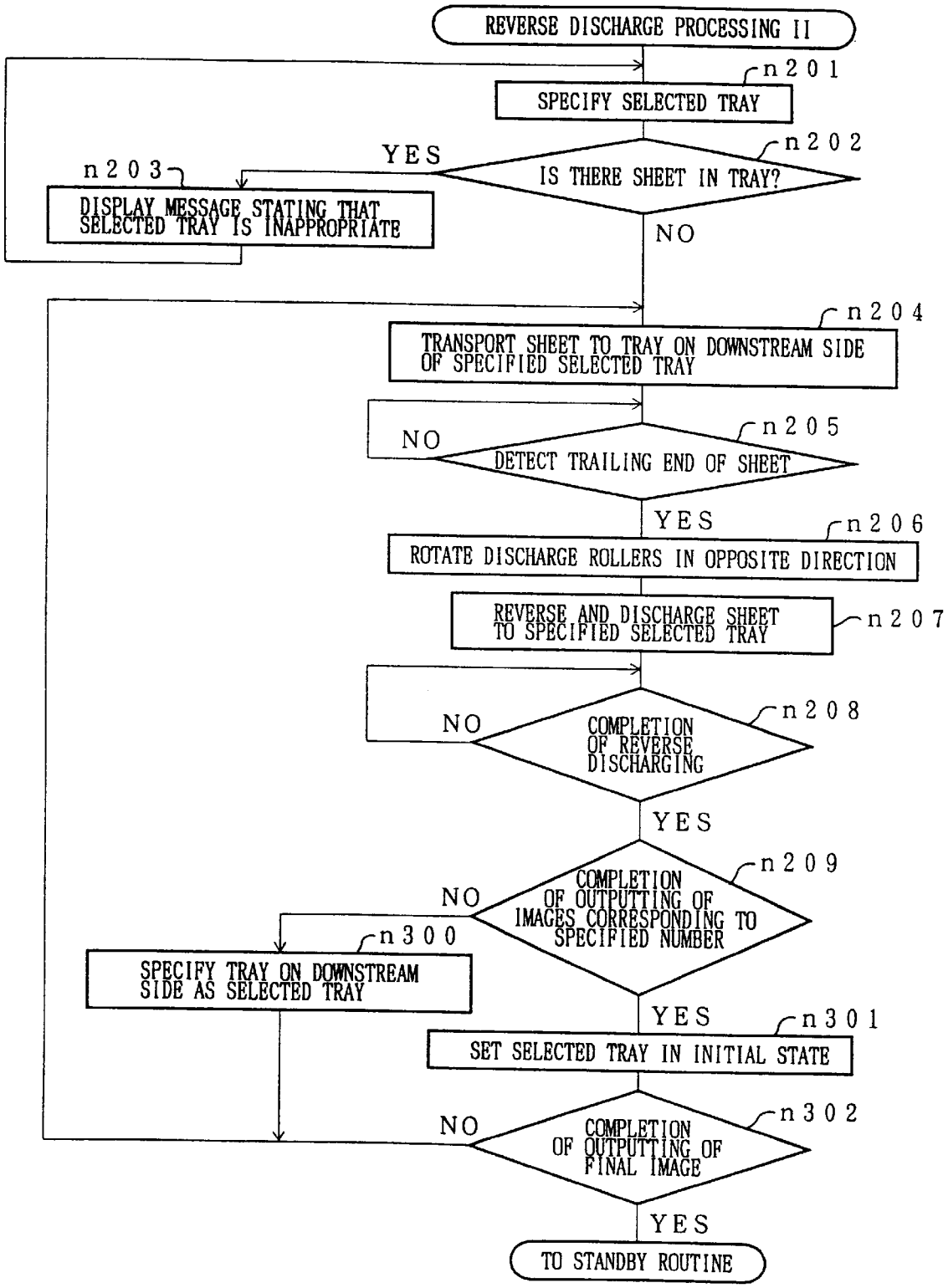
FIG. 23 is a flow chart showing the control steps for the reverse discharge processing according to a yet another embodiment of the sheet discharging apparatus of the present invention.

In reverse discharge processing V explained above, the copying machine main body 1 outputs sets of sheets in the grouping mode. On the contrary, as reverse discharge processing VI, the sorted output by the copying machine main body 1 is explained. In this case, the sheet discharging apparatus 5 needs to be operated in the sorting mode. FIG. 23 shows the flow chart for controlling the discharge processing.

In the sorting mode, as explained above, pieces of the sheets P having the same image formed thereon, corresponding to a specified number of sets, are successively output based on the image data of the first page input to the copying machine main body 1.

When outputting a hard copy in the sorting mode in the state in which the copying machine main body 1 is set in the facsimile mode or the printer mode, control shown in the flow chart of FIG. 23 is executed. As described above, first, if it is necessary to specify a tray for the selected tray, the operator operates the post-processing-mode selecting key 24. As a result, the selecting screen is displayed on the liquid crystal display device 6 as shown in FIG. 24.

If a tray is specified for the selected tray in advance, the routine in step n201 is skipped, and it is confirmed whether the arbitrarily specified selected tray contains the sheet P in step n202. This confirmation is made with the sorter control unit 46 by providing sheet detecting sensors (micro switches, etc., not shown) for the trays 52*a* to 52*f*, respectively, in a conventionally known manner.

If the sheet P is present in the specified selected tray, a message stating that the selected tray is inappropriate is displayed (step n203), and then the control operation returns to step n201 so as to specify another tray for the selected tray. The processes explained above are the same as the processes in steps n101 to n103 shown in FIG. 22 as explained in the section of reverse discharge processing V. The step of specifying a tray for the selected tray is also the same, and it is possible to select an arbitrary tray for the selected tray in the state shown in FIG. 24. Therefore, the explanation thereof will be omitted.

When an arbitrary tray is specified for the selected tray and then the specified tray is confirmed as an appropriate tray, the sorter control unit 46 specifies a tray on a lower level (downstream side) which is adjacent (nearest) to the selected tray for the temporary tray for use in the reverse discharge processing, and controls the feeding of the sheet P output from the copying machine main body 1 (step n204). In the feeding of the sheet P, the rotating direction and the switching position of the gate set 55, the discharge roller set 53, etc. are controlled so as to produce a state in which the sheet P can be fed to the temporary tray.

When the sheet P is fed to the temporary tray located on the downstream side of the selected tray and then the trailing end thereof is detected by the sensor (one of S1 to S6) (step n205), the discharge roller set 53 is stopped rotating. Therefore, the trailing end of the sheet P is caught between a pair of the discharge rollers in the discharge roller set 53. Subsequently, the discharge roller set 53 is rotated in the reverse direction (step n206). Alternatively, in step n206, only the discharge rollers corresponding to the sensor which has detected the trailing end of the sheet P can be rotated in the reverse direction As a result, the sheet P is switchback-transported so as to be turned over, and fed with the image-formed side facing downward to the selected tray mentioned above (step n207). In this case, the gate set 55, etc. are selectively controlled in a suitable manner and guide the sheet P to the selected tray for the reverse transport. Then, when the reverse discharge processing is completed, i.e., when the reverse-transported sheet P is detected by the sensor (one of S1 to S6), the completion of the processing is confirmed (step n208).

After this processing, it is confirmed whether the number of the sheets P which have undergone the reverse discharge processing reaches a number corresponding to the specified number of sets (step n209). If the reverse discharge processing has not been performed the number of times corresponding to the specified number of sets, the selected tray that is a tray to which the sheets P are finally discharged is changed. In this case, a tray on the downstream side which is adjacent to the selected tray, i.e., the temporary tray which has performed the switchback transport of the previously fed sheet P, is specified for the next selected tray (step n300), and then the control operation returns to step n204. By repeating the above-mentioned processes, the sheets P having the image of the same page formed thereon are reversed and then discharged to the sequentially specified selected tray. When the reverse discharge processing has been performed for all the sheets P corresponding to the specified number of sets, the control operation moves to the next step, n301. In this step, the initially specified selected tray is again specified, and then it is confirmed whether the reverse discharge processing has been performed for all the sheets P to be the last page (step n302).

According to this confirmation, if the sorted output of all the sheets P corresponding to the specified number of sets has not been completed, the control operation moves to step n204. In this step, the sheets P on which an image has been formed based on the image data of the next page are reversed, and then discharged to the successively changing selected tray. When an image has been formed on the sheets P corresponding to the specified number of sets based on the image data of the final page, the sheets P are discharged. When the discharge of the sheets P is completed, the copying machine main body 1 and the sheet discharging apparatus 5 move to the standby routine for the next processing.

For example, if the specified number of sets are five sets and the initially specified selected tray is the first tray 52*a* on the highest level, the first tray 52*a* to the fifth tray 52*e* store sets of sheets P piled up in page order, respectively. Moreover, since the reverse-transport of the sheet P to the selected tray is performed at the time the selected tray is sequentially selected, the sheet P is controlled to be fed temporarily to a tray which is located adjacent to and on the lower level (downstream side) of the selected tray. After this process, the sheets P which have been sorted out and arranged in page order are placed on the respective trays. Thus, the operator can easily handle the sheets P.

As explained above, since the reverse transport of the sheets P is performed using a tray in the tray set 52 other than the selected tray in which the reverse-transported sheets P are finally stored, it is possible to perform the reverse discharge processing using the existing means for discharging the sheets P without providing a special switchback mechanism.

In this case, when an arbitrary tray is specified in advance for the selected tray for finally receiving the sheets P, the selected tray is automatically changed whenever a sheet P is output according to the number of copies to be produced, and the temporary tray is also automatically specified. At this time, since the adjacent tray on the downstream side of the selected tray is automatically specified for the temporary tray, the processing time can be shortened. Namely, the time taken for the reverse transport of the sheet P which has been fed to the temporary tray to the selected tray is shortened.

On the other hand, if a lower tray, for example, a tray on the lowest level, is specified for the selected tray, a tray located one level above the selected tray is used for the reverse transport. Therefore, the sheet P is fed to this higher tray, and then fed to the selected tray. Consequently, the transport distance from the temporary tray to the selected tray is minimized, and the time taken for completing the reverse discharge processing is shortened, thereby increasing the speed of the reverse discharge processing.

Another Embodiment of Reverse Discharge Processing: Reverse Discharge Processing VII In the above explanation, the operator can specify an arbitrary tray for the selected tray as shown in FIG. 24. The reverse discharge processing is efficiently performed for a specified number of sets of hard copies according to the specified selected tray.

On the other hand, a selected tray in which the sheets P are finally stored may be automatically specified according to the output mode of the copying machine main body 1, i.e., the copy mode, facsimile mode or printer mode.

For example, in the copy mode, there is no need to turn over the sheet P, and a tray is selected in sequence from the highest tray downward like the conventional structure. On the contrary, in the facsimile mode and printer mode, if the lowest tray is arranged to be automatically specified for the selected tray and the tray to be specified for the selected tray is arranged to change in sequence from the lowest tray upward, it is possible to prevent the operator from confusing the output in the copy mode and the output in the facsimile mode, etc.

Moreover, by making such an arrangement that the tray to be initially specified for the selected tray in the facsimile mode differs from the tray to be initially specified for the selected tray in the printer mode, it is possible to prevent the operator from confusing the outputs in the respective modes. More particularly, when the highest tray is initially specified for the selected tray in the copy mode, the lowest tray is initially specified for the selected tray in the facsimile mode, and the intermediate tray is initially specified for the selected tray in the printer mode automatically, it is possible to prevent the operator from confusing or mixing the outputs in the respective modes.

In this embodiment, the trays are arranged on six levels for the sake of the explanation. However, the trays are usually arranged on 20 levels, or more than 20 levels. Therefore, it is possible to use a large number of trays effectively and perform the reverse discharge processing efficiently.

Furthermore, for example, when a company is organized by a plurality of sections, an exclusive tray may be provided for each section. In this case, if the exclusive tray of each section is specified for the selected tray, the exclusive tray of the other section can be borrowed as the temporary tray when outputting the sheets P in the facsimile mode from the copying machine main body 1. Therefore, the exclusive trays of the respective sections can be used effectively, and the sheets P discharged for each section can be managed easily. Consequently, sets of the sheets P are placed in the exclusive trays of the respective sections, respectively, and the operators of these sections can manage the sheets P easily.

In addition, if the copying machine main body 1 is operated in the facsimile mode or the printer mode to output the sheets P to the respective sections, if an arbitrary section is selected, the exclusive tray provided for the selected section is automatically specified for the selected tray. In the copying machine main body 1, when outputting hard copies to a plurality of related sections, the exclusive trays provided for these sections are specified for the selected trays like the above, and the sheets P having the same image formed thereon can be reverse-discharged to the exclusive trays of the sections.

As described above, a first sheet discharging apparatus of the present invention includes: a plurality of trays for receiving sheets having image formed thereon that are discharged from an image forming apparatus; a sheet transport path disposed to feed the sheets to the plurality of trays, respectively; discharge rollers which are disposed to correspond to the plurality of trays, respectively, and rotatable in the feeding direction of sheets to the respective trays and in the reverse direction; and sheet transport controlling means which specifies one of the plurality of trays for a selected tray that finally receives the sheets in a reversed state in which the front side and back side of the sheets are reversed, specifies a temporary tray that temporarily receives the sheets in a non-reversed state in which the front side and back side of the sheets are not reversed among the trays other than the selected tray according to which tray among the plurality of trays is specified for the selected tray, and controls the discharge rollers so that at least the feeding direction of the sheet by the discharge rollers corresponding to the temporary tray is reversed during the feeding of the sheet to the temporary tray so as to discharge the sheet in the reversed state to the selected tray.

More specifically, if the selected tray is a higher tray among the plurality of trays, the sheets having an image formed thereon are sequentially fed to a single or plural higher or lower non-selected tray(s) other than the selected tray by the sheet transport controlling means, and reverse-discharged to the selected tray in page order of the fed sheets immediately after the completion of the feeding. Consequently, since the reversed sheets are piled up in page order on the selected tray, it is possible to obtain the output sheets in page order.

In particular, by specifying the higher tray for the selected tray, the operator can easily remove the discharged sheets. Moreover, since the existing sorting function can be used as it is for the reverse discharge processing for the sheets and the existing tray can be used as it is for the reverse discharge processing, it is not necessary to increase the overall size of the sheet discharging apparatus nor provide a reversing mechanism (switchback mechanism) in the image forming apparatus. It is thus possible to reduce the sizes of the image forming apparatus and the sheet discharging apparatus, and the cost.

More specifically, the sheet transport controlling means feeds sheets in sequence to a plurality of trays except the selected tray, and keeps the sheets on standby in the respective trays. When the feeding of the sheets to all of the plurality of trays is completed, the sheet transport controlling means keeps the image forming apparatus on standby so as to prevent the succeeding sheets to be fed to the these trays from being discharged. Simultaneously the sheet transport controlling means executes the reverse discharge processing for the plurality of sheets kept on standby in the respective trays in a predetermined order.

Consequently, the trays provided in the sheet discharging apparatus can be used effectively. Moreover, it is possible to successively feed the sheets to the respective trays without intentionally increasing the interval between the sequentially output sheets having an image formed thereon. When the feeding of the sheets is completed, the reverse discharge processing is successively executed. As a result, the reverse discharge processing is performed in the sheet discharging apparatus upon the completion of the output operation in the image forming apparatus without decreasing the output speed. It is thus possible to effectively use spare time.

Furthermore, according to another preferred embodiment, in the reverse discharge processing, the discharge rollers are stopped rotating upon the detection of the trailing end of the sheet by the corresponding sensor. As a result, the discharge rollers are kept on standby in a state in which the trailing end of the sheet is caught between the discharge rollers. In addition, the discharge rollers are rotated in the reverse direction to reverse-transport the sheet. It is thus possible to perform accurate reverse discharge processing without making mistakes in reverse-transporting the sheets or disordering page order. More particularly, since no additional structure is required except for arranging the discharge rollers to be rotatable in the reverse direction, the structure necessary for carrying out the reverse discharge processing is significantly simplified.

In a second sheet discharging apparatus for achieving the object of the present invention, the sheet transport controlling means specifies a lower tray among a plurality of trays for the selected tray. In order to discharge the sheet in the reversed state to the selected tray, the sheet is temporarily fed to a tray above the selected tray without being turned over, and then transported in the reverse direction so as to be discharged to the selected tray. The succeeding sheet is fed to a tray located on a still higher level simultaneously with the reverse discharge processing. At this time, the sheet transport controlling means controls the rotation and rotating direction of the discharge rollers according to the detection of the sheet by a sensor disposed in front of the discharge rollers.

Consequently, since the reverse discharge processing for the previously fed sheet and the feeding of the next sheet can be performed simultaneously, the time taken to complete the reverse discharge processing is shortened. Moreover, a state for receiving the next output sheet can be prepared quickly.

Similarly, the sheet transport controlling means feeds the sheets to the respective trays located above the selected tray in sequence from the tray adjacent to the selected tray upward. Alternatively, the sheet transport controlling means feeds the sheets to the respective trays in sequence from the highest tray downward. When the feeding of the sheets to the respective trays is completed, the sheet transport controlling means executes the reverse discharge processing for the sheets in sequence in which the sheets were fed, and sequentially discharges the sheets to the selected tray located on the downstream side. As a result, the transport direction of the sheet for performing the reverse discharge processing becomes always uniform. Namely, the transport direction in discharging the standby sheets to the selected tray on the lower level can be made the same as the transport direction in feeding the sheet from the image forming apparatus to the tray. Consequently, the transport device is simplified.

When the sheet transport controlling means feeds the sheets to the respective trays in sequence from the highest tray which is most distant from the selected tray downward, there is a case where the image forming apparatus further discharges succeeding sheets though there are no more trays to which the sheet can be fed. Even in such a case, the reverse discharge processing in the highest tray is performed first. Then, when this reverse discharge processing is completed, the feeding of the succeeding sheets continues to be performed. Namely, even when the number of succeeding sheets to be output is not less than the number of trays, it is possible to perform efficient reverse discharge processing. As a result, a great deal of reverse discharge processing can be performed in a short time according to the processing speed of the image forming apparatus.

Alternatively, it is possible to successively execute the reverse discharge processing in a plurality of trays to which the sheets have been fed, and always feed the succeeding sheets from the image forming apparatus to the respective trays in the same tray order upon the completion of the reverse discharge processing for all the previously fed sheets, and repeat the reverse discharge processing. In this arrangement, it is possible to execute a great deal of reverse discharge processing successively by temporarily interrupting the output operation of the image forming apparatus or decreasing the output speed only for a period of time in which the reverse discharge processing is performed.

Furthermore, in the first and second sheet discharging apparatuses, when the sheets reverse-transported from the respective trays are no longer detected by the sensors, if the sheet transport controlling means controls the reverse discharge processing for the sheet which is kept on standby in the next tray to be started, the sheets standing by in the tray can be discharged in proper page order to the selected tray irrespectively of the sizes of the sheets without causing the sheets of different sizes to overlap each other in the transport path.

Additionally, in a third sheet discharging apparatus for achieving the object of the invention, the sheet transport controlling means specifies a tray located in a middle level among a plurality of trays for the selected tray. In this case, the plurality of trays are divided into the trays on the upstream side and the trays on the downstream side by the selected tray as the boundary. The sheet transport controlling means first feeds the sheet to the tray nearest to the selected tray on the upstream side, and feeds the succeeding sheet to the tray nearest to the selected tray on the downstream side. Moreover, after executing the reverse discharge processing for the sheet standing by in the nearest tray on the upstream side upon the completion of the feeding of the sheet to the nearest tray on the downstream side, the sheet transport controlling means performs the reverse discharge processing for the sheet standing by in the nearest tray on the downstream side. If a succeeding sheet is present in the image forming apparatus, the sheet is fed to the nearest tray on the upstream side simultaneously with the reverse discharge processing in the nearest tray on the downstream side. Thus, when the sheets are controlled to be fed to the tray on the upstream side and the tray on the downstream side alternately, the reverse discharge processing is efficiently performed using a small number of trays.

More particularly, when feeding the sheet to the nearest tray on the downstream side and then the succeeding sheet to the nearest tray on the upstream side, if the sheet transport controlling means executes the reverse discharge processing in the nearest tray on the downstream side in feeding the sheet to the nearest tray on the upstream side and controls the feeding and the reverse discharge processing to be performed alternately, it is possible to perform the reverse discharge processing for the previously fed sheet during the feeding of the next sheet, thereby achieving effective processing.

In addition, if the sheet transport controlling means feeds the sheets to a tray on the downstream side or the upstream side with respect to the selected tray and executes the reverse-transport of the sheet to the selected tray according to the detection of the trailing end of the sheet fed to the tray on the downstream side or the upstream side, it is possible to perform the reverse discharge processing accurately, particularly without disordering their page order, irrespectively of the sizes of the sheets.

Moreover, the sheet controlling means can divide a plurality of trays into the tray group on the upstream side and the tray group on the downstream side by the selected tray as the boundary, sequentially feed the sheets to the tray group on the downstream side, and feed the succeeding sheets to the tray group on the upstream side upon the completion of the feeding of the sheets to the tray group on the downstream side. This arrangement enables the reverse discharge processing for the previously fed standby sheet and the feeding of the succeeding sheet to be performed simultaneously. Namely, the reverse discharge processing for the previously fed standby sheet can be executed by effectively using the time taken for feeding the succeeding sheet.

On the other hand, if the selected tray is arbitrarily specified and a tray adjacent to the selected tray is always specified automatically for a temporary tray, when finally discharging a sheet to the selected tray, the time taken for temporarily feeding the sheet to the temporary tray and then discharging the sheet to the selected tray by the reverse-transport is shortened. It is therefore possible to reduce the overall processing time from the start of the discharge of the sheet by the image forming apparatus to the completion of the reverse discharge processing.

Furthermore, since the temporary tray is automatically selected from a plurality of trays appropriately, no tray is fixed for the temporary tray. Namely, a tray that can achieve the highest processing efficiency is specified for the temporary tray.

In addition, in the case where the selected tray is automatically selected according to the output mode of the image forming apparatus, if the selected tray is selected according to the print mode or facsimile mode while considering the tray for use in the copy mode, it is possible to prevent the sheet discharged in the copy mode from being mixed with the sheet discharged in the reversed state on the tray. Namely, when the sheets are successively discharged from the higher trays in the copy mode, it is necessary to select a tray for finally receiving the sheets in the reversed state in sequence from the lower tray upward in the printer mode, etc.

Furthermore, in the above-mentioned sheet discharging apparatus, if means for detecting the sheets stored in the respective trays are provided, and if a tray from which a sheet is detected by the sheet detecting means is excluded from the selected tray or the temporary tray, i.e., the selected tray or the temporary tray is selected from trays containing no sheets, it is possible to prevent the mixture of sheets on a single tray. Additionally, if a tray storing the previously discharged sheet is specified for the temporary tray, a sheet which is temporarily fed to the tray afterward pushes the previously discharged sheet to fall down from the tray or disorders the tidily arranged sheets. However, such problems are prevented by this arrangement.

On the other hand, in the present invention, when discharging more than one set of sheets having images formed thereon from the image forming apparatus, in order to efficiently sort the sheets and to achieve the above-mentioned object, a tray located above or below the selected tray which is specified to receive a first set of sheets is automatically specified for the selected tray for receiving the next set of sheets and a tray adjacent to the selected tray on the higher or lower level is always automatically specified for the temporary tray by the sheet transport controlling means. In this structure, since the tray adjacent to the selected tray is always specified for the temporary tray, it is possible to perform the reverse discharge processing efficiently without changing the processing speed. This is the effect produced by a unique structure of the present invention that does not fix a certain tray for the temporary tray.

Finally, in the above-mentioned sheet discharging apparatus, in order to prevent the reverse-transported sheet from being seen by the operator, it is at least necessary to specify a lower tray adjacent to the selected tray for the temporary tray. More particularly, in the present invention, since the sorting-use bins (trays) which stick out from the apparatus are used for the reverse discharge processing, the sheet which is temporarily fed to the tray is seen by the operator. Thus, there is a possibility that the sheet which is temporarily kept on standby for the reverse discharge processing is removed by the operator by mistake. However, such a problem is prevented by this structure because the sheet kept on standby temporarily is hidden under the selected tray and is not seen by the operator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet discharging apparatus comprising:

a plurality of trays for receiving sheets having images formed thereon that are discharged from an image forming apparatus;

a sheet transport path which is provided to feed the sheets from said image forming apparatus to said plurality of trays, respectively;

discharge rollers which are arranged to correspond to said plurality of trays and rotatable in a direction of feeding the sheets to said trays and in a reverse direction; and sheet transport controlling means which specifies one of said plurality of trays for a selected tray for finally receiving the sheets in a reversed state in which a front side and a back side of the sheets are reversed, selects at least one tray from said plurality of trays except said selected tray for a temporary tray for temporarily receiving the sheets in a non-reversed state in which the front side and the back side of the sheets are not reversed, wherein said temporary tray is selected according to which tray is specified for said selected tray, and controls said discharge rollers so that at least a discharge roller corresponding to said temporary tray is rotated in the reverse direction in feeding the sheets in sequence to said temporary tray and discharges the sheets in the reversed state to said selected tray.

2. The sheet discharging apparatus as set forth in claim 1, wherein said sheet transport controlling means includes tray specifying means, and when a plurality of temporary trays are selected for said temporary tray, said tray specifying means specifies a first order in which the sheets are fed to said plurality of temporary trays and a second order in which the sheets are discharged from said plurality of temporary trays to said selected tray, said first order and said second order being specified according to which tray among said plurality of trays is specified for said selected tray.

3. The sheet discharging apparatus as set forth in claim 1, further comprising sensors for detecting whether the sheets are present or not, each of said sensors being disposed on an upstream side of said discharge rollers in a transport direction in which the sheets are fed to said trays through said sheet transport path, wherein said sheet transport controlling means controls a rotation and rotating direction of each of said discharge rollers according to a detection of the sheets by said sensors.

4. The sheet discharging apparatus as set forth in claim 1, wherein said plurality of trays are arranged on different levels in said sheet discharging apparatus, and when said sheet transport controlling means specifies one tray on a highest level among said plurality trays for said selected tray, said sheet transport controlling means controls the rotation and the rotating direction of said discharge rollers so that the sheets are fed in page order to non-selected trays other than said selected tray in sequence from a highest tray among said non-selected tray downward and that the sheets are discharged in the reversed state in page order from said non-selected trays to said selected tray on completion of the feeding of the sheets to said non-selected trays.

5. The sheet discharging apparatus as set forth in claim 1, wherein said plurality of trays are arranged on different levels in said sheet discharging apparatus, and when said sheet transport controlling means specifies one tray on a highest level among said plurality of trays for said selected tray, said sheet transport controlling means controls the rotation and the rotating direction of said discharge rollers so that the sheets are fed in page order to non-selected trays other than said selected tray in sequence from a lowest tray among said non-selected trays upward and that the sheets are discharged in the reversed state in page order from said non-selected trays to said selected tray on completion of the feeding of the sheets to said non-selected trays.

6. The sheet discharging apparatus as set forth in claim 1, wherein, when said sheet transport controlling means specifies a plurality of temporary trays for said temporary tray, said sheet transport controlling means instructs controlling means of said image forming apparatus to pause an output of succeeding sheets on completion of feeding of the sheets to all of said plurality of temporary trays.

7. The sheet discharging apparatus as set forth in claim 1, further comprising sensors for detecting whether the sheets are present or not, each of said sensor being disposed on an upstream side of said discharge rollers in a transport direction in which the sheets are fed to said trays through said sheet transport path, wherein, when said sensors detect trailing ends of the sheets, said sheet transport controlling means controls said discharge rollers to stop rotating so that the detected sheets are kept on standby in a state in which the trailing ends of the detected sheets are positioned on said discharge rollers, and to rotate in the reverse direction so that the detected sheets are discharged in the reversed state to said selected tray.

8. The sheet discharging apparatus as set forth in claim 1, wherein said plurality of trays are arranged on different levels in said sheet discharging apparatus, and when said sheet transport controlling means specifies one tray on a low level among said plurality of trays for said selected tray, said sheet transport controlling means selects a tray on a high level which is above said tray on the low level for said temporary tray.

9. The sheet discharging apparatus as set forth in claim 1, wherein said plurality of trays are arranged on different levels in said sheet discharging apparatus, and when said sheet transport controlling means specifies one tray on a low level among said plurality trays for said selected tray, said sheet transport controlling means selects the tray on a high level which is adjacent to said tray on the low level for said temporary tray.

10. The sheet discharging apparatus as set forth in claim 8, wherein said sheet transport controlling means controls said discharge rollers to temporarily feed one of the sheets in the non-reversed state to said tray on the high level, and reverse-transport the one of the sheets from said tray on the high level to said selected tray while temporarily feeding a succeeding sheet in the non-reversed state to a tray on a higher level than said tray on the high level.

11. The sheet discharging apparatus as set forth in claim 1, wherein said plurality of trays are arranged on different levels in said sheet discharging apparatus, and when said sheet transport controlling means specifies one tray on a low level among said plurality trays for said selected tray, said sheet transport controlling means controls said discharge rollers so that the sheets are temporarily fed in the non-reversed state to upper trays ranging from the tray on a high level which is adjacent to said tray on the low level to the tray on a highest level in order from said tray on the high level toward said tray on the highest level, and the sheets are reverse-transported from said upper trays to said selected tray in said order on completion of the feeding of the sheets to said upper trays.

12. The sheet discharging apparatus as set forth in claim 1, wherein said plurality of trays are arranged on different levels in said sheet discharging apparatus, and when said sheet transport controlling means specifies one tray on a low level among said plurality trays for said selected tray, said sheet transport controlling means controls said discharge rollers so that the sheets are temporarily fed in the non-reversed state to upper trays which are disposed between said tray on the low level and the tray on a highest level which is most distant from said tray on the low level in order from said tray on the highest level toward said tray on the low level, and the sheets are reverse-transported from said upper trays to said selected tray in said order on completion of the feeding of the sheets to said upper trays.

13. The sheet discharging apparatus as set forth in claim 1, when the number of trays that can be selected for said temporary tray is less than the number of sheets to be output successively from said image forming apparatus, said sheet transport controlling means instructs controlling means of said image forming apparatus to stop outputting the sheets in one cycle in which reverse-discharge processing for discharging a sheet which has been fed in the non-reversed state to said temporary tray to said selected tray in the reversed state is performed with respect to all the trays selected for said temporary tray.

14. The sheet discharging apparatus as set forth in claim 13, wherein said sheet transport controlling means instructs said controlling means to resume the output of the sheets on completion of one cycle of reverse-discharge processing so as to continue a next cycle of reverse discharge processing.

15. The sheet discharging apparatus as set forth in claim 14, wherein said sheet transport controlling means controls said discharge rollers so that the feeding of sheets in the non-reversed state to all the trays selected for said temporary tray and the reverse-discharge processing are repeated in a same order in said one cycle and said next cycle.

16. The sheet discharging apparatus as set forth in claim 2, further comprising sensors for detecting whether the sheets are present or not, each of said sensors being disposed on an upstream side of said discharge rollers in a transport direction in which the sheets are fed to said trays through said sheet transport path, wherein, when a sensor corresponding to a temporary tray among said plurality of temporary trays no longer detects the sheet discharged from said temporary tray to said selected tray, said sheet transport controlling means controls the rotation and rotating direction of said discharge rollers so that a next sheet is discharged from a next temporary tray to said selected tray.

17. The sheet discharging apparatus as set forth in claim 1, wherein said plurality of trays are arranged on different levels in said sheet discharging apparatus, and when said plurality of trays are divided into a higher tray group and a lower tray group with a certain tray therebetween, said sheet transport controlling means selects said certain tray for said selected tray and selects the trays other than said selected tray for said temporary trays.

18. The sheet discharging apparatus as set forth in claim 17, wherein said sheet transport controlling means controls said discharge rollers so that sheets are successively fed in the non-reversed state to the tray on a high level which is adjacent to said selected tray and to the tray on a low level which is adjacent to said selected tray in this order, and reverse discharge processing for discharging the sheets which have been fed in the non-reversed state to said temporary trays to said selected tray in the reversed state is successively performed in said tray on the high level and said tray on the low level in this order, and if a succeeding sheet discharged from said image forming apparatus is still present, the succeeding sheet is fed in the non-reversed state to said tray on the high level during the reverse-discharge processing in said tray on the low level.

19. The sheet discharging apparatus as set forth in claim 17, wherein said sheet transport controlling means controls said discharge rollers to successively feed the sheets in the non-reversed state to the tray on a low level adjacent to said selected tray and to the tray on a high level adjacent to said selected tray in this order, and discharge one of the sheets which have been fed in the non-reversed state to said tray on the low level to said selected tray in the reversed state during the feeding of the other of the sheets to said tray on the high level.

20. The sheet discharging apparatus as set forth in claim 17, further comprising:

sensors for detecting whether the sheets are present or not, each of said sensors being disposed on an upstream side of said discharge rollers in a transport direction in which the sheets are fed to said trays through said sheet transport path, wherein said sheet transport controlling means controls said discharge rollers to feed the sheets in the non-reversed state to said upper tray group and said lower tray group, and discharge the sheets fed to said upper tray group and said lower tray group in the reversed state to said selected tray as trailing ends of the sheets fed to said upper tray group and said lower tray group are detected by said sensors.

21. The sheet discharging apparatus as set forth in claim 17, wherein said sheet transport controlling means controls said discharge rollers to feed the sheets in the non-reversed state to said lower tray group, feed succeeding sheets discharged from said image forming apparatus to said upper tray group on completion of the feeding of the sheets to said lower tray group, and discharge the sheets fed to said lower tray group to said selected tray in the reversed state during the feeding of the sheets to the upper tray group.

22. The sheet discharging apparatus as set forth in claim 1, further comprising a select key for allowing an operator to select an arbitrary tray for said selected tray from said plurality of trays.

23. The sheet discharging apparatus as set forth in claim 22, further comprising a display device for showing a depiction of said plurality of trays and an arrow indicating one of said plurality of trays according to an input entered by the operator through said selected key.

24. The sheet discharging apparatus as set forth in claim 22, wherein said sheet transport controlling means controls the discharge rollers so that the tray, which is adjacent to said selected tray arbitrarily selected through said select key, is selected for said temporary tray.

25. The sheet discharging apparatus as set forth in claim 24, wherein said sheet transport controlling means controls the discharge rollers so that said selected tray is selected according to a mode of said image forming apparatus which is set depending on a way of discharging the sheets to said plurality of trays, and the number of sets of sheets placed separately on said plurality of trays.

26. The sheet discharging apparatus as set forth in claim 22, further comprising sheet detecting means in each of said plurality of trays, for detecting whether a sheet is present, wherein said sheet transport controlling means specifies said selected tray or said temporary tray from said plurality of trays except the tray in which the sheet is detected by said sheet detecting means.

27. The sheet discharging apparatus as set forth in claim 1, wherein said plurality of trays are disposed so that there is one tray or are two trays adjacent to each of said plurality of trays, and when said image forming apparatus repeatedly outputs sets of sheets, said sheet transport controlling means controls said discharge rollers so that (1) a first temporary tray for receiving a first set of sheets to be output first in the non-reversed state, and a first selected tray for receiving the first set of sheets in the reversed state are selected from adjacent trays among said plurality of trays, (2) said first temporary tray is specified for a second selected tray for receiving a second set of sheets to be output next in the reversed state, and (3) other tray adjacent to said first temporary tray is specified for a second temporary tray for receiving the second set of sheets in the non-reversed state.

28. The sheet discharging apparatus as set forth in claim 27, wherein, when said plurality of trays are arranged on different levels in said sheet discharging apparatus, said first temporary tray is the tray which is located below and adjacent to said first selected tray.

29. The sheet discharging apparatus as set forth in claim 27, wherein, when said plurality of trays are arranged on different levels in said sheet discharging apparatus, said first temporary tray is the tray which is located above and adjacent to said first selected tray.

30. The sheet discharging apparatus as set forth in claim 29, wherein said sheet transport controlling means controls said discharge rollers so that discharge of the set of sheets which have been transported to said first temporary tray to said first selected tray in the reversed state and transport of the second set of sheets to said second temporary tray are performed simultaneously.

31. The sheet discharging apparatus as set forth in claim 1, further comprising:

a sheet entrance opening for receiving sheets output from said image forming apparatus; and transport rollers, disposed to correspond to said sheet entrance opening, for transporting the sheets to said sheet transport path, wherein said sheet transport controlling means controls said transport rollers so that, when number Ns of the sheets output from said image forming apparatus is not less than number N of said plurality of trays and when Ns−(N−1) is not more than (N−1), said Ns−(N−1) sheets are successively output from said image forming apparatus before (N−1) sheets.

32. The sheet discharging apparatus as set forth in claim 1, further comprising:

a retransport path, branched from said sheet transport path, for returning a sheet output from said image forming apparatus to said image forming apparatus; and a gate, disposed at a crossroads where said sheet transport path and said retransport path cross, for selectively switching four destinations of sheets.

33. The sheet discharging apparatus as set forth in claim 32, wherein said gate forms a straight guide path and two curved guide paths arranged symmetrically with said straight guide path therebetween, and said gate is allowed to turn at said crossroads so as to connect two destinations arbitrarily selected from said four destinations according to an angle formed by said straight guide path and said sheet transport path or said retransport path.

34. The sheet discharging apparatus as set forth in claim 33, wherein said sheet transport controlling means controls a discharge roller corresponding to said tray to which the sheet has been fed and controls the turn of said gate so that the sheet is temporarily fed to any one of said plurality of trays through said gate, and the sheet is sent in the reversed state to said retransport path by rotating said corresponding discharge roller in a reverse direction.

* * * * *